US010676962B1

(12) United States Patent
Weinerman et al.

(10) Patent No.: US 10,676,962 B1
(45) Date of Patent: Jun. 9, 2020

(54) LATCH APPARATUS

(71) Applicant: The Eastern Company, Cleveland, OH (US)

(72) Inventors: Lee S. Weinerman, Medina, OH (US); Scott Arthurs, Brunswick, OH (US); Grant A. Lugas, Elyria, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 293 days.

(21) Appl. No.: 15/615,208

(22) Filed: Jun. 6, 2017

Related U.S. Application Data

(63) Continuation-in-part of application No. 14/541,332, filed on Nov. 14, 2014, now Pat. No. 9,809,999.

(60) Provisional application No. 62/352,751, filed on Jun. 21, 2016, provisional application No. 61/908,415, filed on Nov. 25, 2013.

(51) Int. Cl.

| | |
|---|---|
| ***E05B 47/00*** | (2006.01) |
| ***E05B 81/34*** | (2014.01) |
| ***E05B 81/06*** | (2014.01) |
| *E05B 81/12* | (2014.01) |

(52) U.S. Cl.
CPC ..... *E05B 47/0001* (2013.01); *E05B 47/0012* (2013.01); *E05B 81/06* (2013.01); *E05B 81/34* (2013.01); *E05B 81/12* (2013.01); *E05B 2047/0014* (2013.01)

(58) Field of Classification Search
CPC ..... E05B 81/34; E05B 81/28; E05B 81/64; E05B 85/02; E05B 79/04; E05B 81/68; Y10T 292/1018; Y10T 292/1079; Y10T 70/5907
See application file for complete search history.

(56) References Cited

U.S. PATENT DOCUMENTS

| | | | | |
|---|---|---|---|---|
| 5,076,625 | A * | 12/1991 | Oxley | E05B 47/0047 292/201 |
| 6,102,453 | A * | 8/2000 | Cetnar | E05B 77/28 292/199 |
| 6,386,599 | B1 * | 5/2002 | Chevalier | E05B 81/14 292/201 |
| 8,047,585 | B1 * | 11/2011 | Peabody | E05B 47/0046 292/340 |
| 8,096,594 | B2 * | 1/2012 | Uyeda | E05B 47/0046 292/341.15 |

(Continued)

*Primary Examiner* — Mark A Williams
(74) *Attorney, Agent, or Firm* — Ralph E. Jocke; Colin P. Cochran; Walker & Jocke

(57) ABSTRACT

An actuator (24, 528, 606, 646, 670, 700, 702) is configured to cause a latch assembly (22, 322, 422, 522, 526, 604, 644, 668, 694) to be changed from a closed condition in which an item is latched, to an open condition in which the item is unlatched. A catch jaw (30, 530, 690) is operative in a first position to engage a member (106) connected to the item when the latch assembly is in the closed condition. The catch jaw in a second position enables the member to disengage from the catch jaw when the latch assembly is in the open condition. The actuator assembly includes a drive (152, 526, 608, 706) and a gear system (157, 563, 610, 712). The gear system is operative to move a release member (174, 538, 612, 722, 764). The release member is configured to be in operative connection with the catch jaw such that the movement of the release member causes the catch jaw to be enabled to move to the second position.

35 Claims, 33 Drawing Sheets

(56) References Cited

U.S. PATENT DOCUMENTS

| | | | | |
|---|---|---|---|---|
| 8,757,677 | B2 * | 6/2014 | Wintersteiger | E05B 47/0696 292/201 |
| 2005/0067840 | A1 * | 3/2005 | Koveal | E05B 47/0012 292/95 |
| 2008/0169657 | A1 * | 7/2008 | Horton | E05B 83/30 292/220 |

* cited by examiner

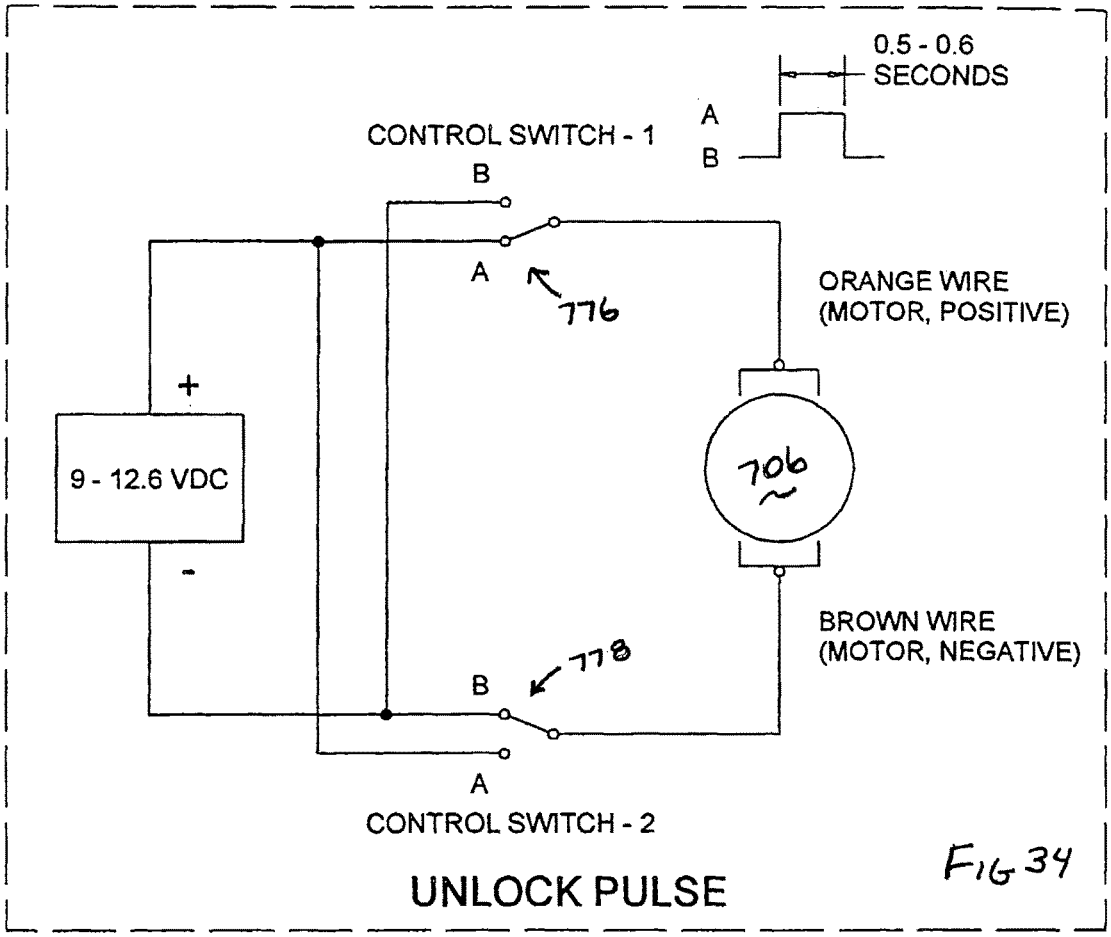
UNLOCK PULSE
FIG 34
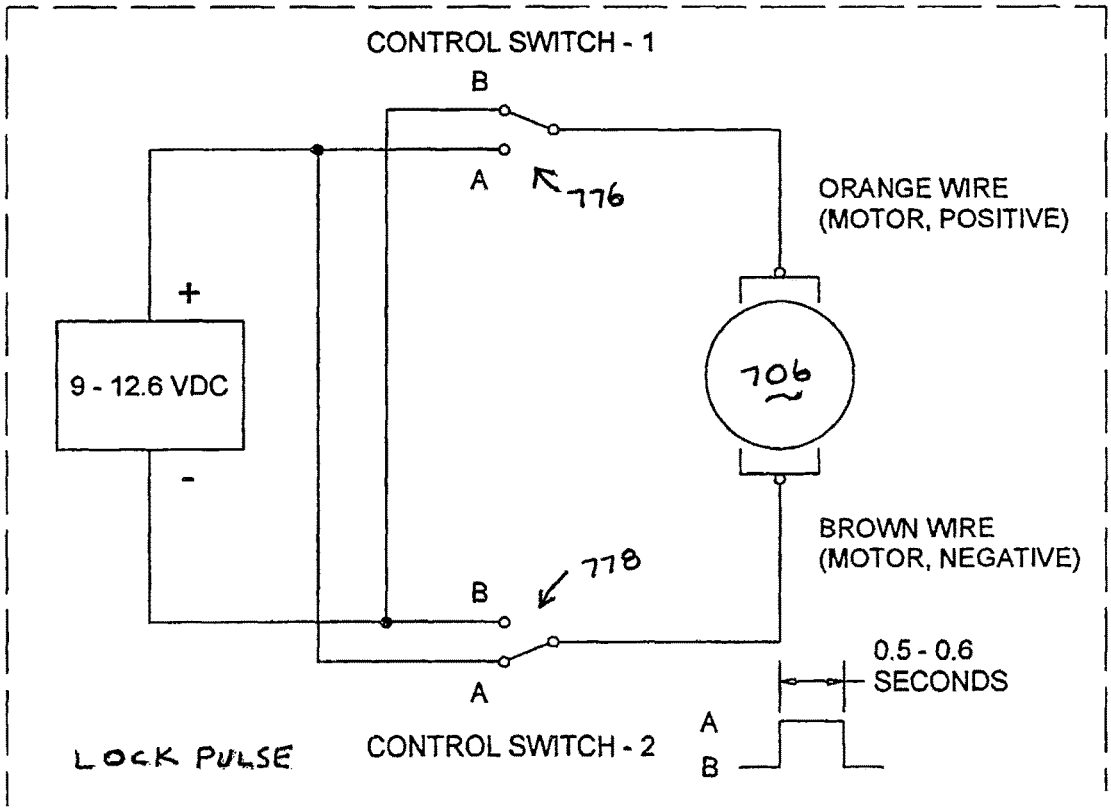
LOCK PULSE

704

LATCH APPARATUS

CROSS REFERENCE TO RELATED APPLICATIONS

This Application claims benefit pursuant to 35 U.S.C § 119(e) of Provisional Application Ser. No. 62/352,751 filed Jun. 21, 2016. This Application is a continuation-in-part of U.S. application Ser. No. 14/541,332 filed Nov. 14, 2014, which claims benefit pursuant to 35 U.S.C. § 119(e) of Provisional Application Ser. No. 61/908,415 filed Nov. 25, 2013. The disclosures of these prior applications are incorporated herein by reference in their entirety.

TECHNICAL FIELD

Exemplary embodiments relate to a latching mechanism for holding an item in a relatively fixed position and selectively releasing the item from engagement with the latching mechanism when desired.

BACKGROUND

Latches and particularly rotary type latches are useful for holding doors or other items in a fixed position. For example, the rotary latch may hold a door in a closed position closing a compartment. Latches may be selectively released when desired. Some latches may be opened or released manually through movement of one or more release levers in response to manual movement of an item such as a handle. Other latches may include an electrical actuator that is used to selectively release the latch. Such an electrical actuator may operate to release the latch in response to electrical signals. Some latches may include structures that enable the latch to be released either in response to manual movement or in response to an electrical actuator. Such latches and actuators may benefit from improvements.

SUMMARY

The following is a brief summary of the subject matter that is described in greater detail herein. This summary is not intended to be limiting as to the scope of the claims.

In one aspect of an exemplary embodiment, an actuator is provided that is configured for causing a latch assembly to be changed from a closed condition in which an item is held in latched engagement with the latch, to an open condition in which the item is unlatched and disengageable from the latch. The latch assembly includes a catch jaw. The catch jaw is movably configured to be in a first position to engage a member connected to the item when the latch assembly is in the closed condition. The catch jaw is configured to be movable to a second position in which the member may disengage from the catch jaw when the latch assembly is in the open condition.

The exemplary actuator assembly includes a drive and a gear system. The gear system is operatively connected to the drive. The gear system is configured to move a release member. The release member is operative to move in a first direction in response to operation of the drive. The release member is configured to be operatively associated with the catch jaw such that the movement of the release member a distance in a first direction enables the catch jaw to be movable to the second position. The exemplary actuator is a separate unit that may be releasably engaged with the latch assembly.

In another aspect of an exemplary embodiment, an apparatus is provided that includes a latch assembly. The latch assembly is operative to be placed in a closed condition for latching an item and an open condition for unlatching an item. The exemplary latch assembly comprises a moveable catch jaw. The catch jaw is operative in a first position to engage a member connected to the item when the latch assembly is in the closed condition. The catch jaw is configured to be selectively movable to a second position to allow the member to disengage from the catch jaw when the latch assembly is in the open condition. The exemplary apparatus further includes an actuator. The actuator includes a drive and a release member. The drive is in operative connection with the release member. The release member is in operative connection with the catch jaw. The release member is operative to linearly move a distance in a first direction in response to operation of the drive, wherein the linear movement of the release member in the first direction enables the catch jaw to move to the second position.

In another aspect of an exemplary embodiment, an apparatus is provided that includes a latch assembly. The latch assembly is configured to be selectively placed in a closed condition for latching engagement with an item and an open condition for unlatching an item. The exemplary latch assembly includes a moveable catch jaw. The catch jaw is operative in a first position to engage a member operatively connected to the item when the latch assembly is in the closed condition. The catch jaw is operative in a second position to allow the member to disengage from the catch jaw when the latch assembly is in the open condition. The exemplary apparatus further includes an actuator. The actuator includes a drive and a gear system. The drive is operatively connected to the gear system. The exemplary gear system moves a release member. The release member is operative to move a distance in a first direction in response to operation of the drive. The release member is configured to be operatively associated with the catch jaw such that the movement of the release member in the first direction enables the catch jaw to be moved to the second position. The exemplary actuator is a unit that is separable from the latch assembly.

Other aspects of exemplary embodiments will be explained with reference to the following detailed description and drawing figures.

BRIEF DESCRIPTION OF THE DRAWINGS

FIG. 34 are schematic views of an exemplary control circuit for controlling operation of the motor of an exemplary latch actuator.

DETAILED DESCRIPTION

Figure 1:
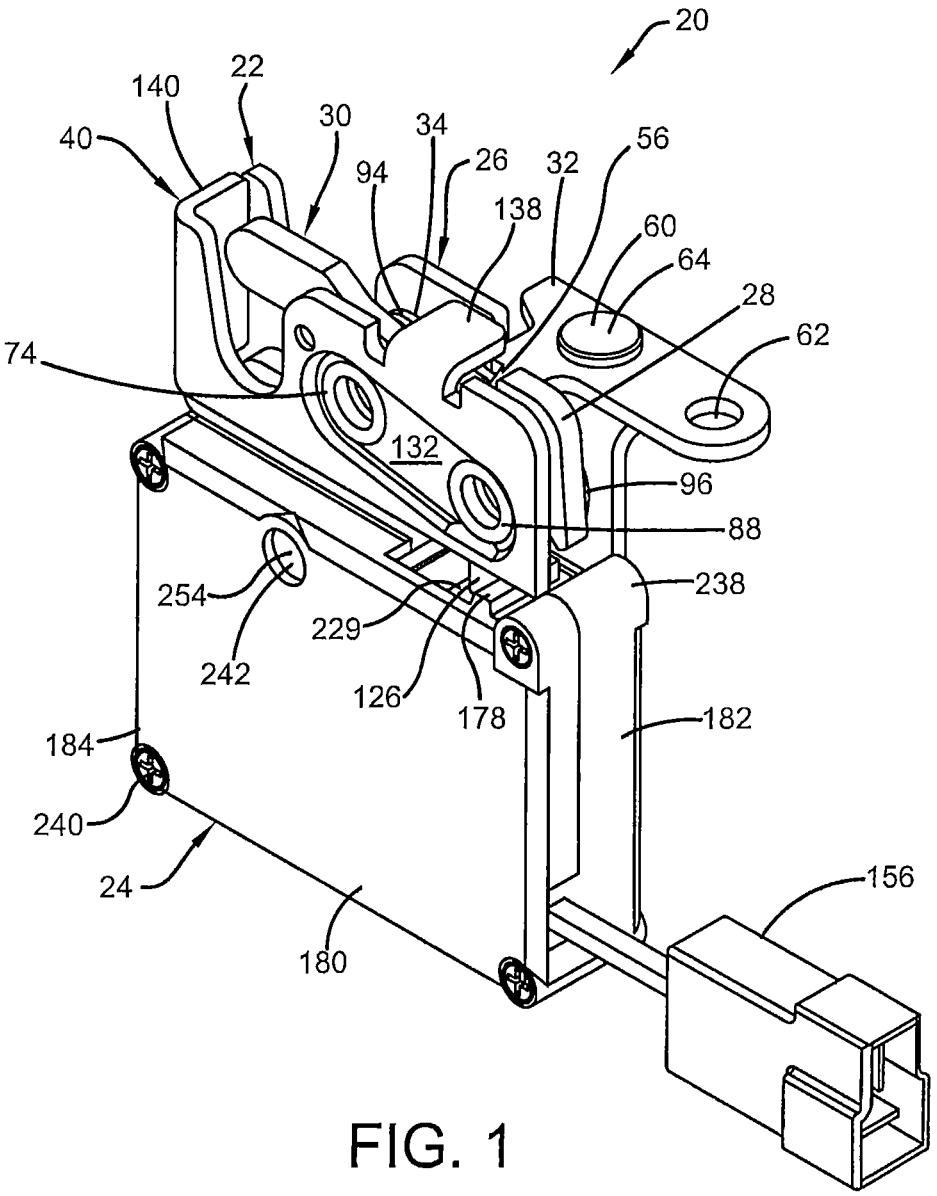
FIG. 1 is a front and right perspective view of an apparatus according to an exemplary embodiment.

Various features and relationships pertaining to exemplary embodiments of a latch apparatus and actuator will now be described with reference to the drawings, where like reference numerals represent like elements throughout. In the following description of the exemplary embodiments, the terms "clockwise", "counterclockwise", "front", "rear", "right", "rightwardly", "left", "leftwardly" "top", "bottom", "forwardly", "rearwardly", "upper", "upwardly", "lower", and "downwardly" are used with reference to the views of the Figures unless indicated otherwise. Those having ordinary skill in the art will recognize that these terms are used descriptively of the Figures, and do not represent limitations on the scope of the claimed embodiments, as defined by the claims hereof.

With reference to FIG. 1, a front perspective view of an exemplary embodiment of an apparatus 20 is illustrated. The apparatus 20 may include a rotary latch assembly 22 and a separate electrical actuator 24 for actuating the latch assembly 22.

Figure 2:
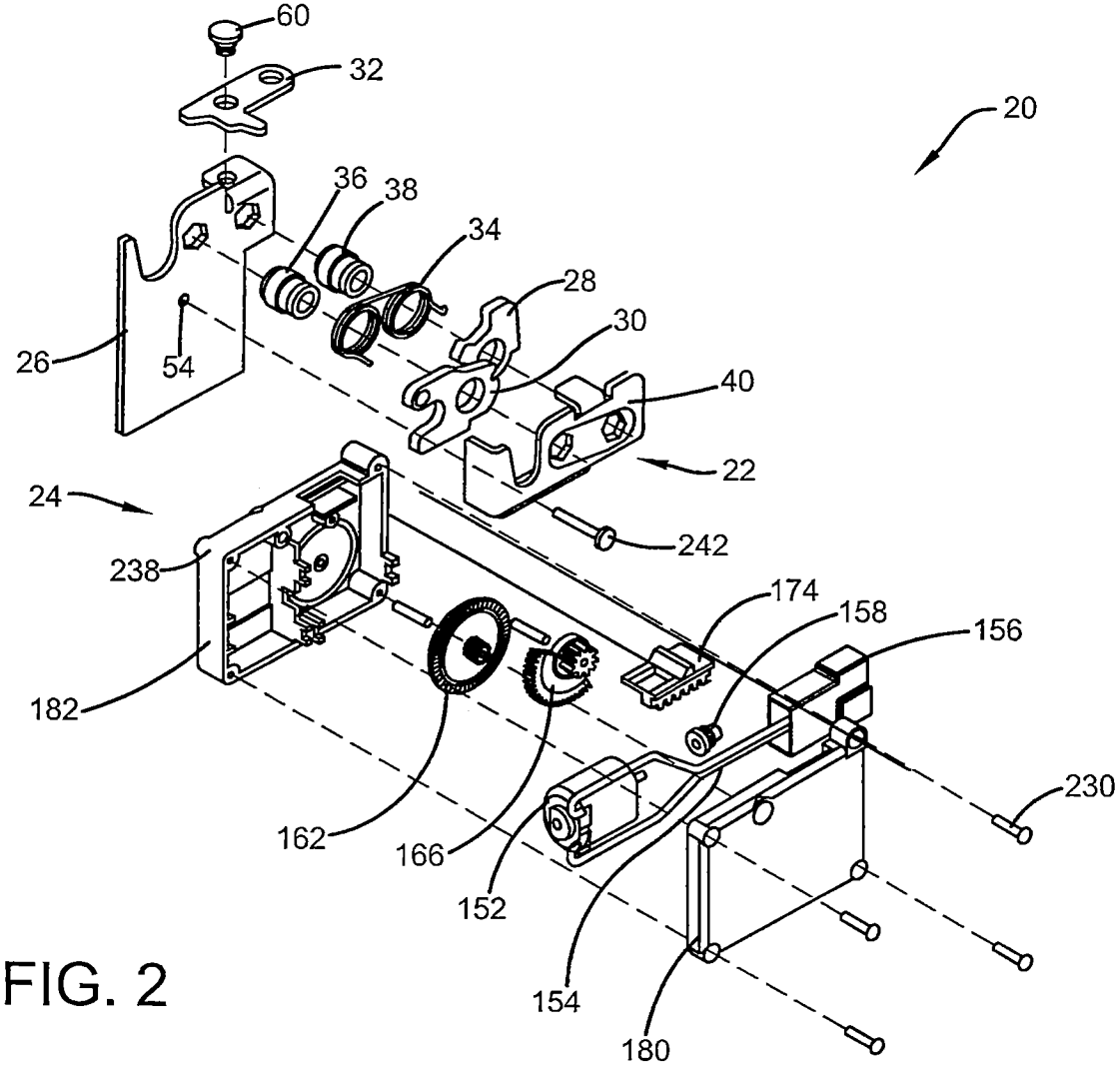
FIG. 2 is a front and left exploded view of the apparatus of FIG. 1.
Figure 3:
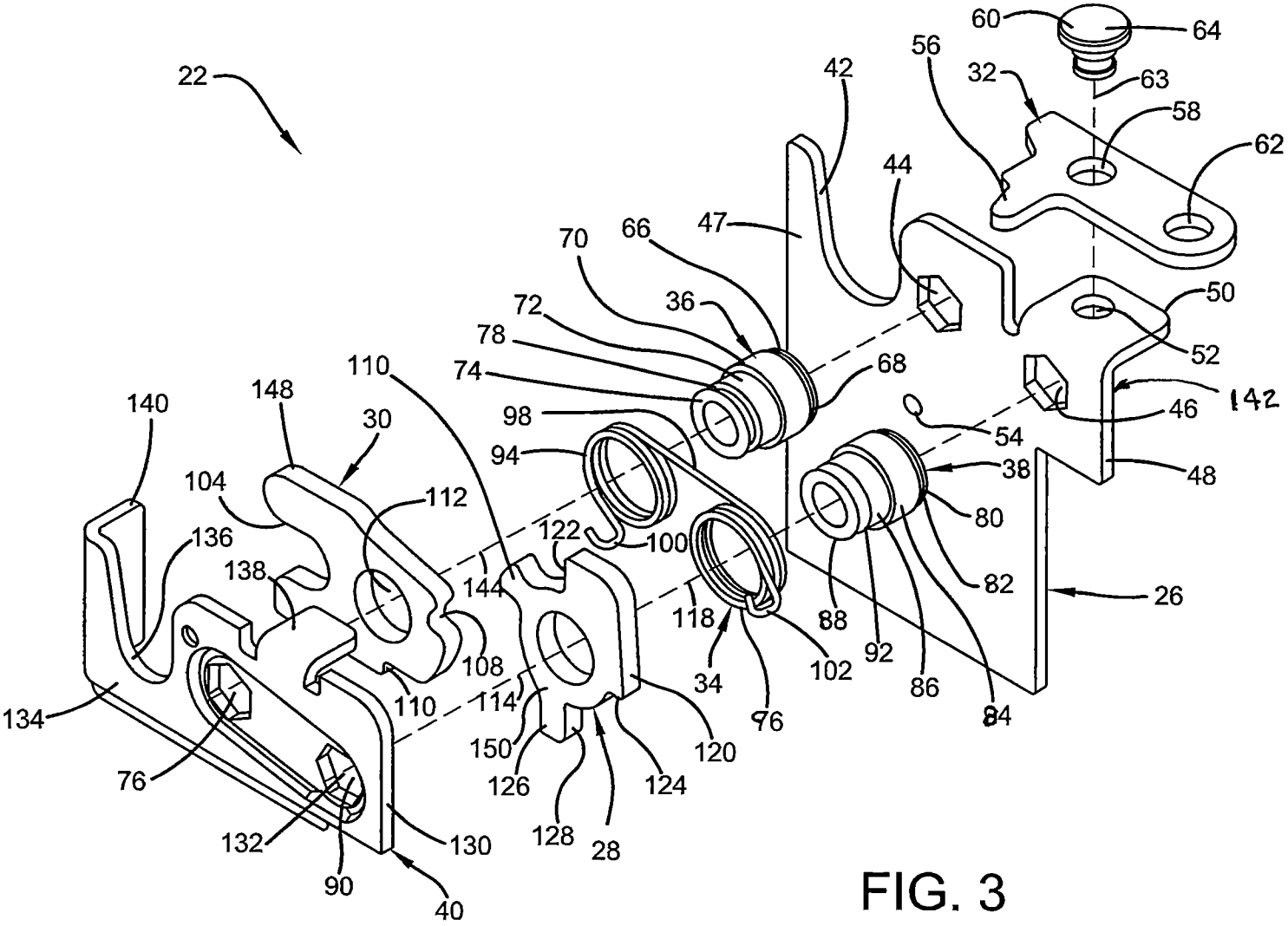
FIG. 3 is a front and right exploded view of the latch assembly of the apparatus of FIG. 1.

The exemplary actuator is used to selectively change the latch apparatus from a latched (closed) condition to an unlatched (open) condition. Of course this arrangement is exemplary and in other embodiments other arrangements may be used. As shown in FIGS. 2 and 3, the exemplary latch assembly includes a latch plate 26, release pawl 28, catch jaw 30, actuation or release lever 32, double torsion spring 34, first and second spacers 36, 38, and a cover plate 40. Referring to FIG. 3, the exemplary latch plate 26 includes a u-shaped cut out 42 formed in the upper edge of the latch plate 26 near the left side of the latch plate 26. First and second apertures 44, 46 are formed in the upper portion 47 of the latch plate 26. The second aperture 46 is formed in a right offset portion 48. A tab 50 is integrally formed with the upper end of the offset portion 46 and extends rearwardly from the upper end of the offset portion 46. The tab includes an aperture 52. The exemplary latch plate 26 further includes a mounting aperture 54 located below the first aperture 52 for receiving a rivet or other fastener for purposes later explained in detail. The exemplary latch plate 26 is formed in one piece of metal or other suitable rigid material.

The exemplary release lever 32 is formed from one piece of metal or other suitable rigid material. The release lever 32 includes a projection 56 located near the left side of the lever 32. The release lever 32 includes a pivot aperture 58 for receiving a shoulder rivet 60 and an aperture 62 for operative connection to a cable, rod or other member that can be moved in response to manual or other movement of an operatively connected handle or similar movable structure. The release lever 32 is rotatably mounted in connection with the tab 50 via the shoulder rivet 60 and rotates relative to the tab 50 about an axis 63. In particular, the shoulder rivet 60 extends through the aligned apertures 58, 52 of the release lever 32 and tab 50, with an enlarged head 64 of the rivet positioned adjacent the upper surface of the release lever 26 as also shown in FIG. 1.

Figure 8:
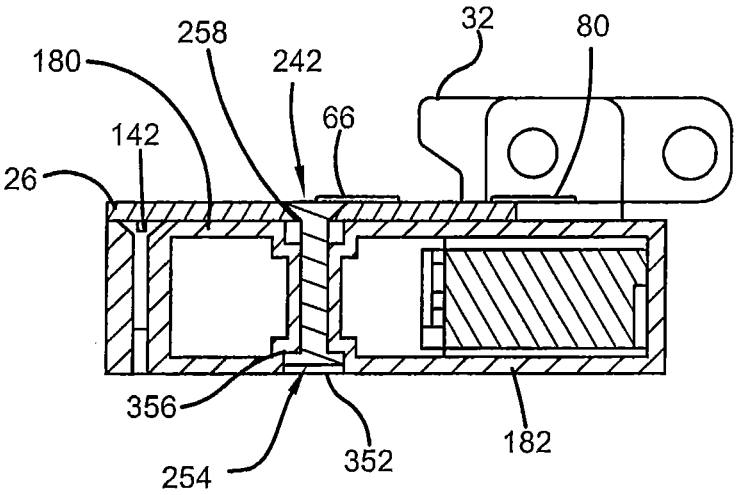
FIG. 8 is a sectional view taken along line 8-8 of FIG. 7 but viewed from the back or rear side of FIG. 7.

As represented in FIG. 3, the first spacer 36 of the exemplary arrangement is generally cylindrical in shape and formed as one piece. The first spacer 36 includes a rear annular flange 66 integrally formed around the rear end of the first spacer 36. The rear flange 66 is beveled (as also seen in FIG. 8), tapering rearwardly to facilitate insertion of the rear flange 66 of the first spacer 36 through the first aperture 44. An annular groove 68 is formed in the first spacer 36 and located forwardly adjacent the rear flange 66. The exemplary first spacer 36 also includes a central portion 70 for positioning the torsion spring 34. Forwardly adjacent the central portion 70 is a front annular portion 72 that has a smaller diameter than that of the central portion 70. The front annular portion 72 rotatably supports the catch jaw 30. The first spacer 36 includes a front annular flange 74 integrally formed around the front end of the first spacer 36. The front flange 74 is beveled, tapering forwardly to facilitate insertion of the front flange 74 through an aperture 76 of the cover plate 40. An annular groove 78 is formed in the first spacer 36 and located between the front flange 74 and front annular portion 72.

The exemplary second spacer 38 is similar in construction to the first spacer 36. In particular, the second spacer 38 is generally cylindrical in shape and formed as one piece. The second spacer 38 includes a rear annular flange 80 integrally formed around the rear end of the second spacer 38. The rear flange 80 is beveled (as also seen in FIG. 8), tapering rearwardly to facilitate insertion of the rear flange 80 of the second spacer 38 through the second aperture 46. An annular groove 82 is formed in the second spacer 38 and located forwardly adjacent the rear flange 80. The second spacer 38 also includes a central portion 84 for positioning the torsion spring 34. Forwardly adjacent the central portion 84 is a front annular portion 86 that has a smaller diameter than that of the central portion 84. The front annular portion 86 rotatably supports the release pawl 28. The second spacer 38 includes a front annular flange 88 integrally formed around the front end of the second spacer 38. The front flange 88 is beveled, tapering forwardly to facilitate insertion of the front flange 88 through an aperture 90 of the cover plate 40. An annular groove 92 is formed in the second spacer 38 and located between the front flange 88 and front annular portion 86.

The double torsion spring 34 of the exemplary arrangement serves as a unitary biasing device and includes first and second coils or spring portions 94, 96 that are connected together by an intermediate wire portion 98. The first and second coils 94, 96 include hooked ends 100, 102, respectively. Each coil provides rotatable biasing force relative to the center of each coil to allow both ends of the spring 34 to cause biased operation of latch components in the manner described. The exemplary double torsion spring 34 may be made of steel or other suitable material. Alternatively, the biasing device may have two separate torsion springs instead of the unitary double torsion spring. Other types of suitable biasing devices may also be used as well such as a linear-type (compression or tension) spring.

The exemplary catch jaw 30 is formed as one piece of a generally flat piece of rigid material and includes a recess 104 formed in a left end of the catch jaw 30 for receiving a member such as a post 106 (FIG. 5) that is operatively connected to a door or other item to be releasably held by the latch assembly. The exemplary catch jaw 30 includes a recess which is alternatively referred to as a detent 108 formed on the side surface thereof. The catch jaw 30 also includes a step surface 110 that extends on a lower end of the side of the catch jaw. An aperture 112 is formed generally in the center of the catch jaw for rotatably receiving the front portion 72 of the first spacer 36.

Figure 5:
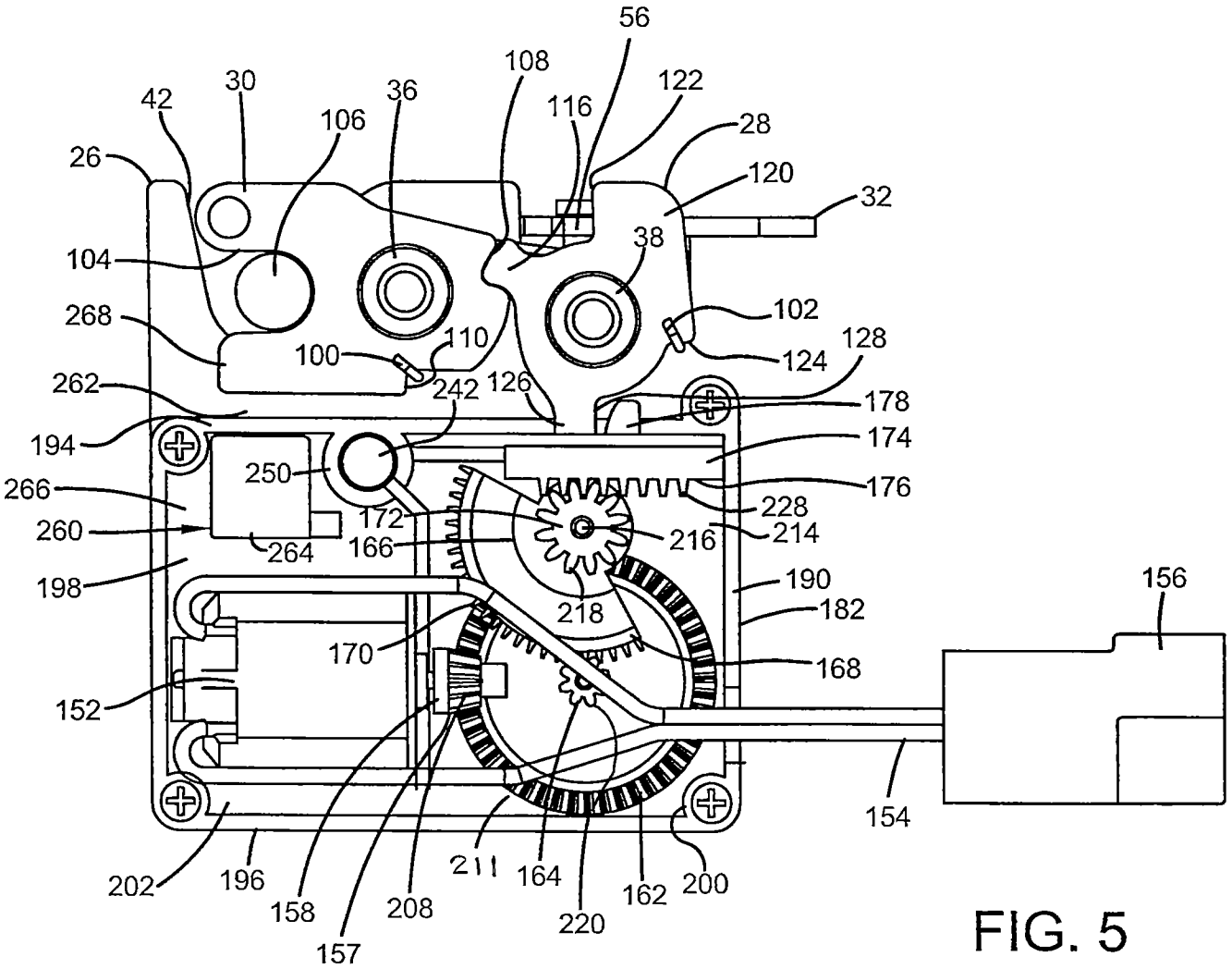
FIG. 5 is a front view of the apparatus of FIG. 1 with the latch assembly in the closed condition and with portions removed for illustrative purposes.

The exemplary release pawl 28 is formed as one generally flat piece of rigid material and includes an aperture 114 for receiving the front portion 86 of the second spacer 38. The release pawl 28 includes a first projection 116 extending radially outward (with respect to axis of rotation 118) from the upper left portion of the release pawl 28 as shown in FIG. 5. The release pawl 28 includes a second projection 120 extending radially outward from the upper right portion of the release pawl 28. The second projection 120 is bounded by upper and lower step surfaces 122, 124. The exemplary release pawl 28 includes a third projection 126 which serves as a release projection that extends radially outward from the lower end of the release pawl 28. The third projection 126 is bounded by a step surface 128. Of course these configurations of the latching components are exemplary and other configurations may be used.

The exemplary cover plate 40 is formed as one piece and includes a main body 130. A race track shaped recess 132 is formed in the front surface 134 of the main body 130. The recess 132 slopes upwardly in the left direction as shown in FIG. 3. Apertures 76, 90 are formed in the main body 130 and are located within the recess 132. A guide slot 136 is formed in the upper end of the main body 130 near the left end of the main body 130. The cover plate 40 includes a tab 138 that extends rearwardly from the upper end of the main body 130 as shown in FIG. 3. The exemplary guide slot 136 generally conforms in contour with cut out 42 of the latch plate 26. The cover plate 40 includes a shield 140 that extends rearwardly from the left side of the main body 130.

Figure 6:
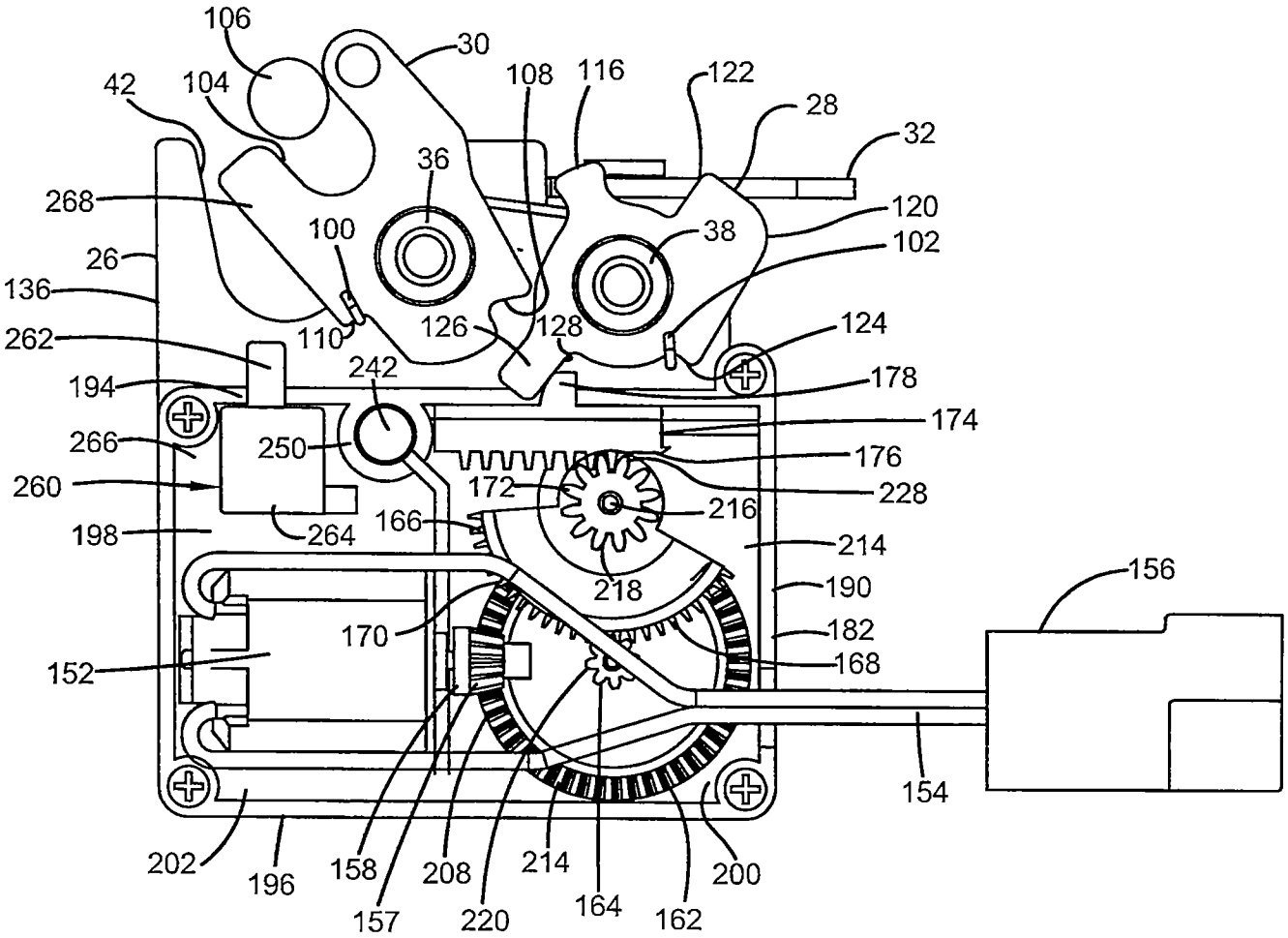
FIG. 6 is view similar to FIG. 5 except that the latch assembly is in the open condition.

When assembled, the first spacer 36 extends through the first aperture 44 of the latch plate 26 such that the latch plate 26 securely engages the groove 68. The rear flange 66 of the spacer engages a rear side 142 of the latch plate 26 to prevent disengagement of the first spacer 36 and the latch plate 26. The end portions of the latch plate 26 bounding the first aperture 44 are engaged with and help prevent rotation of the first spacer 36 relative to the latch plate 26. Alternatively other types of spacers and fastening methods may be used, such as the castle style fastening spacers 642 shown in the latch embodiment 644 of FIGS. 15-19. The first coil 94 of the torsion spring 34 extends around the central portion 70 of the first spacer 36. The catch jaw 30 is movably supported on the front portion 72 of the first spacer 36 such that the catch jaw 30 may rotate relative to the first spacer 36 about an axis 144. The hooked end 100 of the torsion spring 34 operatively engages the step surface 110 at the lower end of the catch jaw 30 as seen in FIGS. 5 and 6. The torsion spring 34 biases the catch jaw 30 in the clockwise direction as shown, towards a second position in which the post is disengageable from the recess 104 of the catch jaw.

Also in the exemplary arrangement, when assembled, the second spacer 38 extends through the second aperture 46 of the latch plate 26 such that the latch plate 26 securely engages the groove 82. The rear flange 80 of the spacer engages the rear side 142 of the latch plate 26 to prevent disengagement of the second spacer 38 and the latch plate. The end portions of the latch plate 26 bounding of the second aperture 46 are engaged with and help to prevent rotation of the second spacer 38 relative to the latch plate 26. Alternatively, other types of spacer configurations may be used. The second coil 96 of the torsion spring 34 extends around the central portion 84 of the second spacer 38. The release pawl 28 is movably supported on front portion 86 of the second spacer 38 such that the release pawl 28 may rotate relative to the second spacer 38 about the axis 118. The hooked end 102 of the torsion spring 34 operatively engages the lower step surface 124 of the second projection 120 as shown in FIGS. 5 and 6. The torsion spring 34 biases the release pawl 28 in the counterclockwise direction as shown in FIG. 5 toward a first position. The projection 56 of the release lever 32 is positioned adjacent the upper step surface 122 of the second projection 120 of the release pawl 28.

In the exemplary embodiment, the first and second spacers 36, 38 extend through their respective apertures 76, 90 of the cover plate 40 such that the cover plate 40 securely engages the respective spacer grooves 78, 92. The front flanges 74, 88 extend through respective apertures in the cover plate and engage the front surface 134 of the cover plate 40 at the recess to prevent disengagement of the cover plate 40 and the spacers 36, 38, as represented in FIG. 1. The engaged surfaces bounding apertures 76, 90 in the cover plate 40 help to prevent rotation of the spacers 36, 38 relative to the cover plate. Of course in other embodiments, other spacer and fastening configurations may be used. As seen in FIG. 1, the exemplary cover plate 40 overlies the front sides 148, 150 (FIG. 3) of the catch jaw 30 and the release pawl 28, respectively, and the recess 104 of the catch jaw 30 to minimize external access to the release pawl 28 and the catch jaw 30. The exemplary tab 138 overlies the first projection 116 of the release pawl 28, the detent 108 of the catch jaw 30, and the projection 56 of the release lever 32 to minimize access to these elements. This reduces the risk that a criminal or other unauthorized person may use a tool to move the release pawl 28 and open the latch assembly 22 improperly. Other forms of cover plates or other or additional structures may be used in connection with different embodiments of latch assemblies to minimize the risk of unauthorized access and latch release.

As shown in FIG. 5, when the exemplary latch assembly 22 is in the closed condition for latching and holding an item, the catch jaw 30 is positioned in a first position to engage the post 106 and hold the post in the recess 104. In this condition, the shield 140 as well as the surfaces bounding the guide slot 136 and the cut out 42 prevent disengagement of the post 106 from the catch jaw of the latch assembly 22. In the closed condition, the first projection 116 of the release pawl 28 engages the detent 108 of the catch jaw 30 to prevent clockwise rotation of the catch jaw 30. In this first position of the release pawl 28, the second coil 96 of the spring 34 biases the first projection 116 counter clockwise as shown to engage the detent 108 with a force sufficient to counteract the biasing force of the first coil 94 acting to bias the catch jaw 30 in a clockwise direction, thereby holding the catch jaw 30 in the first position in holding engagement with the post 106. As a result the item to which the post is operatively connected, such as a door, is held in a position due to the closed condition of the latch. Alternatively, in other arrangements the detent and first projection features could be reversed on the release pawl and catch jaw such that the catch jaw has a projection that engages a detent of the release pawl to hold the catch jaw in the engaged position with the post. Also, in alternative arrangements, there may be intermediate structures acting operatively between the catch jaw and release pawl to allow the release pawl to hold or release the catch jaw in the first position.

The exemplary latch assembly 22 may be placed in the released or open condition for unlatching an item as represented in FIG. 6. To place the exemplary latch assembly 22 in the open condition from the closed condition in FIG. 5, a user grasps a handle operatively connected to the cable, rod or other member, which is attached to the release lever 32 via the aperture 62, and applies a manual force to move the member in the rearward direction, which in turn rotates the release lever 32 about the axis 63. Rotation of the release lever 32 causes the projection 56 to engage the upper step surface 122 and rotate the release pawl 28 clockwise as shown in FIG. 5. The relative movement of the release pawl with respect to the catch jaw causes the first projection 116 to disengage from the detent 108 of the catch jaw 30 when sufficient force is applied by the user to move the release pawl by overcoming the biasing force of the second coil 96 of the spring 34 acting on the release pawl 28.

In the exemplary arrangement disengagement of the first projection 116 and the detent 108 releases the holding force of the first projection 116 of the release pawl 28 acting against the detent 108 of the catch jaw 30. The biasing force of the first coil 94 of the spring 34 acting on the catch jaw 30 rotates the catch jaw 30 in the clockwise direction as shown in FIG. 5 to a second position in which the post is released by the catch jaw and the post can disengage from the latch. Rotation of the catch jaw 30 in the clockwise direction to the second position by the spring 34 urges the post 106 to move in the guide slot until the post 106 and recess 104 disengage and the post can be disposed away from the guide slot 136 and the shield 140. The post 106 moves relative to and may disengage from the latch assembly 22. This enables the door or other item operatively engaged with the post 106 to be released from operative engagement with the latch and moved relative thereto. For example if the item is a door it may be opened.

In exemplary embodiments, the latch can be changed from the release condition to the latched condition by moving the post 106 toward the catch jaw 30 and the cut out 42. As the post moves toward the latch, it engages the recess in the catch jaw which causes the catch jaw to rotate in a counterclockwise direction as shown about the axis 144 of spacer 36. The catch jaw rotates until the first projection 116 of the release pawl, which is biased to rotate counterclockwise by the spring, engages the step surface 108 on the catch jaw. This returns the latch to the latch door closed position. In other exemplary embodiments, other types of latching mechanisms may be utilized. Such mechanisms may include a two-stage latch for example. For example, a two-stage latch may include a catch jaw and release pawl arrangement that engages a post, such as post 106, in a position in which the post is held by the catch jaw, but which is disposed somewhat away from the condition in which the latch is fully latched. Such a two-stage latching arrangement is sometimes desirable when a door or other closure member might be moved towards the latch position but is not moved all the way to cause the catch jaw to move to the latched position. A two-stage latch enables the post to be held engaged with the latch, even though the latch is not fully latched. Latches of this type may be useful in many applications where a user does not want a door or other closure member to come open once it has been moved towards the closed position, even though it has not been moved sufficiently to be fully latched. Of course, these approaches are exemplary and in other embodiments other approaches may be used.

Figure 4:
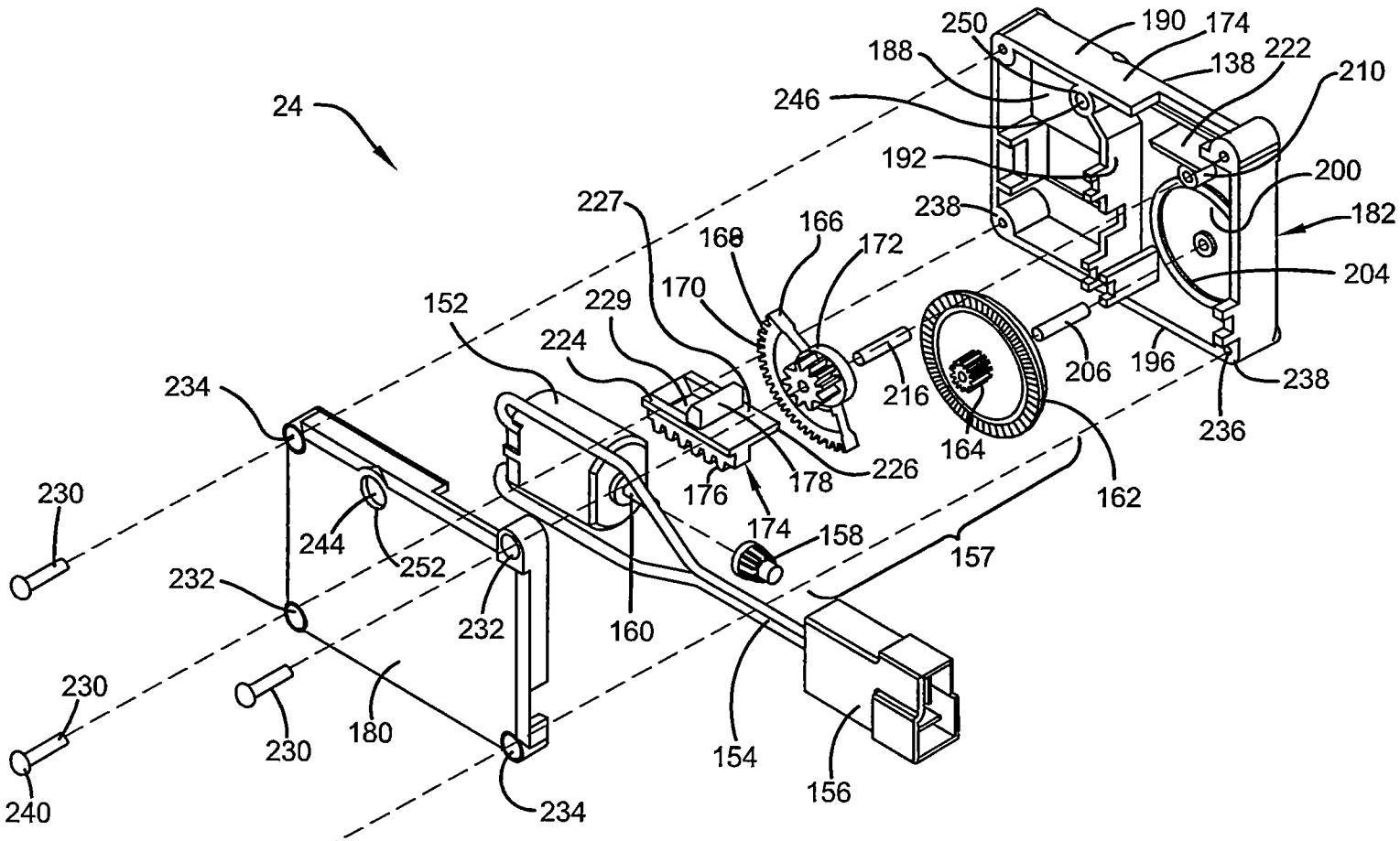
FIG. 4 is a front and right exploded view of the actuator of the apparatus of FIG. 1.

In addition or alternatively, the exemplary latch assembly 22 may be changed to the open condition from the closed condition through operation of the actuator 24. In particular, as depicted in FIGS. 2 and 4, the exemplary actuator 24 comprises a drive such as a motor 152. The motor 152 may be an air motor, electric motor, hydraulic motor or other suitable type of motor. Alternatively, solenoids or other suitable drives may be used instead of a motor. The motor 152 may be powered via wires 154 by a power source such as a 110 volt alternating current power source such as a household outlet or a 12 volt DC battery. The wires 154 may also be connected to a wire harness 156. A suitable control circuit may be used to selectively deliver power to and control operation of the motor.

Referring to FIG. 4, the exemplary electrical actuator 24 further comprises gear system which is alternatively referred to as a gear train 157. The exemplary gear system 157 includes a pinion 158 fixed to the end of a rotating shaft 160 of the motor 152. The gear system 157 also includes an annular arcuate gear portion in the form of ring gear 162. The exemplary ring gear 162 includes an integrally formed central pinion 164 located at the center of the ring gear 162. The ring and central pinion comprise a first pair of reduction gears. The exemplary gear system 157 further comprises a rack drive gear 166. The rack drive gear 166 includes an arcuate gear portion 168 that has teeth 170 on a lower end of the gear portion 168. A pinion 172 extends in fixed relation on the central portion of the arcuate gear portion 168. The pinion 172 rotates co-axially with the gear portion 168. The drive gear 166 and pinion 172 serve as a second pair of reduction gears. The exemplary gear system 157 further includes an elongated release member 174. The exemplary release member includes a linear gear rack 176 at an inner side of the release member 174. An upstanding finger 178 extends on the top of the release member 174. The left side of the exemplary finger 178 slopes downwardly and outwardly toward the left direction. A recess 229 extends in an outer surface of the release member. Of course it should be understood that this configuration is exemplary, and in other embodiments other configurations may be used.

As shown in FIG. 4 an exemplary actuator assembly 24 further includes front and rear casings 180, 182, respectively, which are alternatively referred to herein as housing portions. The casings define a housing 184 that generally surrounds the motor 152 and gear system 157. The rear casing 182 includes a rear base 188 and a peripheral wall 190 extending forwardly from the periphery of the base 188. A divider wall 192 extends between the upper and lower portions 194, 196 of the peripheral wall 190 to define, along with the peripheral wall 190, left and right compartments 198, 200. As shown in FIGS. 5 and 6, the motor 152 is positioned in the lower portion 202 of the left compartment 198, and the ring gear 162 is rotatably movable in a complimentary recess 204 (FIG. 4) formed in the right compartment 200. The ring gear 162 may rotate about an axis of rotation about an axle 206 that extends in the rear casing 182 and through the center of the ring gear 162. The teeth 208 of the pinion 158 on the drive shaft of the motor 152 engage the teeth 211 of the ring gear 162. The rack drive gear 166 is rotatably supported by a boss 210 (FIG. 4) in the upper portion 214 of the right compartment 200. The rack drive gear 166 may rotate about an axis of rotation about an axle 216 that extends through the pinion 172 and into a bore in the boss 210. Teeth 220 of the pinion 164 engage the teeth 170 of the arcuate gear portion 168.

The exemplary release member 174 has a main body 227 (FIG. 4) that is movably supported on a support ledge 222 (FIG. 4) of the rear casing 182. Left and right end portions 224, 226 (FIG. 4) of the body 227 of the release member 174 are configured to be movably positioned under the upper portion 194 of the peripheral wall 190 and may slidably contact the underside of the upper portion 194 during movement of the release member 174 as shown in FIGS. 5 and 6. The teeth 228 of the gear rack 176 engage the teeth 218 of the pinion 172 of the rack drive gear 166. Thus, rotation of the pinion 172 in the counterclockwise direction moves the release member 174 linearly along a straight line from right to left as shown in FIGS. 5 and 6. The end portions 224, 226 of the release member 174 are movably positioned underneath the upper portion 194 during the linear movement of the release member 174 and serve to hold the release member 174 in engagement with the housing.

Referring to FIG. 4, the exemplary front casing 180 is in mounted connection with the rear casing 182 by fasteners such as screws 230. Specifically, screws 230 extend through corresponding apertures 232 in corner recesses 234 of the front casing and threadably engage bores 236 formed in the corner portions 238 of the peripheral wall 190 of the rear casing 182. The heads 240 of the screws 230 are positioned on the front side of the recesses 234 to secure the front casing 180 in engaged relation with the rear casing 182.

The exemplary actuator 24 is a separable unit from the latch assembly 22 as best illustrated in FIG. 2. The exemplary actuator 24 is in mounted relation with the latch assembly 22 through at least one a suitable fastener 242. For example, the fastener may include a releasable fastening rivet 242 (FIGS. 2 and 8) that extends through aligned apertures 244, 246 (FIG. 4), and 54 (FIG. 3), in the front casing 180, a boss 250 of the rear casing 182, and the latch plate 26, respectively, to releasably secure the actuator assembly 24 to the latch plate 26 of the latch assembly 22. In particular, the aperture 244 of the front casing 180 may be formed in a recess 252 (FIG. 4). As shown in FIG. 1, the rivet 242 may include a head 254 that is positioned upon a front side of the recess 252 and a bucked or upset tail 258 (FIG. 8) that is securely positioned in the aperture 54 (FIG. 3) of the latch plate 26 to secure the latch plate 26 to the front and rear casings 180, 182. The rivet 242 may hold the actuator and latch assembly 24, 22 engaged by an internal fastener such as a screw, nut, stud or other suitable member. In other arrangements the rivet may be of the type that provides a generally permanent fastening engagement such as a rivet that is deformed in place such as by an orbital riveter. Of course these fastening arrangements are exemplary. In this exemplary embodiment, the rear casing 182 is positioned adjacent the latch plate 26, when the actuator 24 is mounted to the latch assembly 22.

In other arrangements, other types of fastening arrangements may be used. For example, one or more bolts or screws may extend through the apertures with a nut threadably fastened thereto to secure the actuator and the latch plate in engaged relation. The fasteners may be constructed so that the actuator 24 may be removably mounted to the latch plate 26 of the latch assembly 22. This feature may readily enable the latch assembly 22 (without the actuator 24 attached thereto), to operate solely manually using the release lever 32. The separate actuator 24 being attached to the latch assembly 22 enables the same configuration of the latch assembly 22 to be released either electrically or manually. Alternatively the exemplary latch assembly configuration may also be operated without the manual release lever, so that the latch assembly can be released solely by the electrical actuator assembly 24. Of course these configurations are exemplary.

Exemplary embodiments of the apparatus 20 also enable the actuator 24 to be installed in operative engagement with the latch assembly 22 either in the factory or in the field. This configuration may enable a user to change latch assemblies to add or remove an actuator assembly as desired in the particular environment where the latch assembly is used. The separate actuator configuration also makes it easier to replace a broken actuator, since there is no need to disassemble other parts of the latch assembly. The separate actuator assembly may also provide a more economical construction. The removable actuator assembly may also enable the use of different types of actuators with the same components of the mechanical latch assembly. This may include, for example, actuators with motors that run at different voltages. This may be desirable depending on the applications in which the latch assembly is used. For example, latch assemblies on vehicles may use a 12 volt DC motors. Actuators used in stationary applications may use 110 volt AC motors or motors that operate at other suitable voltages.

Figure 17:
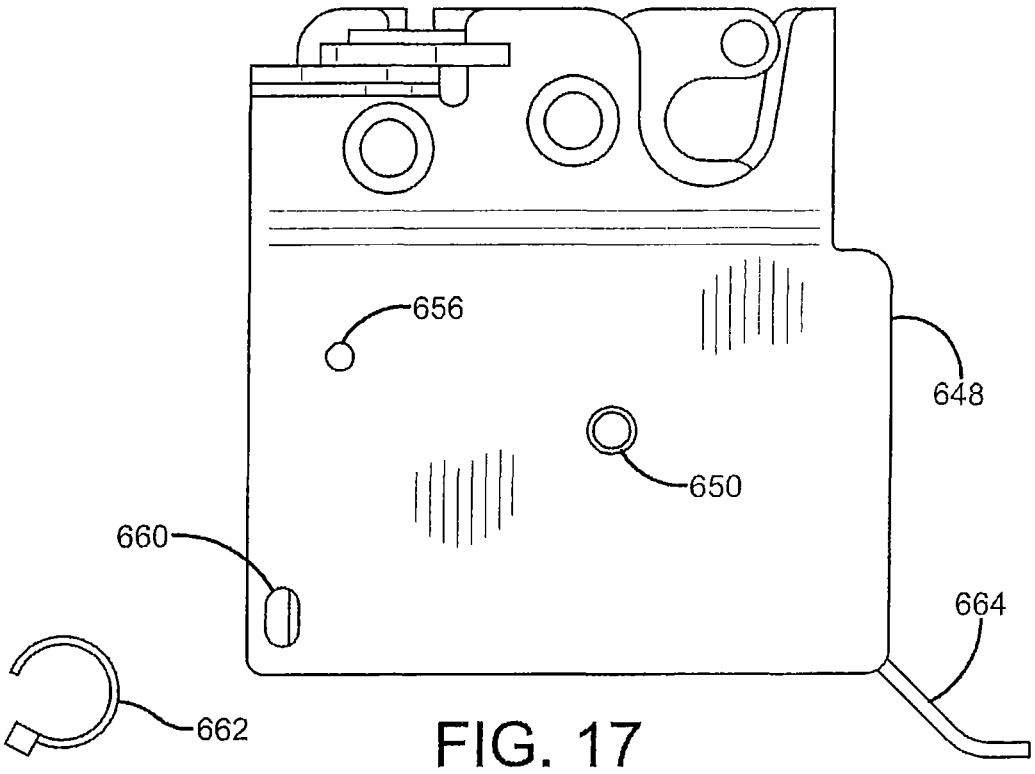
FIG. 17 is a rear view of the latching apparatus shown in FIG. 15.
Figure 19:
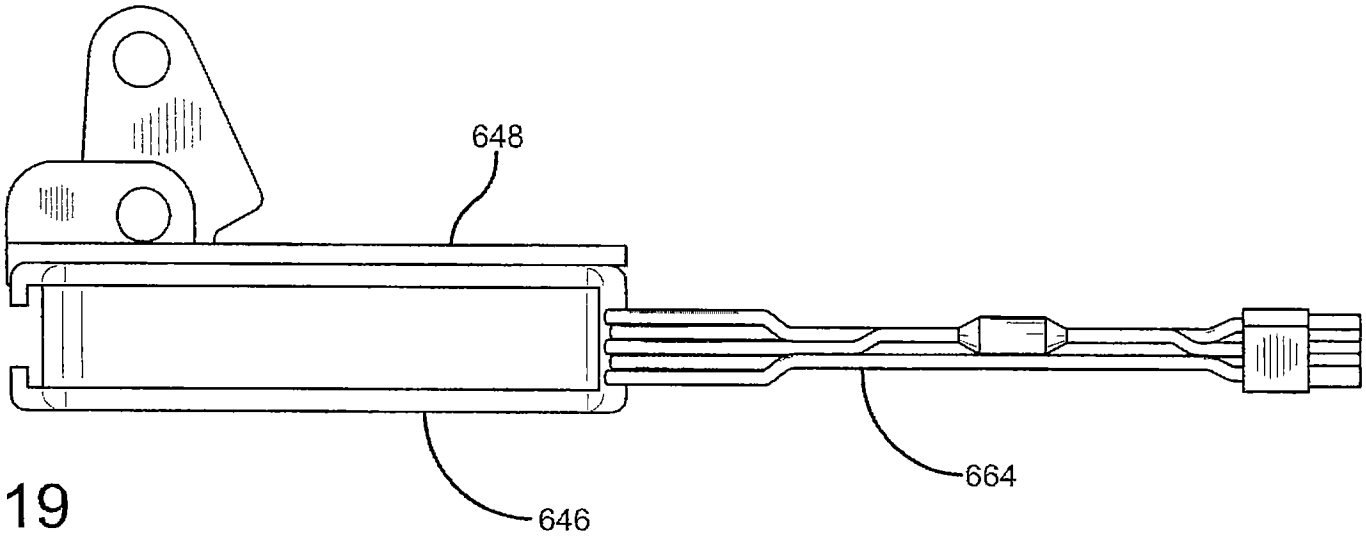
FIG. 19 is a bottom view of the latching apparatus shown in FIG. 15.
Figure 18:
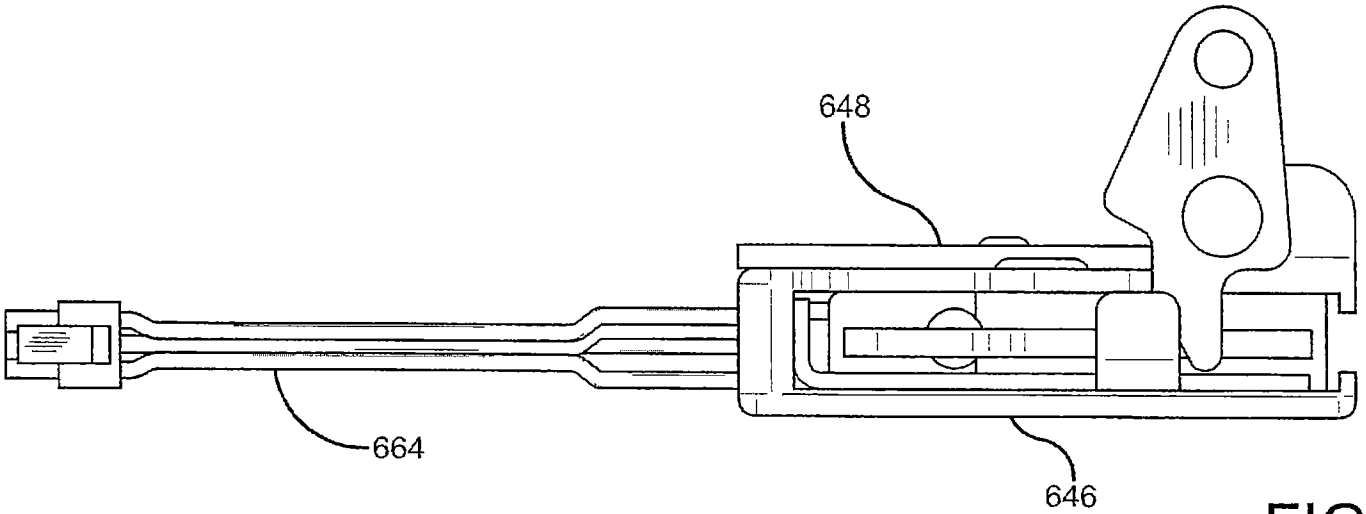
FIG. 18 is a top view of the latching apparatus shown in FIG. 15.

An alternative approach to the attachment of an actuator assembly and a latch assembly is shown in an alternative embodiment in FIGS. 15-19. In this exemplary embodiment, a latch assembly 644 that is generally similar to latch assembly 22 is shown in attached relation with an actuator assembly 646. In this exemplary embodiment, a latch assembly includes a latch plate 648. As best shown in FIG. 17, which is a rear view of the latch assembly, the latch plate includes an aperture 650. The aperture 650 in the latch plate is aligned with an aperture 652 in the housing 654 of the actuator assembly in the housing in the operative position. In the exemplary arrangement, a fastener such as a rivet or other holding fastener, extends in the apertures 650 and 652 to hold the housing 654 and the latch plate 648 in engagement.

In the exemplary embodiment, the latch plate further includes a projection 656, the back of which is shown in FIG. 17. In the exemplary arrangement, the projection 656 extends on the forward face of the latch plate 648 toward the housing 654. The housing includes a corresponding recess sized to accept the projection therein in inter-engaging relation. The recess is positioned in the exemplary embodiment in generally aligned relation with a recess 658 on the front side of the housing.

In the exemplary arrangement, the inter-engaging projection and recess are operative to prevent relative movement of the latch plate and the housing of the actuator. The inter-engaging projection and recess resist any force that might be applied that would tend to rotate the housing 646 about the fastener that extends through the apertures 652 and 650. Further, it should be understood that in exemplary arrangements, the configuration of the inter-engaging projections and recesses may be reversed. In such arrangements, the projection may extend from the housing of the actuator and a recess may extend in the latch plate. Further, in the exemplary embodiment, the recess 658 on the housing 646 may be utilized to position the housing relative to a latch when the direction of movement with regard to the latch is the reverse of that shown in FIGS. 15-19. This enables the exemplary actuator assembly 646 to be used in both a left hand and right hand configuration.

Further, in the exemplary embodiment shown, the latch plate 648 includes at least one wire tie opening 660. The exemplary wire tie opening 660 is configured to accept therein a wire tie such as a flexible band type wire tie 662 shown in FIG. 17. The wire tie opening in combination with a suitable wire tie is usable to hold at least one wire, such as the wire harness 664 which extends from the actuator housing, in position relative to the backing plate 648. The wire tie opening 660 might be used for example when the wire harness 664 needs to extend in a direction opposite to the direction that the wire harness extends out of the housing. It should further be understood that in other exemplary embodiments, other numbers, configurations and arrangements of wire tie openings suitable for accepting other types of wire holding or positioning devices may be used.

FIGS. 5 and 6 illustrate the operation of the exemplary actuator 24. When the latch assembly 22 is in the closed or latched condition, the finger 178 of the release member 174 is positioned rightwardly adjacent the step surface 128 that bounds the third projection 126 of the release pawl 28 as depicted in FIG. 5. The exemplary third projection 126 extends in the a recess 229 formed in the top of the main body 227 of the release member 174, which recess is best shown in FIG. 4. To change the latch assembly 22 from a closed condition to the open condition via the actuator assembly 24, the motor 152 is energized by, for example, a user pushing a push button or changing the condition of a switch (not shown) associated with a suitable control circuit. Energization of the motor 152 rotates the motor shaft 160 and pinion 158 fixed thereon clockwise (as viewed in FIG. 2). Rotation of the pinion 158 in turn rotates the ring gear 162 and its central pinion 164 in the clockwise direction. The central pinion 164 rotates the arcuate gear portion 168 and hence, the pinion 172 of the rack drive gear 166, counter clockwise. As shown in FIG. 6, rotation of the pinion 172 of the rack drive gear 166 in turn moves the release member 174 linearly along a straight line to the left in a direction towards the step surface 128 bounding the third projection 126. The finger 178 engages the step surface 128 and rotates the release pawl 28 from the first position to the second position such that the first projection 116 disengages the detent 108 of the catch jaw 30 when sufficient force is applied by the motor 152 to overcome the biasing force of the second spring coil 96.

Disengagement of the first projection 116 and the detent 108 releases the holding force of the first projection 116 of the release pawl 28 acting against catch jaw 30. The biasing force of the first coil 94 of the spring 34 acting on the catch jaw 30 rotates the catch jaw 30 in the clockwise direction from the first position shown in FIG. 5 to the second position shown in FIG. 6. Rotation of the catch jaw 30 in the clockwise direction to the second position by the spring 34 biases the post 106 to move in the guide slot 136 until the post 106 and the recess 104 disengage. The post 106 moves out of the recess 104 of the catch jaw and the guide slot 136 and disengages from the latch assembly 22. This enables the door or other item that is operatively connected to the post 106 to be moved relative to the latch. For example, if the post is in operative connection with a door, the door can be opened.

The relatively large sized ring gear 162 and rack drive gear 166 of the exemplary arrangement function as reduction gears to reduce the force required by the motor 152 to overcome the biasing force of the second spring coil 96 and move the release member 174 to in turn rotate the release pawl 28 until the first projection 116 disengages from the detent 108. Thus, the two pairs of reduction gears of the gear system 157 of the exemplary actuator assembly 24 provides sufficient force to cause the release member 174 to move the release pawl 28 and reliably release or open the latch assembly 22 without the need for a high torque driving motor. Also, the straight linear movement of the release member 174 during movement of the release member 174 causes a generally constant uniform force to be applied by the finger 178 generally perpendicular to the step surface 128 as the release pawl 28 rotates from the first position to the second position. This in turn enables the use of a driving motor with lower torque, as a suitable amount of force is uniformly applied in a suitable direction by the release member 174 to the step surface 128 to rotate the release pawl 28 from the first position to the second position and place the latch assembly 22 in the open condition.

In the exemplary embodiment when it is desirable to enable the latch to be returned to the closed condition, the motor 152 is driven in a direction opposite to that in which it operates when the latch is being changed from the latched to the unlatched condition. The motor is driven responsive to a suitable control circuit so as to cause the release member 174 to be moved from the release position shown in FIG. 6 to the return position shown in FIG. 5. The motor through the gear train causes the release member to move to the return position by moving in an opposed direction from that in which the release member moved to unlatch the latch. In exemplary arrangements, the return of the release member to the return position does not cause movement of the release pawl 28. In the exemplary embodiment, the catch jaw 30 remains in a position allowing the post 106 to be movable into or away from the recess 104 in the catch jaw. When the post 106 is returned to the recess and the catch jaw and causes the catch jaw to move in a counterclockwise direction as shown in FIGS. 5 and 6, the release pawl 28 is enabled to rotate in a counterclockwise direction so as to cause the projection 116 on the release pawl to engage the detent 108 on the catch jaw, holding the latch in the latched position. In this exemplary arrangement, the projection 126 on the release pawl is enabled to move without interference from the release member in the retracted position. Of course, this arrangement is exemplary, and in other embodiments other arrangements may be used.

As shown in FIGS. 5 and 6, in this exemplary arrangement a sensing switch 260 is provided and can be used to determine whether the latch assembly 22 is in the open or closed condition. The exemplary sensing switch comprises a plunger type switch 260 in which a plunger 262 moves in and out relative to a switch body 264. In particular, the exemplary switch 260 is positioned in an upper portion 266 of the left compartment 198 of the rear casing 182. When the latch assembly 22 is in the open condition and the catch jaw 30 is in the second position as seen in FIG. 6, the plunger 262 of the switch 260 biasingly extends upwardly terminating just underneath a left portion 268 of the catch jaw 30 located to the left of the axis 144. When the latch assembly 22 is in the closed condition and the catch jaw 30 is in the first position as seen in FIG. 5, the left portion 268 of the catch jaw 30 engages the plunger 262 and depresses the plunger 262 against the outward biasing force of a spring or other suitable device down toward the switch body 264. This enables the switch 260 to detect the condition of the latch.

An indicator (not shown) may be electrically coupled to the switch 260 to indicate whether the latch assembly 22 is in the closed or open condition. For example, for a plunger switch 260 that is a normally closed circuit type switch, the indicator may be a light that is illuminated to indicate that the latch assembly 22 is in the open condition and the catch jaw 30 is in the second position. The light may be off when the latch assembly 22 is in the closed condition and the catch jaw 30 is in the first position. Alternatively, the switch and circuit may cause the light to be on when the latch is in the latched position and off when the latch is open. In an exemplary arrangement in the closed condition, the left portion 268 of the catch jaw 30 engages the plunger 262 and pushes the plunger 262 down toward the switch body 264 to break the circuit and cut the power to the light. The light being turned off may also indicate to the user that the door or other item operatively connected to the post 106 is fully closed. Other types of indicators may be used such as display screens or audible indicators. As previously mentioned, in the exemplary arrangement, the plunger switch 260 may be positioned inside the left compartment 198 of the rear casing 182. Alternatively, when the latch assembly 22 is used without the actuator 24, or in other exemplary arrangements the plunger switch 260 may be operatively attached separately to the latch plate 26.

Figure 7:
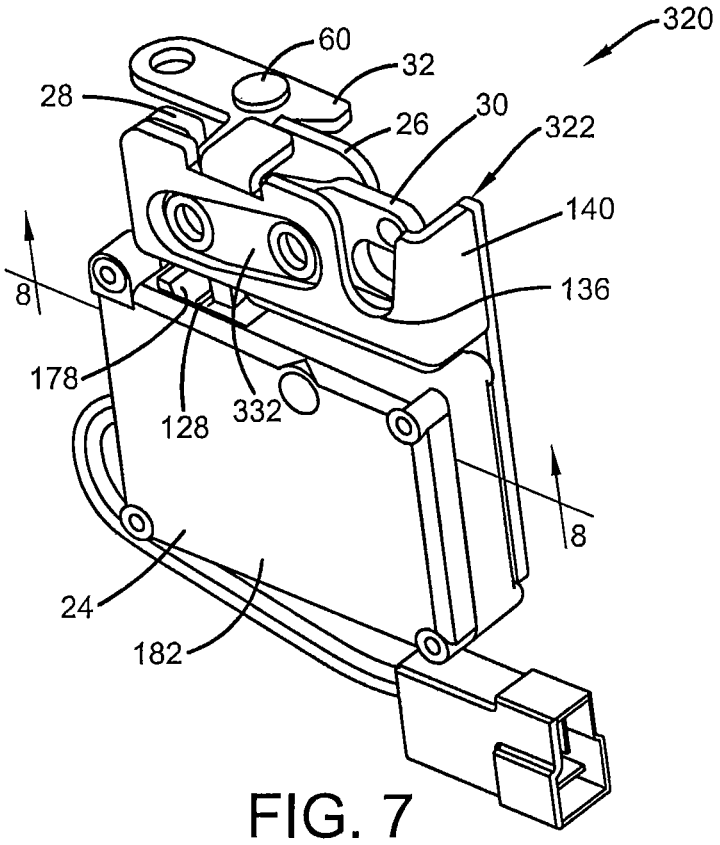
FIG. 7 is a front and right perspective view of an apparatus according to another exemplary embodiment.

The exemplary actuator 24 may be used with other types of latch assemblies. For example, FIGS. 7 and 8 show an exemplary apparatus 320 in which the actuator 24 is used with a different type of latch assembly 322. This exemplary apparatus 320 is similar to the apparatus 20 of FIGS. 1-6 except as discussed below. The same reference numbers will be used to designate elements of the apparatus 320 generally similar in construction and function as the apparatus 20 of FIGS. 1-6.

In this exemplary latch assembly 322, the latch plate 26, catch jaw 30, and release pawl 28 are flipped 180 degrees relative to a vertical axis (as compared to FIG. 1). The locations of the release pawl 28 and catch jaw 30 are reversed compared to the previously described apparatus 20. The hooked end 100 of the spring 34 operatively engages the lower step surface 124 to bias the release pawl 28 to the first position, and the hooked end of 102 of the spring 34 operatively engages the step surface 110 to bias the catch jaw 30 to the second position. When the latch assembly is in the closed condition, the first coil 94 of the spring 34 biases the first projection 116 to engage the detent 108 with a force sufficient to counteract the biasing force of the second coil 96 against the catch jaw 30, thereby holding the catch jaw 30 in the first position in engaging relation with the post 106.

As in the previously described embodiment, in this exemplary apparatus 320, the tab 50 of the latch plate 26 extends rearwardly from the latch plate 26. The release lever 32 is flipped 180 degrees about a horizontal axis compared to the prior arrangement. The guide slot 136 and shield 140 of the cover plate 40 are located on the right side instead of the left side, and the recess 132 of the main body slopes upwardly to the right as shown. The actuator 24 is generally the same as in the previously described apparatus 20 and in this arrangement is engaged with the latch plate 26 such that the front casing 180 rather than the rear casing 182 is positioned adjacent the latch plate 26. In particular, the rear casing 182 includes a recess 352. As shown in FIG. 8, the rivet 242 extends through the recess 352, aperture 244 of the front casing 180, and aperture 54 of the latch plate 26, such that the head 254 of the rivet 242 is positioned on a rear side 356 of the recess 352 and the bucked or upset tail 258 is securely positioned in the aperture 54 (FIG. 3) of the latch plate 26 to secure the latch plate 26 to the front and rear casings 180, 182. Further, in some exemplary arrangements, the interengaging projection and recesses of the previously described embodiment may be utilized in connection with this alternative embodiment to position and retain the actuator housing in engaged relation with the latch plate.

In this exemplary alternative apparatus 320, the finger is located leftwardly adjacent the third projection 126 of the release pawl 28, when the latch assembly 322 is in the closed condition. To change the latch assembly 22 from the closed condition to the open condition via the actuator 24, the motor 152 is energized by, for example, a user pushing a push button or changing the condition of a switch (not shown) of a control circuit. Energization of the motor rotates the motor shaft and the pinion thereon. Rotation of the pinion in turn rotates the ring gear 162 and the central pinion 164. The central pinion 164 rotates the gear portion 168 and hence, the pinion 172. Rotation of the pinion 172 in turn moves the release member 174 linearly to the right (as viewed in FIG. 7) towards the step surface 128 bounding the third projection 126. The finger 178 engages the step surface 128 and rotates the release pawl 28 clockwise (as viewed from back or rear side of the latch in FIG. 7) from the first position to the second position such that the first projection 116 disengages from the detent 108 of the catch jaw 30 when sufficient force is applied by the motor and gear system 152 to overcome the biasing force of the first coil 94.

Disengagement of the first projection 116 and the detent 108 releases the holding force of the first projection 116 of the release pawl 28 acting on the catch jaw 30 such that the biasing force of the second coil 96 of the spring 34 against the catch jaw 30 rotates the catch jaw 30 from the first position to the second position. Rotation of the catch jaw 30 to the second position by the spring 34 urges the post 106 to move outwardly along the guide slot until the post 106 disengages the recess 104. The post 106 disengages recess 104 and disengages from the latch assembly 22. This enables the door or other item operatively connected to the post 106 to be moved relative to the latch.

To manually place the exemplary latch apparatus 20 in the open condition, a user grasps a handle attached to a cable, rod or other member, which is attached to the release lever via the aperture, and applies a manual force to move the member, which in turn rotates the release lever about its axis. Rotation of the release lever 32 causes the first projection 116 to engage the upper step surface 122 and rotate the release pawl 28 clockwise (as viewed from the back or rear side of the latch in FIG. 7) to the second position such that the first projection 116 disengages from the detent 108 of the catch jaw 30 when sufficient force is applied by the user to overcome the biasing force of the first coil 94 of the spring 34 against the release pawl 28. Disengagement of the first projection 116 and the detent 108 releases the holding force of the first projection 116 of the release pawl 28 such that the biasing force of the second coil 96 of the spring 34 acting on the catch jaw 30, rotates the catch jaw 30 in the clockwise direction (as viewed from the back or rear side of the latch in FIG. 7) to a second position. Rotation of the catch jaw 30 in the clockwise direction to the second position by the spring 34 urges the post 106 to move along the guide slot 136 until the post 106 and recess 104 disengage, allowing the post 106 to disengage from the latch assembly 22. This enables the door or other item operatively connected to the post 106 to be opened or otherwise moved relative to the latch.

Figure 9:
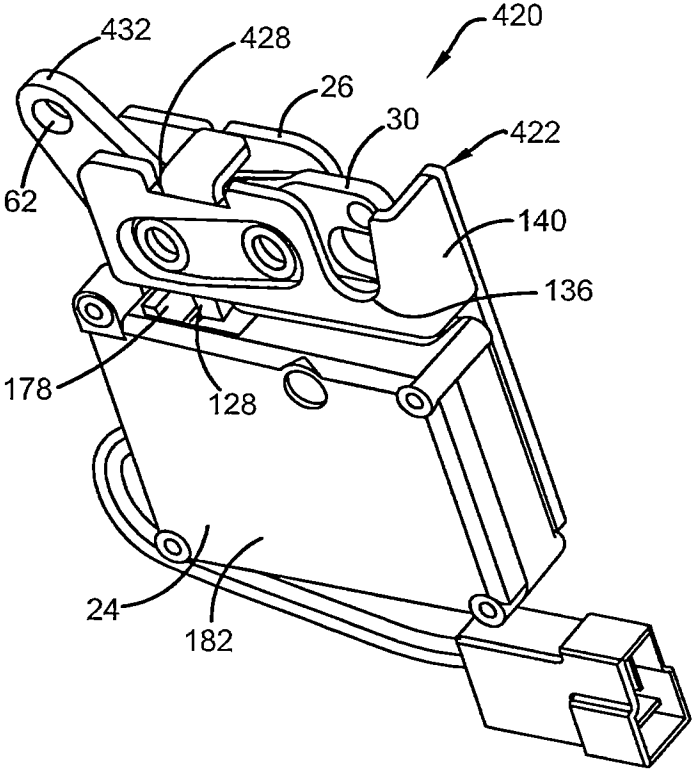
FIG. 9 is a front and right perspective view of an apparatus according to another exemplary embodiment.

FIG. 9 shows a further exemplary apparatus 420 in which the actuator 24 is used with a different type of latch assembly 422. This exemplary apparatus 420 is similar to the apparatus 320 of FIGS. 7 and 8 except as discussed below. The same reference numbers will be used to designate elements of the apparatus 420 similar in construction and function as the apparatus 320 of FIGS. 7 and 8. In this latch assembly 422, the release lever and tab are not included. Instead an ear 432 is integrally formed as one piece with the release pawl 428. The ear 432 extends radially outward (with respect to the axis of rotation of the release pawl) from the upper left corner of the release pawl 428 as shown in FIG. 9. The ear 432 includes an aperture 62 for securely receiving a cable, rod or other member that can be attached to a handle or other item to provide manual or other movement by a user or device.

In an exemplary arrangement when a user pulls the handle to cause the ear 432 to move downwardly in the configuration shown with sufficient force to overcome the biasing force of the spring 34, the release pawl 428 rotates clockwise (as viewed from the back or rear side of the latch in FIG. 9) to the second position. The first projection 116 disengages from the detent 108 of the catch jaw 30 when sufficient force is applied to overcome the biasing force of the first coil 94 of the spring 34 acting against the release pawl 28. Disengagement of the first projection 116 and the detent 108 releases the holding force of the first projection 116 of the release pawl 428 acting against the catch jaw 30, such that the biasing force of the second coil 96 of the spring 34 rotates the catch jaw 30 in the clockwise direction (as viewed from the back or rear side of the latch in FIG. 9) to a second position. Rotation of the catch jaw 30 to the second position by the spring 34 biases the post 106 and urges the post to move outward along the guide slot until the post 106 and recess 104 disengage. This allows the post 106 to move out of the recess 104 and disengage from the latch assembly 22. This enables the door or other item operatively connected to the post 106 to be moved relative to the latch.

Figure 10:
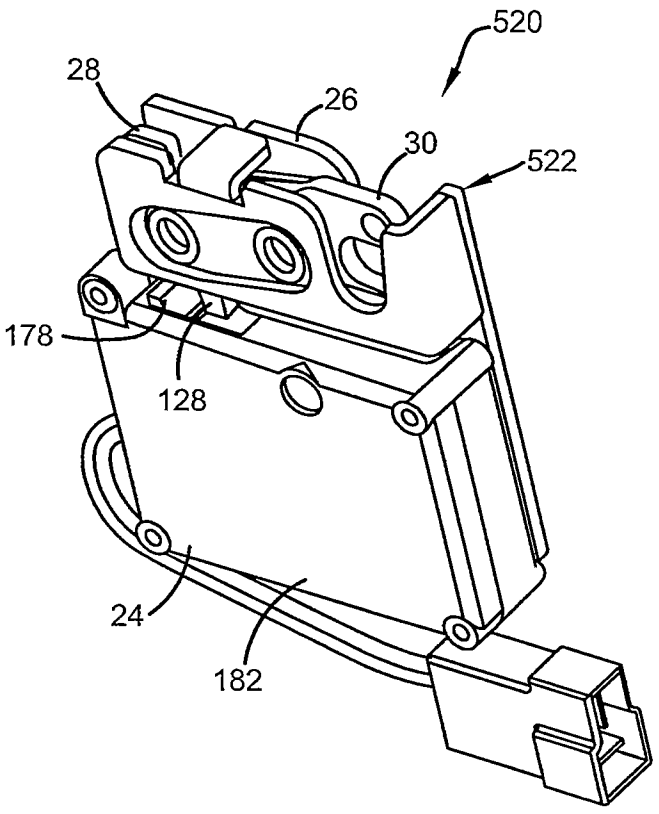
FIG. 10 is a front and right perspective view of an apparatus according to another exemplary embodiment.

FIG. 10 shows another exemplary apparatus 520 in which the actuator 24 is used with a different type of latch assembly 522. This exemplary apparatus 520 is similar to the apparatus 320 of FIGS. 7 and 8 except as discussed below. The same reference numbers will be used to designate elements of the apparatus similar in construction and function as the apparatus of Figures. In this latch assembly 522, the release lever 32 and tab 50 are not present such that the latch assembly 522 may be placed in the open condition solely by operation of the actuator 24.

Figure 11:
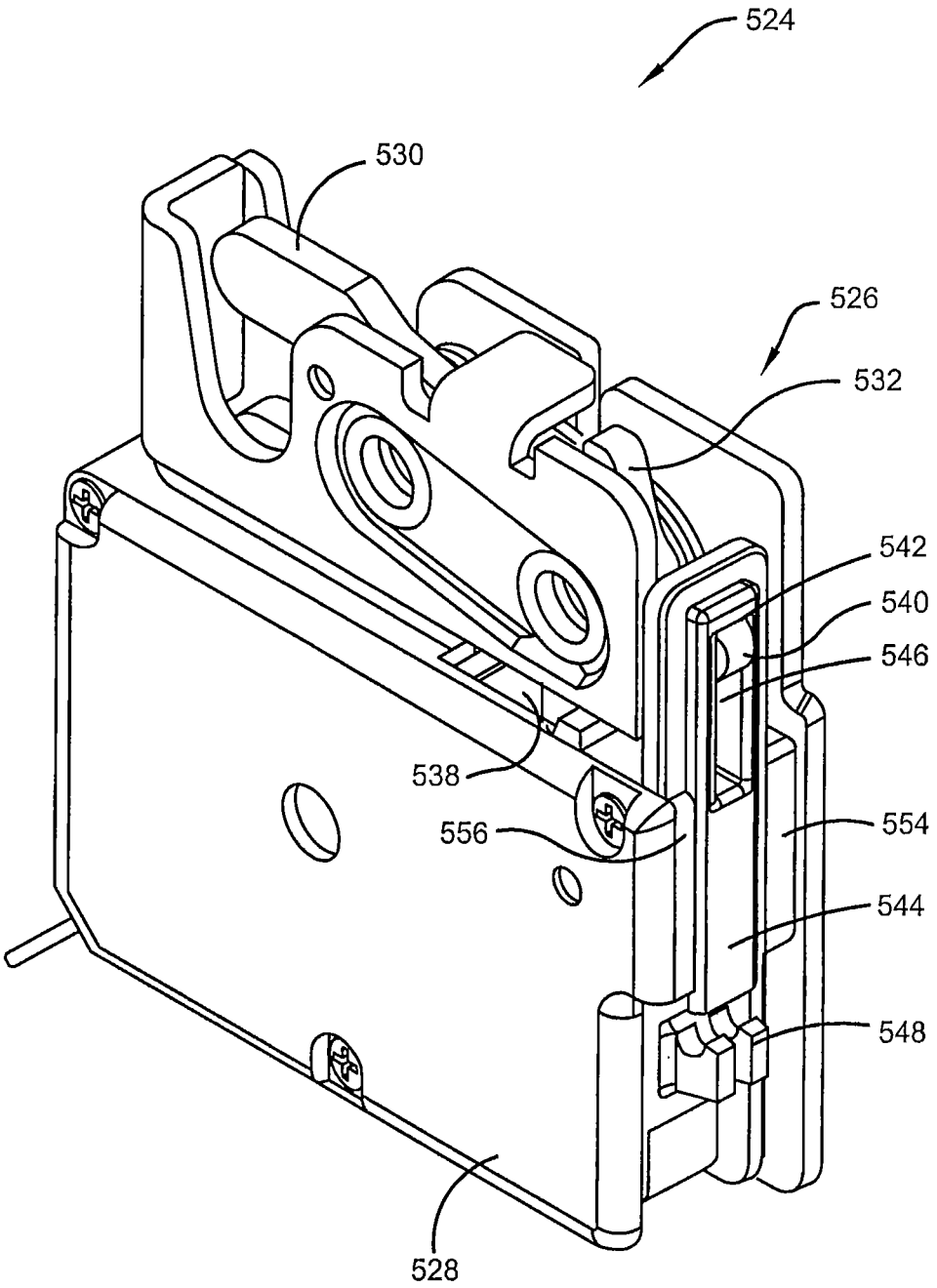
FIG. 11 is a front and right perspective view of a further alternative apparatus according to another exemplary embodiment.
Figure 12:
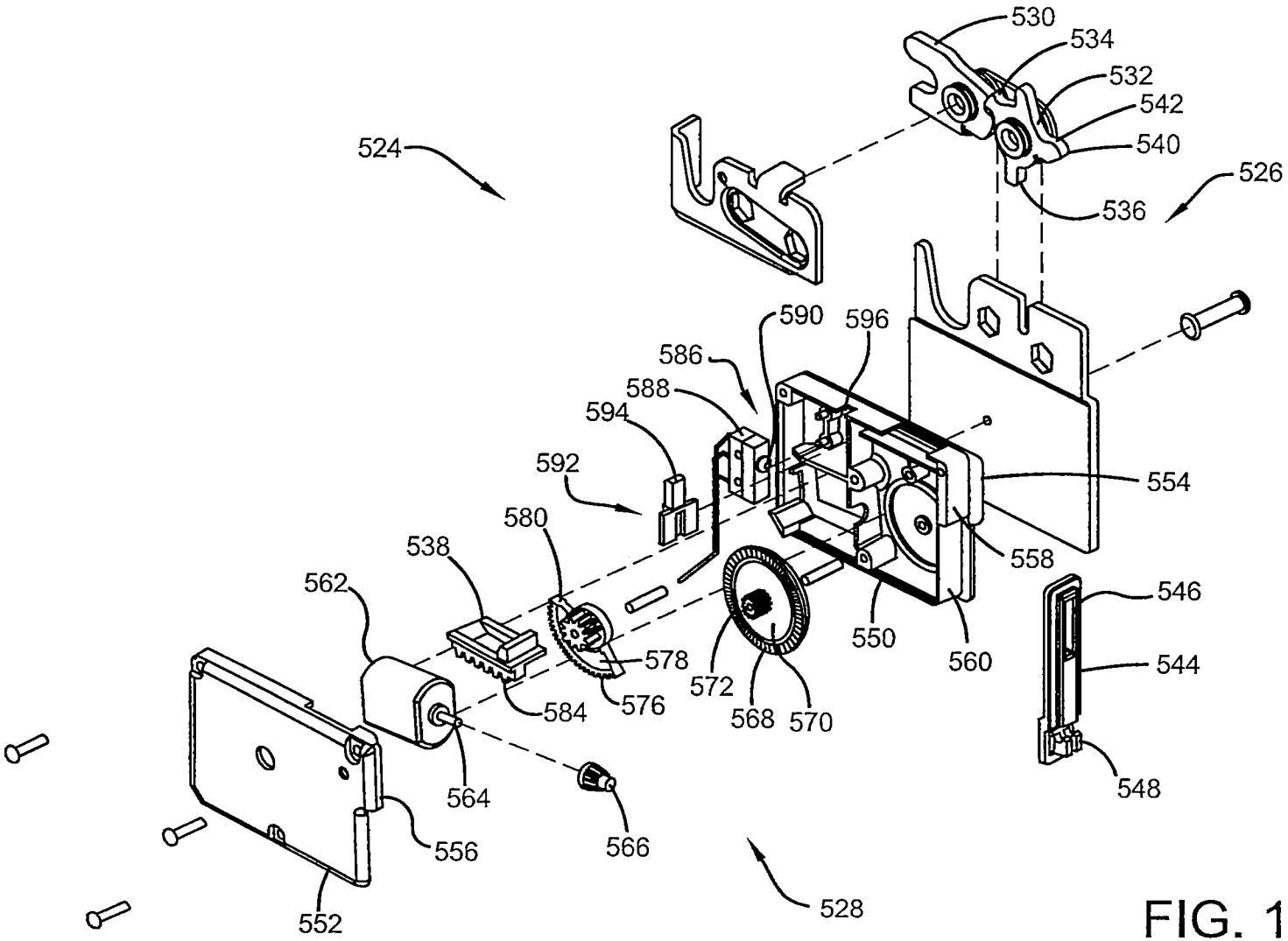
FIG. 12 is an exploded view of the apparatus shown in FIG. 11.
Figure 13:
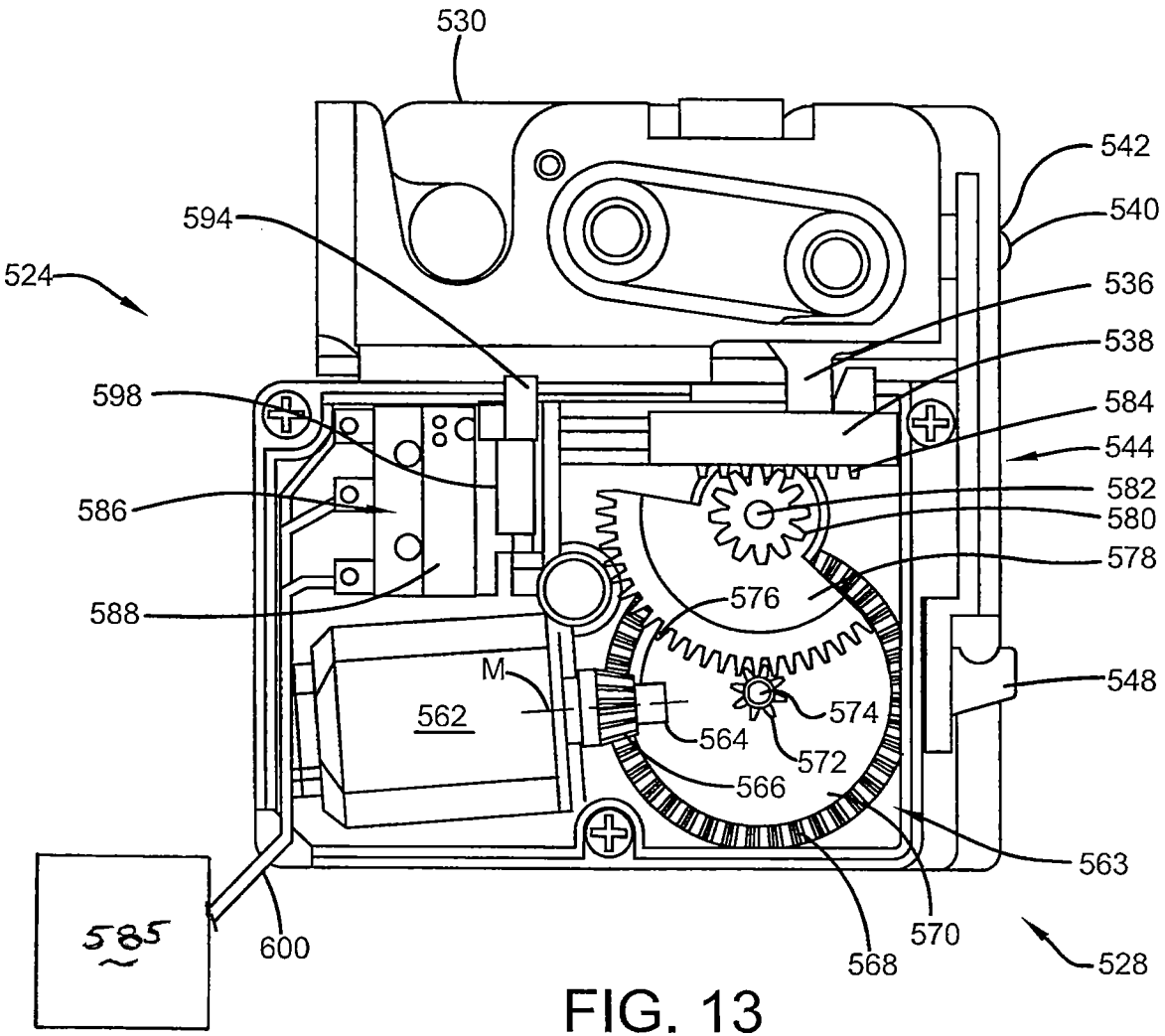
FIG. 13 is a front plan view of the apparatus shown in FIG. 11 with the front housing portion removed.

FIGS. 11-13 show a further exemplary embodiment of an apparatus 524. Apparatus 524 is generally similar to the apparatus 20 described in FIGS. 1-6 except as specifically indicated herein.

Apparatus 524 includes a latch assembly 526 and an actuator 528. The actuator is releasably engageable with the latch assembly. The latch assembly 526 includes a catch jaw 530 which has a configuration generally similar to catch jaw 30. The latch assembly also includes a release pawl 532. The release pawl 532 is generally similar in configuration to release pawl 28 with the exception that it has a different configuration. Release pawl 532 includes a projection 534 which is similar to projection 116 of the previous embodiment. Projection 534 is configured to engage a recess or detent on the catch jaw 530 so as to hold the latch assembly in the closed condition. As represented in FIG. 12, the latch assembly 526 includes a double torsion spring arrangement similar to the prior latch which serves to bias the projection 534 into engagement with the detent of the catch jaw.

The release pawl 532 further includes a release projection 536. The release projection has a configuration similar to projection 126 of the prior embodiment. The release projection 536 is configured to be movably engaged by a release member 538 of the actuator 528 in a manner similar to the prior embodiment.

The release pawl 532 of this arrangement further includes a lever engaging projection 540. The lever engaging projection 540 extends on the release pawl in a direction generally perpendicular to that of the release projection 536. The lever engaging projection is bounded at its upper side by a step surface 542.

The actuator 528 includes a release lever 544. The release lever 544 includes an aperture 546 therethrough. The aperture 546 is configured to accept the lever engaging projection 540 therein. The release lever 544 further includes at an end generally opposed of the aperture, a pair of engaging projections 548. The engaging projections 548 of the exemplary embodiment are configured to have a wire or cable extend intermediate of the projections. The wire or cable may have a cylindrical end piece or other enlarged end piece that is engaged by the arcuate recesses of the projections. This enables the wire or cable to pull the release lever in a downward direction as shown in FIG. 11. Of course it should be understood that other arrangements may be used which include release levers with other types of engaging members.

The actuator 528 of this embodiment is configured to enable the release lever to move in supported operative connection with the body of the housing. In the exemplary arrangement the actuator has a housing that includes a first casing portion 550 and a second casing portion 552. The first casing portion 550 includes a forwardly directed flange projection 554. The casing portion 552 includes a rearwardly directly flange projection 556. In the operative position of the actuator 528, flange projections 554 and 556 are configured to provide a guide slot on the exterior of the housing. The release lever is configured to be movable in supported connection with the housing and is constrained by the guide slot to move only in a generally vertical direction relative to the housing body as shown. In addition, the first casing portion includes an outward extending step portion 558. The step portion 558 underlies the guide slot and further helps to constrain the movement of the release lever along the vertical direction as shown. A recess portion 560 extends on the exterior of the casing portion 550 generally below the step portion 558. The recess portion 560 provides access for the inward extending lower portion of the release lever 544 which includes the engaging projections 548. Of course it should be understood that this configuration is exemplary and in other embodiments other arrangements may be used.

As shown in FIGS. 11 and 13, in the assembled condition of the apparatus 524 the release lever is positioned such that the lever engaging projection 540 of the release pawl extends in the aperture 546. Movement of the release lever by a wire or cable or similar actuating member in a downward direction as shown, causes the lever engaging projection 540 to be moved through engagement of the surface bounding the upper end of the aperture and the step surface 542. Clockwise rotation of the release pawl 532 as shown causes the projection 534 to move relative to the detent on the catch jaw 530. This enables the catch jaw to move from the closed condition in which the catch jaw engages the post or other member which is attached to the latched item, to an open condition in which the post is disengageable from the catch jaw. This enables the door or other item controlled by the latch to be moved to an open or unlatched condition. Of course as can be appreciated, when the latch is to be closed, the post may be moved to engage the catch jaw in the open position. Movement of the post toward the latch assembly causes rotation of the catch jaw until the projection 534 is again engaged with the detent of the catch jaw which holds the latch in the closed condition. Rotation of the release pawl and movement of the lever engaging projection 540 thereof, is enabled within the aperture of the release lever 544. The exemplary release lever 544 is configured to enable the latch assembly to be returned from the open condition to the closed condition. Of course it should be appreciated that this configuration is exemplary and in other embodiments other arrangements may be used.

The exemplary apparatus 524 is also configured to be unlatched through movement of the release member 538. This is done by moving the release projection 536 of the release pawl in a manner similar to that of the previously described embodiment. Actuator 528 includes a drive 562 which in this case includes an electric motor. The drive is operative to change the condition of the latch through a gear system 563. The electric motor includes a motor shaft 564 to which a pinion 566 is attached. Pinion 566 engages a ring gear portion 568 of a first reduction gear 570. Reduction gear 570 is operatively connected to a pinion 572 that in the exemplary arrangement is integrally formed therein. The reduction gear 570 rotates about a first axis of rotation 574.

The pinion 572 engages an arcuate gear portion 576 of a second reduction gear 578. A pinion 580 is operatively connected with reduction gear 578. Pinion 580 rotates about an axis of rotation 582. The pinion 580 engages a gear rack 584 of the release member 538 and is operative to move the release member in a linearly straight direction in a manner like that described in connection with the prior embodiment responsive to operation of the motor.

In the exemplary configuration of actuator 528 the motor 562 is positioned to provide room within the housing of the actuator for other components. Specifically in this exemplary arrangement the motor shaft 564 rotates about an axis (labeled M in FIG. 13) which extends at an angle other than perpendicular to a projection that extends between the axis of rotation 574 of the first reduction gear and the axis of rotation 582 of the second reduction gear. By positioning the drive motor 562 in this manner, rotational torque is enabled to be transmitted through the gear system so as to reliably move the release pawl and change the condition of the latch from the closed condition to the open condition. However, this arrangement also provides additional room within the housing for other components such as those described hereafter. Of course it should be understood that this arrangement is exemplary and in other embodiments other drive arrangements may be used.

In the exemplary arrangement the actuator 528 includes a switch 586. Switch 586 is an electrical switch that is operative to provide electrical signals corresponding to the position of the catch jaw 530. The exemplary switch 586 includes an electrical switch body 588. Switch body 588 includes a spring loaded actuator button 590 that extends biasingly outward from the switch body 588 (see FIG. 12). In the exemplary arrangement the electrical condition of the switch changes with the extent to which the actuator button 590 extends outward from the switch body 588.

In the exemplary arrangement switch 586 further includes a plunger member 592. Plunger member 592 includes a body portion that is movably guided vertically on guide projections that extend within casing portion 550. The plunger member 592 further includes a finger portion 594 that is sized to extend outwardly through an opening 596 in the casing portion 550. The plunger member 592 is biased by a spring (not separately shown) that urges the finger portion 594 to extend outwardly from the opening 596. In the exemplary arrangement the side of the plunger member that is in facing relation to the actuator button 590 includes a ramp surface 598. The ramp surface is configured so that when the plunger member is disposed inwardly of the housing due to engagement of the finger portion and the lower face of the catch jaw, the ramp portion disposes the actuator button 590 inwardly so that the switch body 588 is in a first electrical condition. This position of the plunger member and the electrical condition of the switch correspond to the latch assembly being in the closed condition.

When the catch jaw 530 moves to the open condition of the latch assembly, the lower surface of the catch jaw is disposed away from the actuator housing so that the finger portion 594 is disposed outwardly in response to the biasing force of the spring. The movement of the ramp portion 598 relative to the actuator button 590 causes the button to extend further outward from the switch body. This causes the switch body to be in a second electrical condition. The second electrical condition is indicative that the latch assembly is in the open condition. In some alternative arrangements in which the latch may be hold be the release pawl in a partially closed position in which the catch jaw engages the post or other member, a switch may be used which provides an electrical indication that the latch is in this partially latched condition. Suitable wiring 600 is operatively connected to the switch body 588 and extends outward from the actuator housing. Suitable electrical circuitry of the type previously discussed is operatively connected to the wiring so as to provide an indication of when the switch is in the open and/or closed (or partially closed) conditions. Similarly in the exemplary embodiment the wiring 600 may include the wires necessary to power the motor 562.

As can be appreciated, in the exemplary arrangement suitable circuitry is provided to cause the motor 562 to rotate in a first rotational direction for purposes of changing the condition of the latch assembly from the closed condition to the open condition. In the exemplary arrangement this results from the straight linear movement of the release member 538 to a release position. Once the latch has been opened, the circuitry is operative to cause the motor 562 to rotate in an opposed direction so as to cause the release member to be returned to its original return position which is fully disposed to the right as shown in FIG. 13. Returning the release member 538 to this return position enables the release projection 536 on the release pawl to again extend in the recess of the release member. With the release pawl 532 in this position, the catch jaw 530 is enabled to be moved by engagement with a post or other suitable member from the open condition to a closed condition in which the release pawl holds the catch jaw so as to engage the post in generally immovable relation within the latch assembly.

In exemplary arrangements, suitable control circuitry 585 may be utilized to control the condition of the release member and the latch assembly responsive to the condition of the latch as sensed through operation of the switch 586. For example in some arrangements circuitry 585 may operate in response to the switch indicating that the catch jaw is positioned such that the latch is in the closed condition to make a determination that the release member 538 is positioned to the retracted position shown in FIG. 13. This determination is made through operation of the control circuitry responsive to the fact that the latch is in the closed condition, which in the exemplary embodiment may only occur when the release pawl 532 is enabled to have the release projection 536 extend into engagement with the recess of release member 538.

In some exemplary arrangements the control circuitry is enabled to operate the motor 562 so as to rotate in a first direction so as to cause the latch assembly to change from the closed condition to the open condition. The change in condition of the latch assembly is sensed through operation of the switch 586. In response to sensing the change in condition of the latch, the exemplary control circuitry may reverse the direction of operation of the motor so as to return the release member 538 to its original retracted return position. This may be done in some exemplary circuitry through the use of a timing function that causes the motor to operate in an opposite rotational direction that corresponds to the time that the motor rotated in a first rotational direction to cause the latch assembly to change conditions. In other arrangements the control circuitry may operate a stepper motor or other motor that measures the rotational displacement of the motor so as to provide reverse movement of the same displacement. Alternatively in other arrangements, a sensing switch may be provided in operative connection with the release member 538 to determine that the release member has been moved to the retracted or other position. In still other exemplary arrangements, the control circuitry 585 may operate to sense the change in electrical draw by the motor which would indicate that the motor has stopped moving because the release member 538 has reached the end of its travel. In response to sensing an electrical condition corresponding to the bound and stopped condition of the motor, the circuitry may cease supplying electrical power to the motor. Of course it should be understood that these are but examples of approaches that may be used.

In still other exemplary arrangements, control circuitry used in connection with the actuator may detect the catch jaw in the open position and not include control logic which determines whether the open condition was caused through operation of the motor or manual operation of the associated manual release lever such as release lever 32 or 544. In such exemplary arrangements the control circuitry may operate in response to the switch 586 detecting that the latch is in the open condition to detect the position of the release member 538 in one of the ways previously discussed. The control circuitry may then operate the motor as appropriate to assure that the release member is in its retracted position so that the latch assembly may again be returned to the closed condition. Of course it should be understood that these approaches are exemplary and numerous other types of control circuitry and control logic may be used in connection with latch apparatus arrangements.

Figure 14:
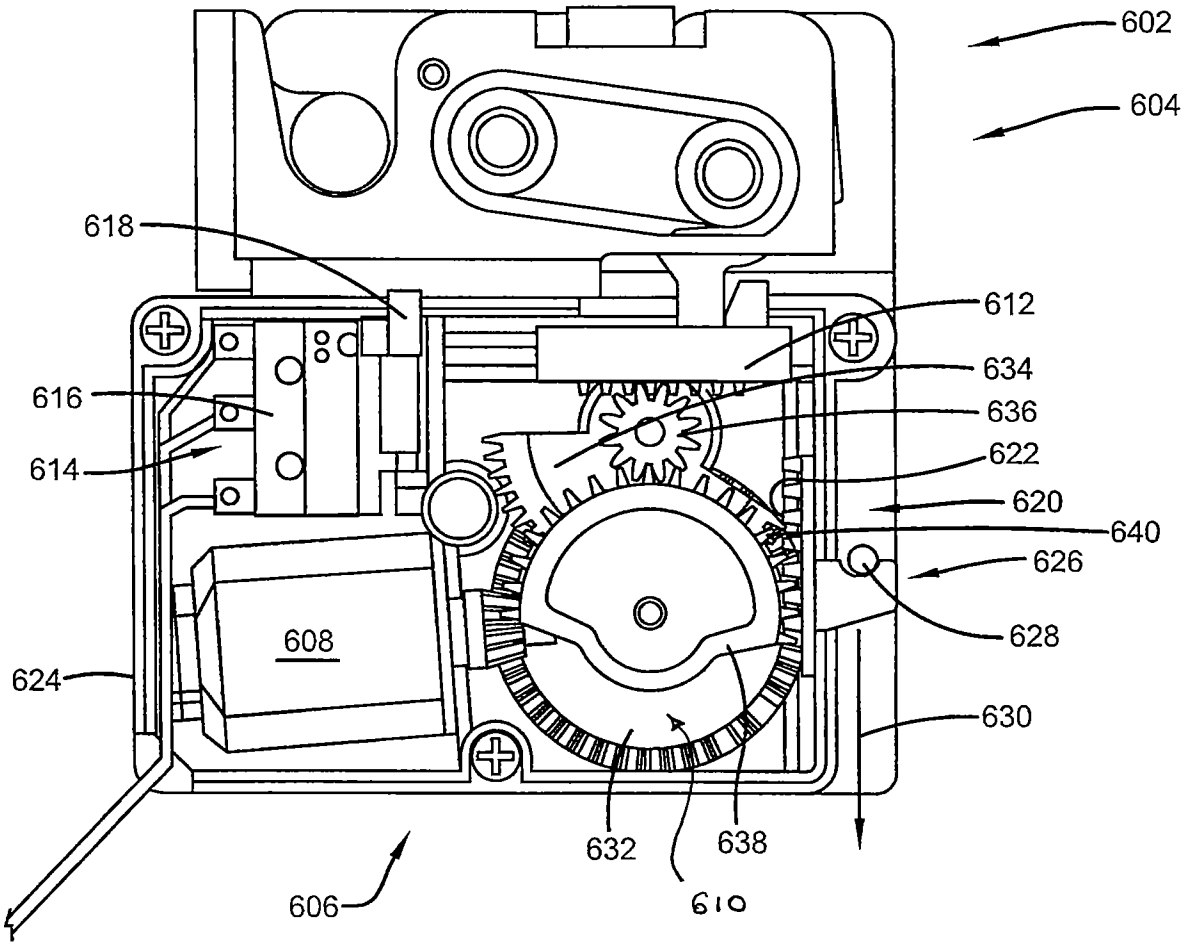
FIG. 14 is a plan view of an apparatus according to another exemplary embodiment with the front portion of the housing removed.
Figure 15:
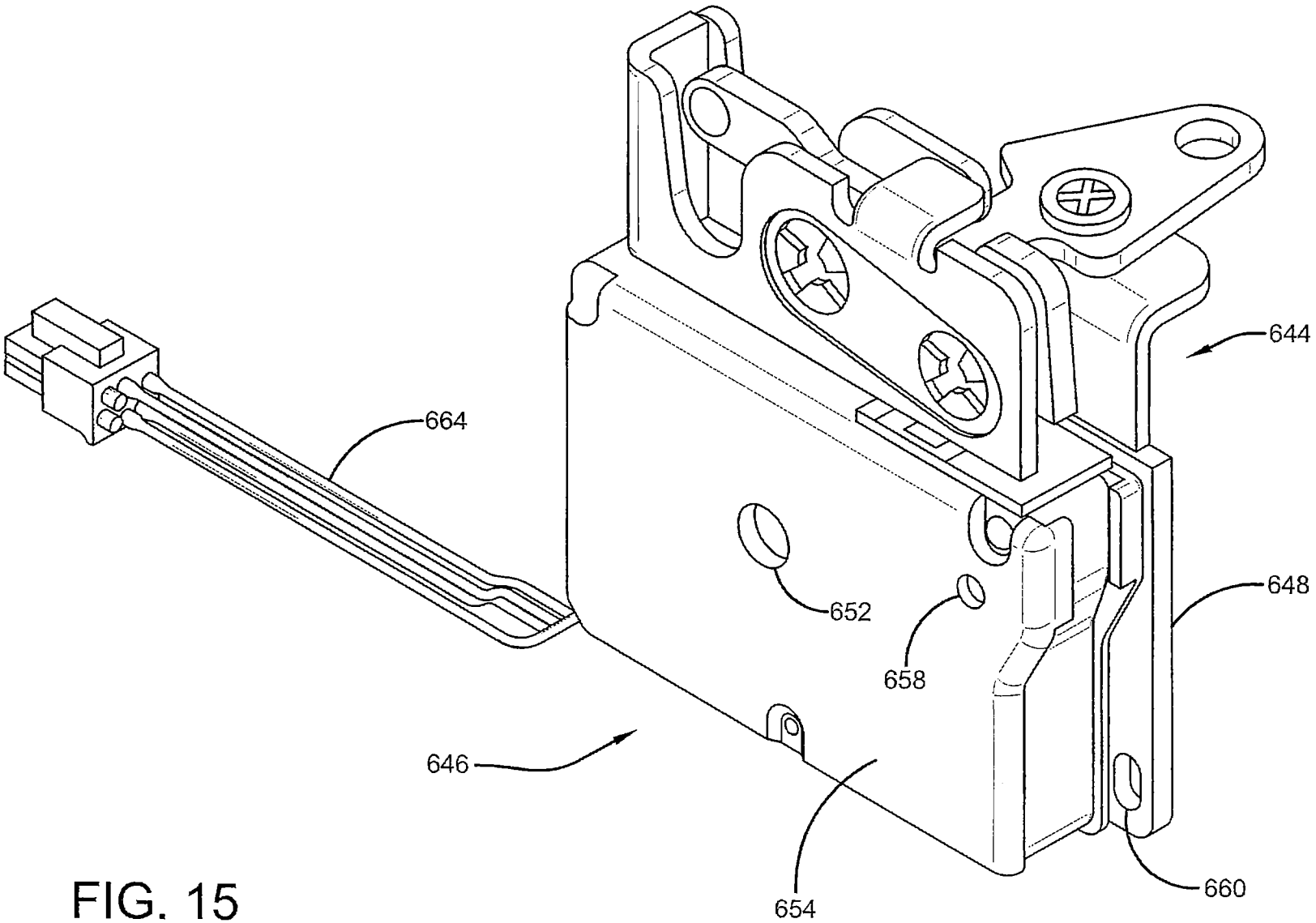
FIG. 15 is a right front isometric view of an alternative embodiment of a latching apparatus.
Figure 16:
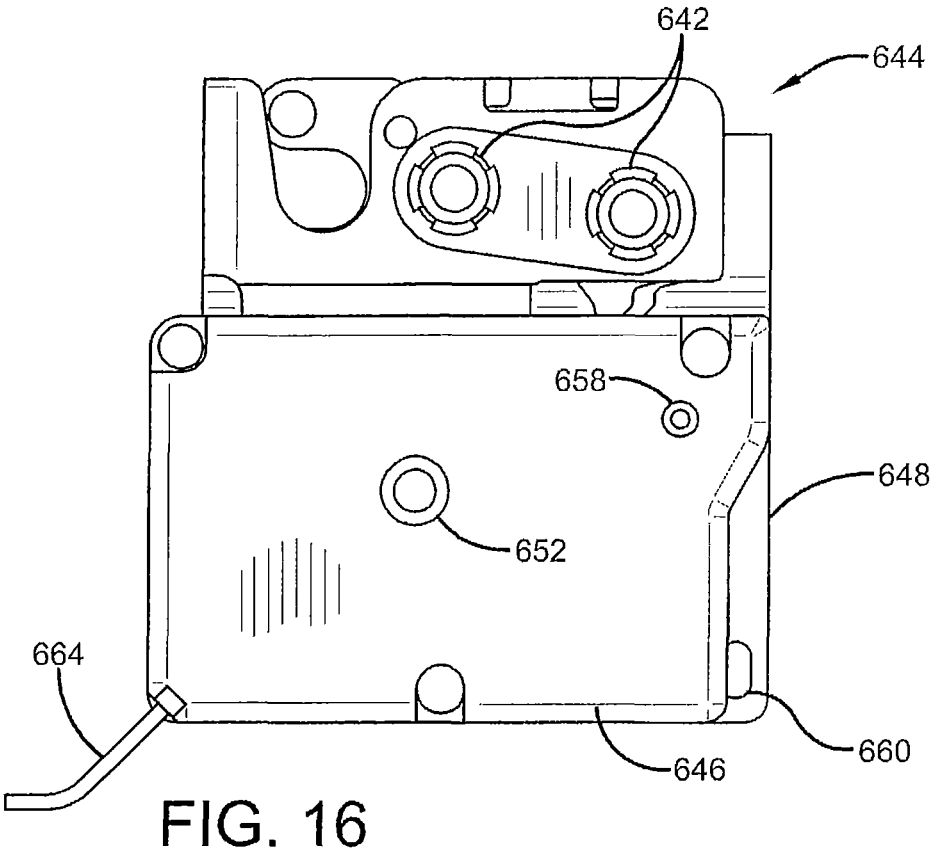
FIG. 16 is a front view of the latching apparatus shown in FIG. 15.

FIG. 14 shows a further embodiment of a latch apparatus generally indicated 602. Apparatus 602 includes a latch assembly 604 which is generally similar to latch assembly 22. Apparatus 602 further includes an actuator 606. Actuator 606 is generally similar to actuators 24 and 528 except as described herein.

The exemplary actuator 606 includes a drive 608. The latch further includes a gear system 610 which includes a pair of reduction gears that are operative to move a release member 612 in response to operation of the drive 608 in a manner like that which has been previously described.

Actuator 606 further includes a switch 614. Switch 614 includes a switch body 616 and a biased plunger member 618 which includes a finger portion that is biased to extend outwardly from the actuator housing.

Actuator 606 further includes a trip release member 620. The trip release member 620 is movably mounted in operative supported connection with the housing of the actuator 606. The exemplary trip release member 620 includes a linear gear rack 622. Gear rack 622 extends within the housing 624 of the actuator 606. The trip release member 620 and the housing 624 are configured to enable the trip release member to move relative to the housing along a generally vertical direction as shown in FIG. 14.

The exemplary trip release member 620 further includes a pair of engaging projections generally indicated 626. The pair of the engaging projections is generally similar to engaging projections 548 of the previously described embodiment. The pair of engaging projections is configured to enable a cable or wire to extend therebetween and each projection includes an arcuate surface suitable for engaging a cylindrical head at the end of the cable or wire, such as head 628 shown in FIG. 14. Movement of the cable 620 downward in the orientation shown in FIG. 14 is operative to cause the trip release member 620 to correspondingly move downward. In the exemplary arrangement the housing 624 includes a suitable rectangular aperture in the wall thereof so as to enable the trip release member to move therein.

In the exemplary arrangement of actuator 606, the gear system 610 includes a reduction gear 632 that is similar to reduction gear 570 of the previous embodiment. Reduction gear 632 is in operative connection with a further reduction gear 634 which is generally similar to reduction gear 578. Reduction gear 634 includes a pinion 636 which is in engagement with the gear rack of the release member 612 in a manner similar to that of the previously described embodiment.

Actuator 606 further includes a freewheeling gear 638. Freewheeling gear 638 is rotatable about the same axis of rotation as reduction gear 632. However, freewheeling gear 638 is configured through suitable bushings or other arrangements, to be movable independently of reduction gear 632. Freewheeling gear 638 includes an arcuate gear segment 640. Arcuate gear segment 640 is engaged with both gear rack 622 of the trip release member as well as pinion 636.

In the operation of actuator 606, the latch assembly 604 may be changed between the closed condition and the open condition through movement of the release member 612 through operation of the motor drive 608. This may be done in the manner previously described which includes operating the motor to move the release member so as to cause the release pawl to allow the catch jaw to move from the closed condition to the open condition. Likewise the motor drive may return the release member to its retracted position so that the latch assembly may again be placed in the closed condition.

Actuator 606 further enables the actuator to be changed from the closed condition to the open position through movement of the trip release member 620 without operation of the drive. This is done by moving the trip release member through displacement of the cable 630 so as to cause the gear rack 622 on the trip release member to move downward as shown in FIG. 14. This movement of the trip release member causes the freewheeling gear 638 to rotate in a clockwise direction as shown. Clockwise rotation of the freewheeling gear 638 causes the pinion 636 that is engaged therewith to rotate in a counterclockwise direction. Counterclockwise rotation of the pinion 636 causes the gear rack associated with the release member 612 to move the release member linearly to the left as shown in FIG. 14. This causes the release pawl to move such that the catch jaw of the latch assembly can change from the closed condition to the open condition.

As can be appreciated, in the exemplary arrangement of the apparatus shown in FIG. 14, movement of the release member 612 through operation of the trip release member 620 also operates to cause the reduction gears 634 and 632 to rotate in response thereto. This similarly causes the drive motor 608 to rotate as well. In this exemplary arrangement because the motor drive can be selectively generally freewheeling, the trip release member can be used to change the condition of the latch assembly to the open condition without operation of the drive. Once the latch assembly is in the open condition, this condition may be sensed through operation of the switch associated with the actuator and the control circuitry may operate the motor to cause the release member 612 to be returned to the retracted position. Further, in this exemplary arrangement the circuitry may be configured to energize the motor to brake and oppose movement that may be imparted by the trip release member so as to selectively prevent the change in condition of the latch via the trip release member at times determined through operation of the circuitry. Of course it should be understood that these approaches are exemplary and in other arrangements, other components, drive mechanisms and control circuitry may be utilized to effectively control the condition of the exemplary latch assembly or other types of latching mechanisms.

Figure 20:
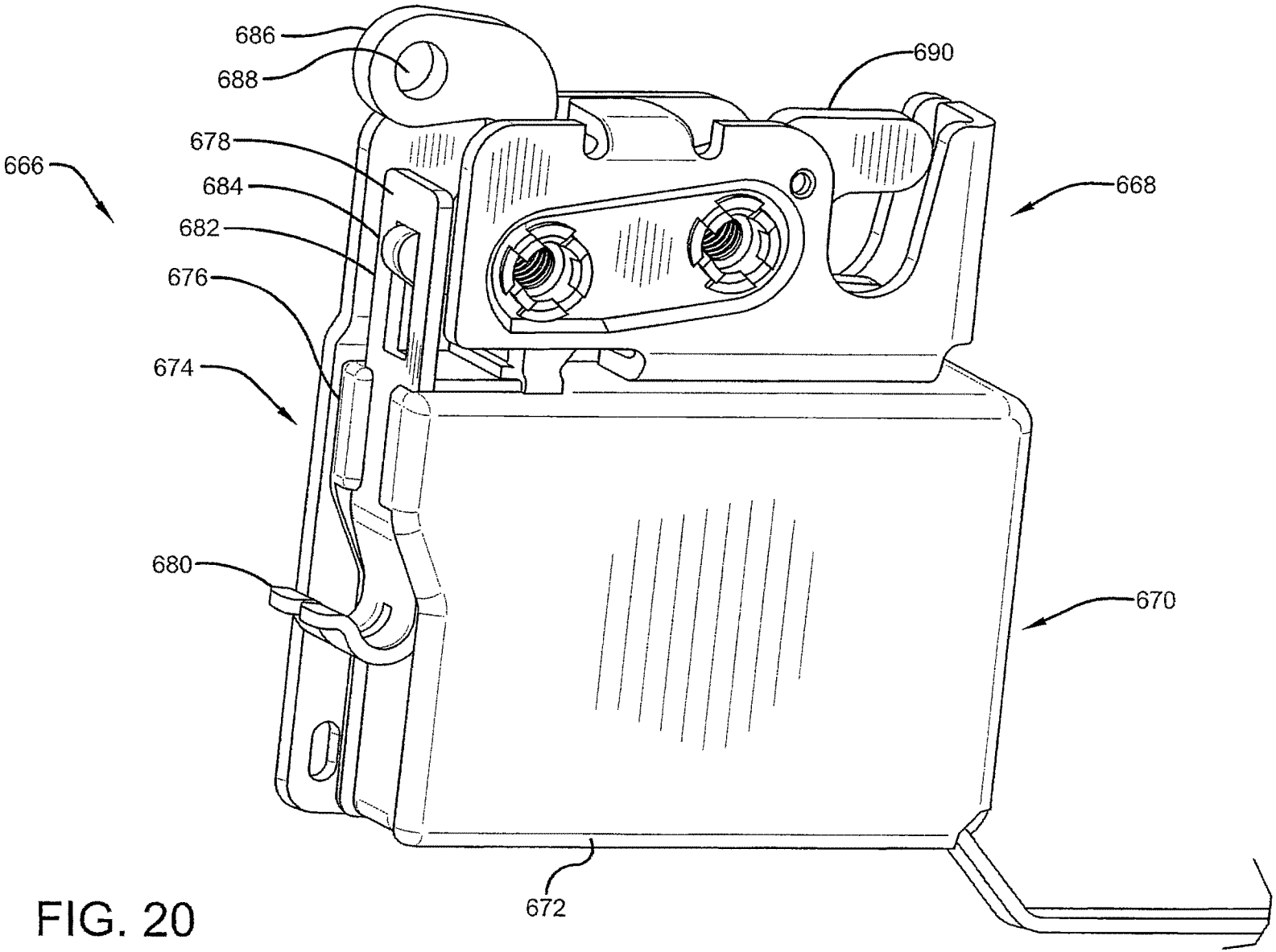
FIG. 20 is a further alternative embodiment of a latching apparatus shown in a latched condition.
Figure 21:
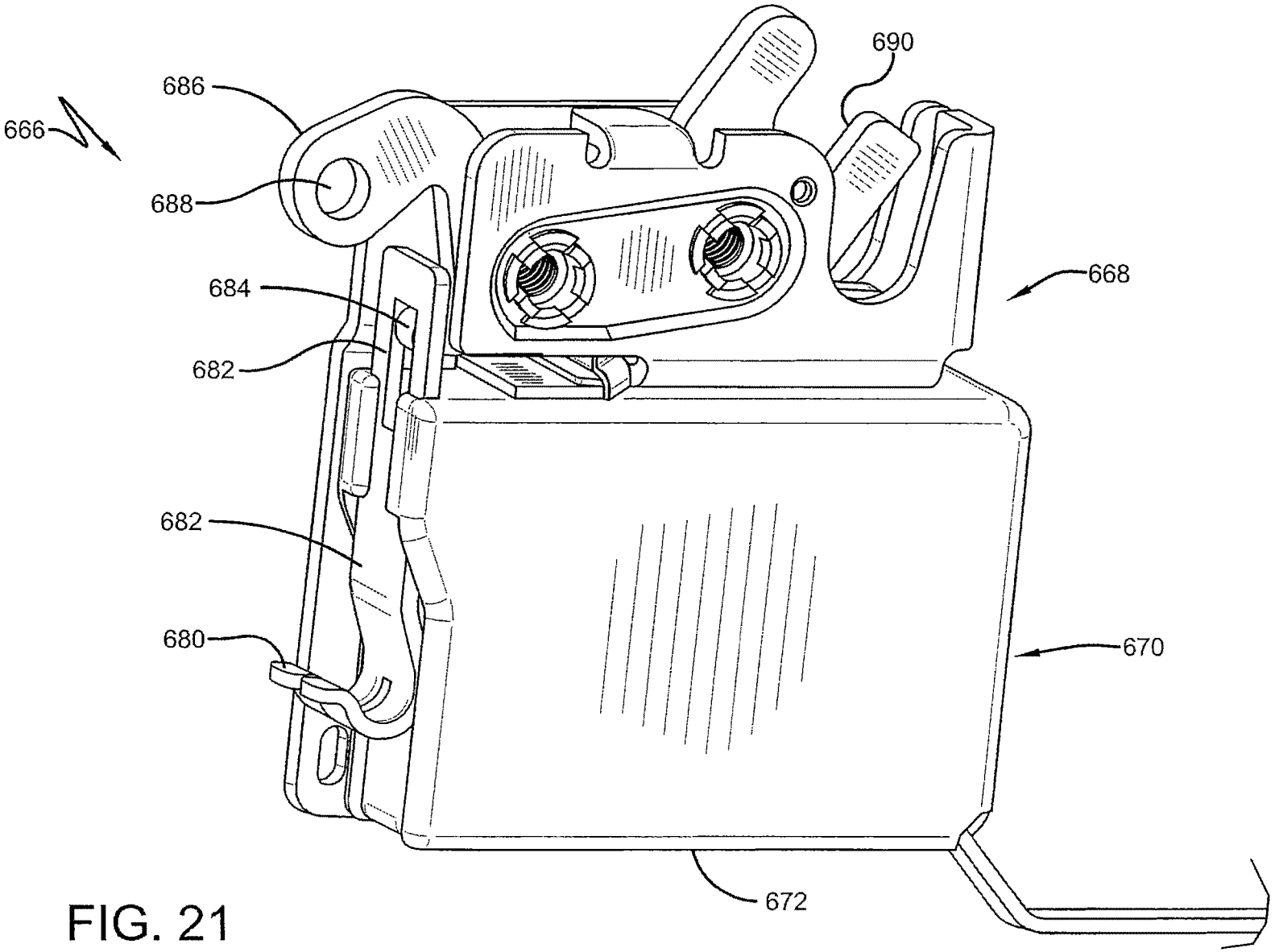
FIG. 21 is a view similar to FIG. 20 with the latching apparatus shown in an unlatched condition.

FIGS. 20 and 21 show a further alternative embodiment of a latching apparatus 666. The apparatus includes a latch assembly 668 and an actuator 670. In this exemplary arrangement, the actuator 670 has a housing 672. The housing 672 has many similar features to housing 654 of the actuator previously described.

The housing 672 includes a guide slot 674. The guide slot 674 is bounded in cross section by a pair of in-turned fingers or tracks 676. Similar tracks are shown in the top and bottom views of the actuator 646 shown in FIGS. 18 and 19.

In the exemplary configuration of housing 672, a release lever 678 is movable in the guide slot. In the configuration shown, the release lever 678 is constrained to move in a generally vertical direction between the tracks 676. The exemplary release lever 678 includes at a first end, engaging projections 680. The engaging projections 680 are configured to engage a lever, cable or other mechanism that is moved to cause corresponding movement of the release lever 678.

The end of release lever 678 generally opposite the engaging projections 680 includes an aperture 682. Aperture 682 is configured to receive therein an engaging projection 684. The engaging projection 684 is part of a release pawl similar to those previously described.

Further, the release pawl of latch assembly 668 further includes an ear 686. Ear 686 includes an aperture 688 therein. The aperture 688 is sized for accepting a lever, linkage or cable therein, which is suitable for manually moving the release pawl.

As represented in FIG. 20, in the exemplary arrangement a release pawl to which the engaging projection 684 and the ear 686 are operatively connected, is operative to hold a catch jaw 690 in a latched position. Moving the release lever 678 downward as shown in FIG. 20 is operative to cause the engaging projection 684 to likewise move downward to the position shown in FIG. 21. This moves the release pawl and causes the catch jaw 690 to move to the unlatched position similar to that described in connection with the apparatus 524 previously described.

Alternatively or in addition, if a lever is connected to ear 686, movement of the ear by the lever downward, which is counterclockwise as shown from the position in FIG. 20, to the position shown in FIG. 21, is also operative to cause the catch jaw to move to the unlatched condition. This enables the latch assembly 668 to operate in a manner similar to the apparatus 420 previously described. In addition, the latch is also enabled to be unlatched responsive to electrical actuation of the actuator assembly 646.

Figure 22:
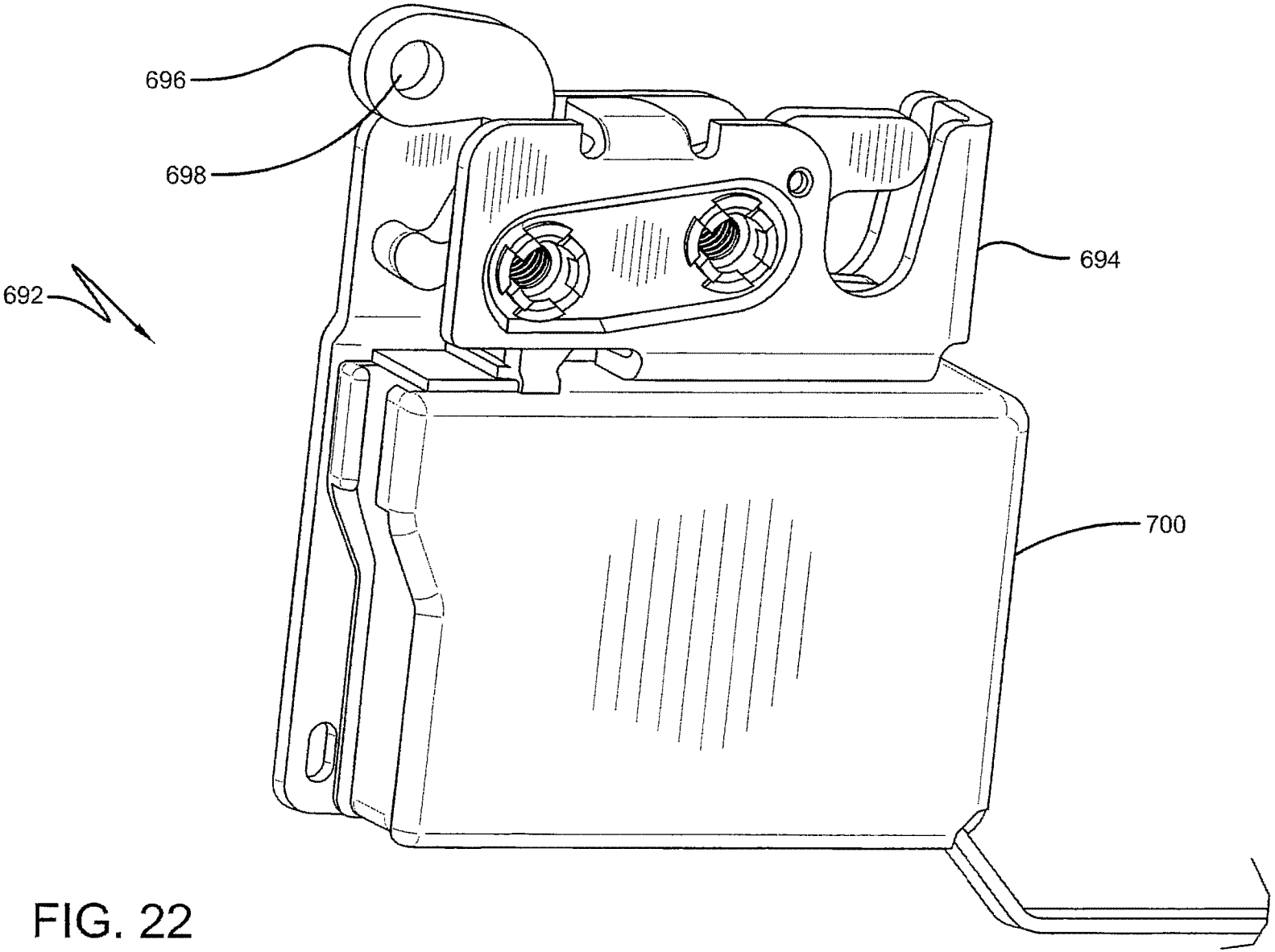
FIG. 22 shows an alternative arrangement of a latching apparatus similar to that shown in FIGS. 20 and 21 without a release member, shown in a latched condition.
Figure 23:
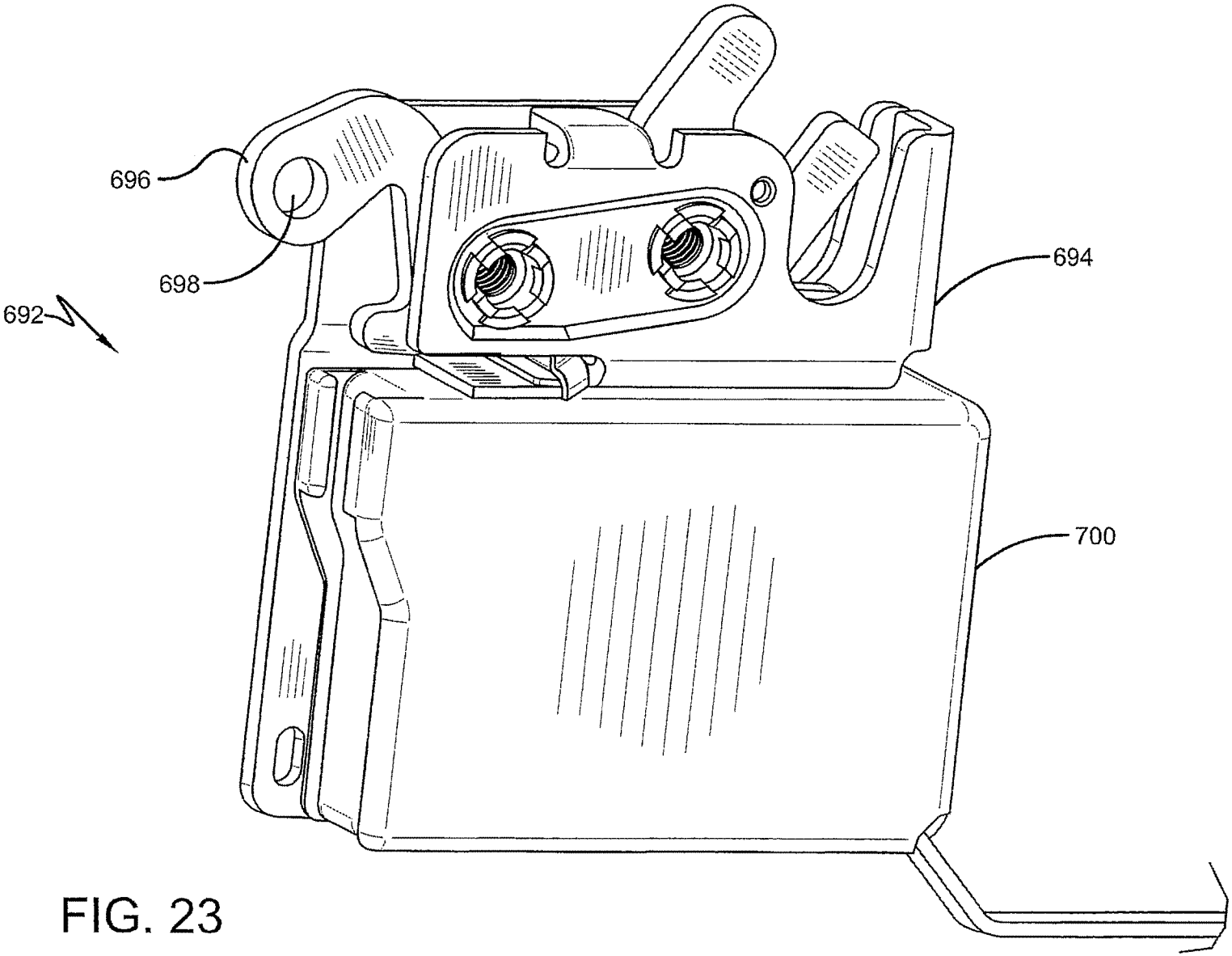
FIG. 23 shows the latching apparatus of FIG. 22 in an unlatched condition.

FIGS. 22 and 23 show an apparatus 692. Apparatus 692 is the same as apparatus 666, except that it does not include a release lever similar to release lever 678. Instead in this exemplary embodiment, the latch assembly 694 includes an ear 696 with an aperture 698 therein. As represented by FIGS. 22 and 23, in this exemplary arrangement the latch may be changed from the latched condition to the unlatched condition by movement of the ear 696 through a lever, cable or other member engaged with ear via the aperture 698. Further, the latch assembly 694 can be electrically changed from the latched to the unlatched condition by operation of the actuator 700. Thus, it should be appreciated from the description of the housing of the exemplary actuator, that numerous different latch assembly configurations and release lever configurations may be utilized to provide numerous different options and configurations that allow changing the condition of the latch in response to movement of mechanical members, as well as electrically through operation of the actuator.

FIGS. 24-31 show an alternative embodiment of an actuator 702. Actuator 702 is generally similar to the actuators previously discussed. Actuator 702 includes a housing 704. The housing includes an electric motor 706. Motor 706 has an output shaft 708 on which a pinion gear 710 is supported. The housing also encloses a gear train 712, which similar to the previously described embodiments, includes a pair reduction gears. The pinion 710 is in engagement with a ring gear 714. The ring gear 714 is coaxial with and in driving engagement with a pinion 716. Pinion 716 is in driving engagement with an arcuate gear portion 718. The arcuate gear portion 718 is coaxial with and in driving relation with a pinion 720.

In the exemplary arrangement, the pinion 720 is in operative connection with a release member 722. Like the prior embodiments, the release member 722 includes a gear rack 724, which is in engagement with pinion 720. The exemplary release member 722, similar to other release members that have been described herein, is configured to engage a release pawl to change the condition of a latch assembly from the latched condition to the unlatched condition. Of course, it should be understood that the described actuator configuration is exemplary and in other embodiments other approaches may be used.

Figure 24:
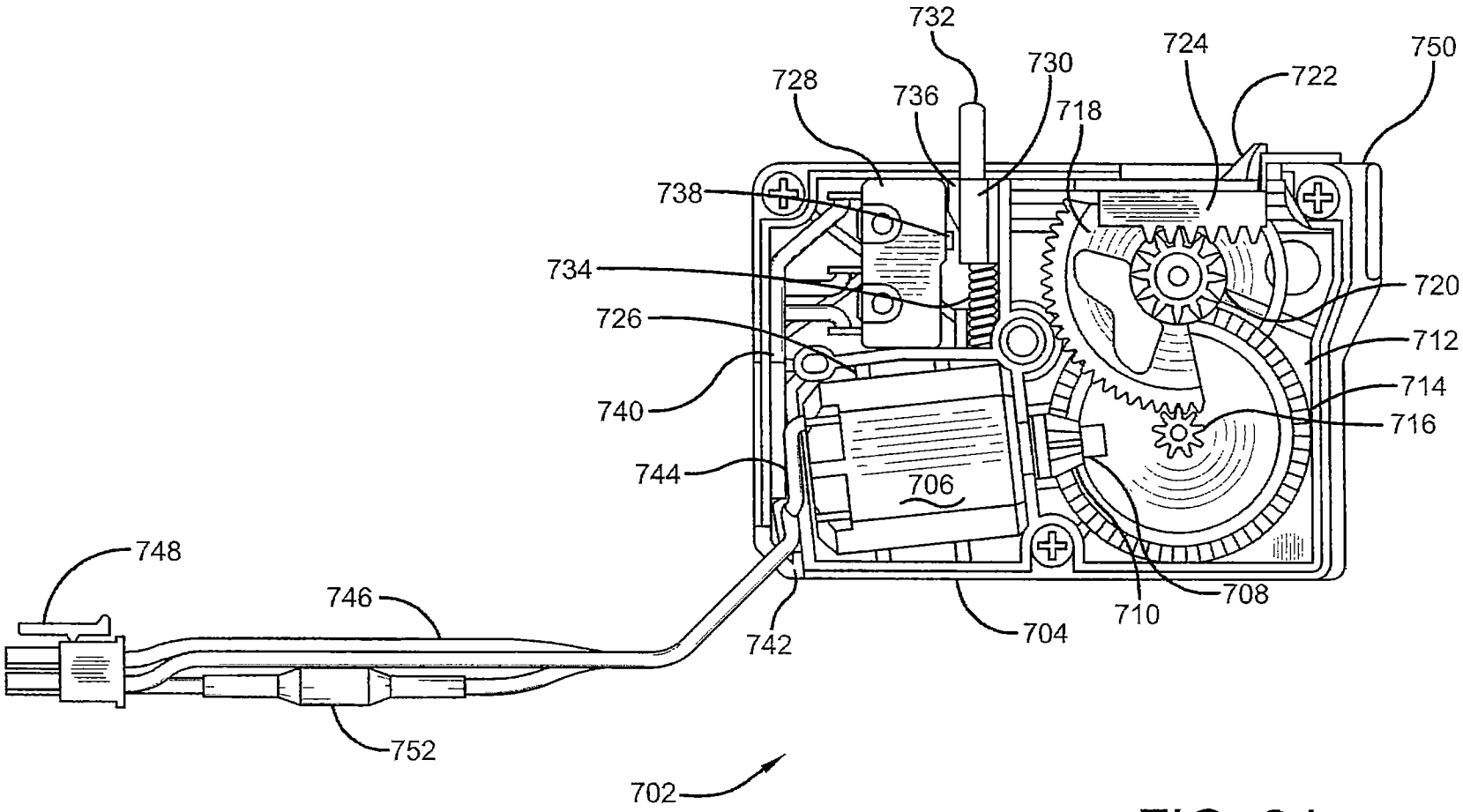
FIG. 24 is a transparent view of a latch actuator shown with the release member in a return position.

Also included in the housing interior area 726 of housing 704 is a switch 728. A plunger member 730 is movably mounted in a vertical direction as shown in FIG. 24. The plunger member includes a finger portion 732 that extends outward from the housing 704 through an opening therein. A compression spring 734 biases the finger portion 732 in an outward direction.

The exemplary plunger member includes a cam surface 736. The cam surface 736 is operative to engage and move a push button 738 on the switch 728. In the exemplary arrangement, similar to the plunger member 592 previously described, the catch jaw of a latch assembly in the latched position is operative to engage and press the finger portion 732 inward. This causes the cam portion 736 to depress the outwardly biased push button 734 on the switch. When the catch jaw is in the release position, the finger portion 732 extends outwardly from the housing 704 and the cam portion 736 is disposed away from the push button 734. As a result, the switch 728 has different electrical conditions that correspond to the position of the plunger member and the condition of the catch jaw, similar to the embodiments previously described.

The exemplary embodiment further includes a plurality of switch wires 740 that extend inside the interior area 726 of the housing and extend outside the housing through an opening 742. A plurality of motor wires 744 extend from the motor 706 through the opening 742. The switch wires and the motor wires are engaged together in a wiring harness 746 that terminates in a modular connector 748. Of course, it should be understood that this configuration is exemplary and in other arrangements other approaches may be used.

Also in the exemplary embodiment of the actuator housing 704, the housing includes tracks 750 similar to tracks 676, which provide a guide slot for movably holding a release member in actuator configurations when one is to be used.

Figure 25:
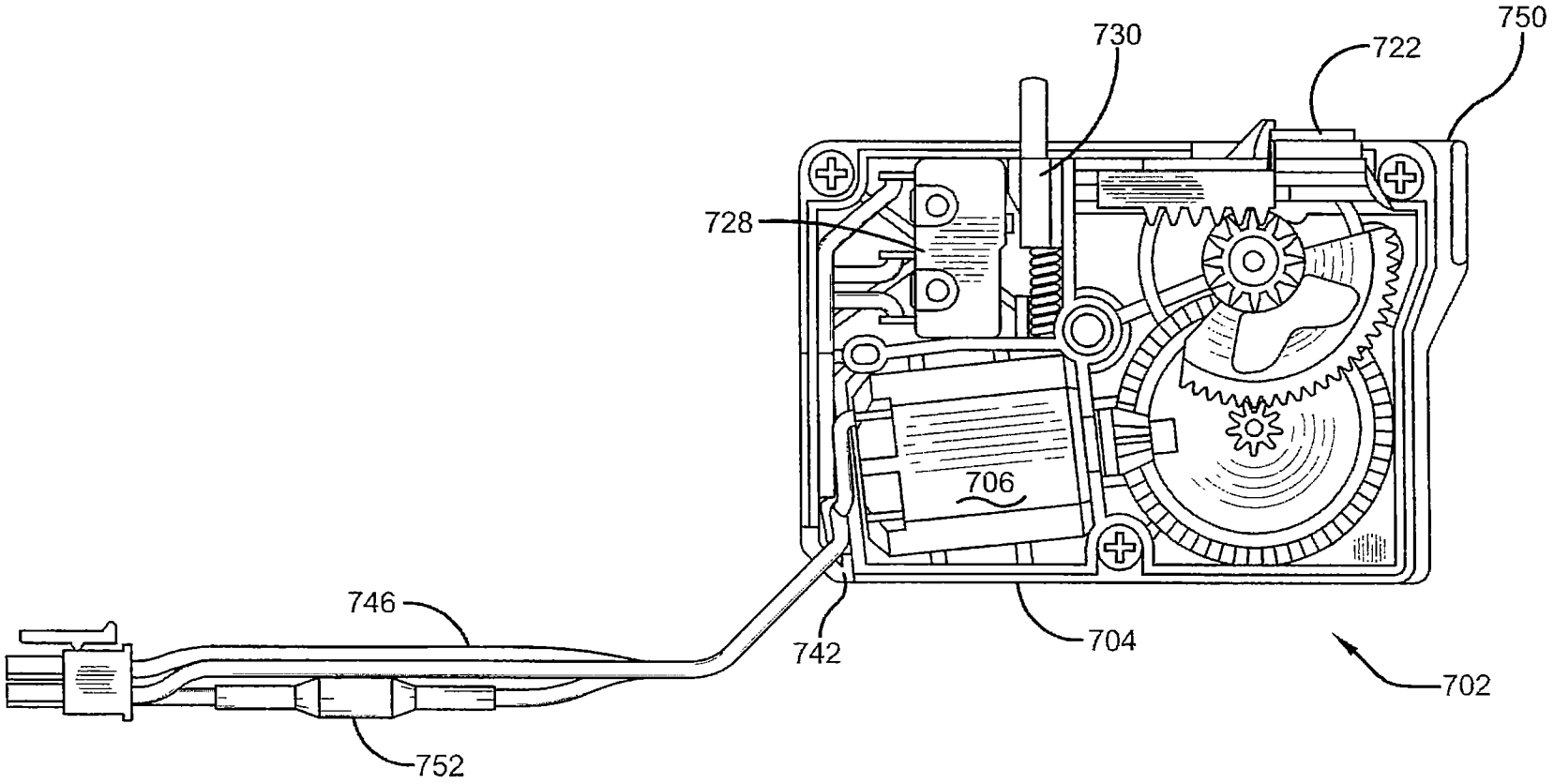
FIG. 25 is a view similar to FIG. 24 with the release member of the latch actuator in a release position.
Figure 26:
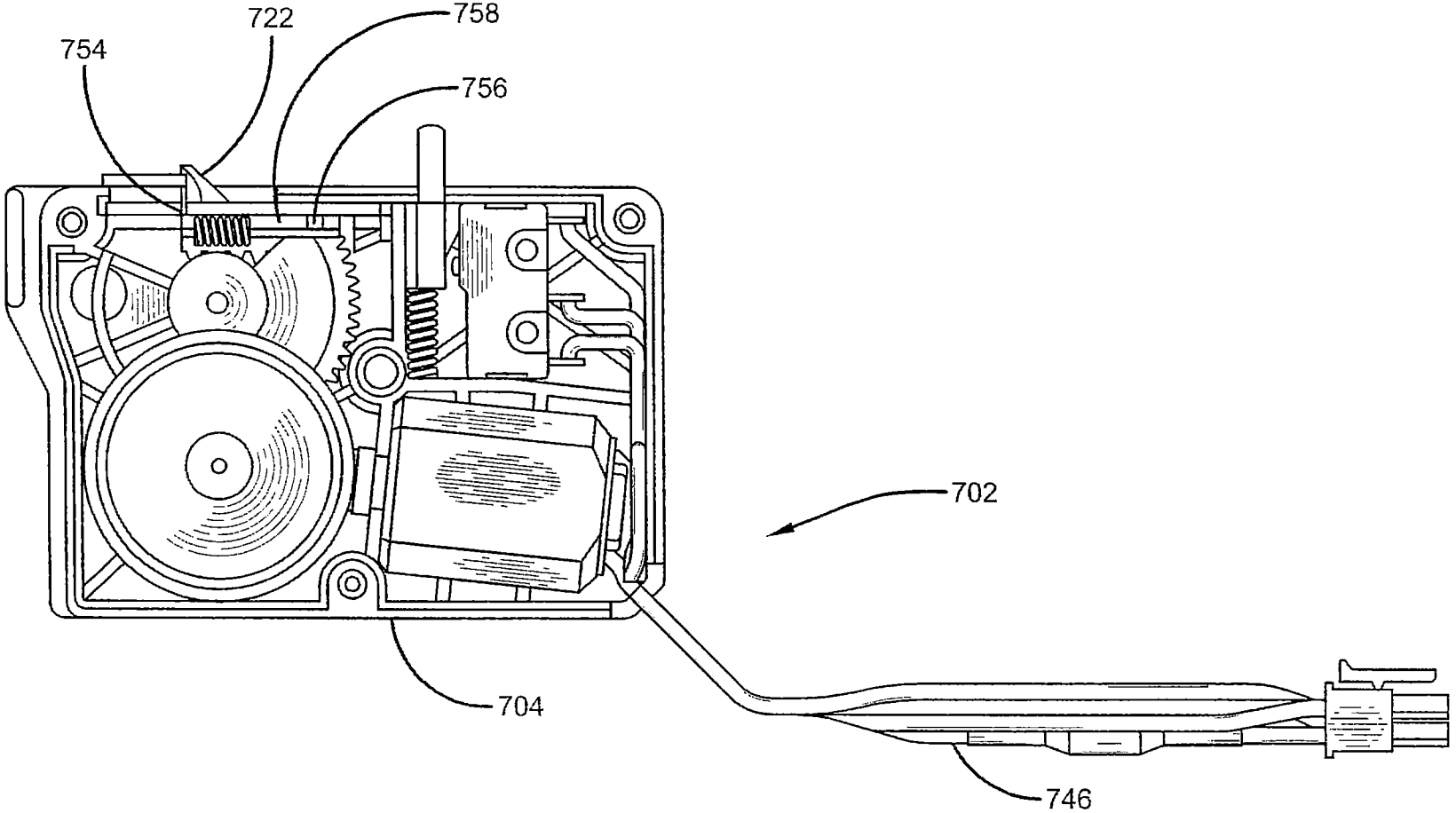
FIG. 26 is a rear transparent view of the latch actuator of FIG. 24 showing the cushioning mechanism for the release member at its extremes of travel.
Figure 27:
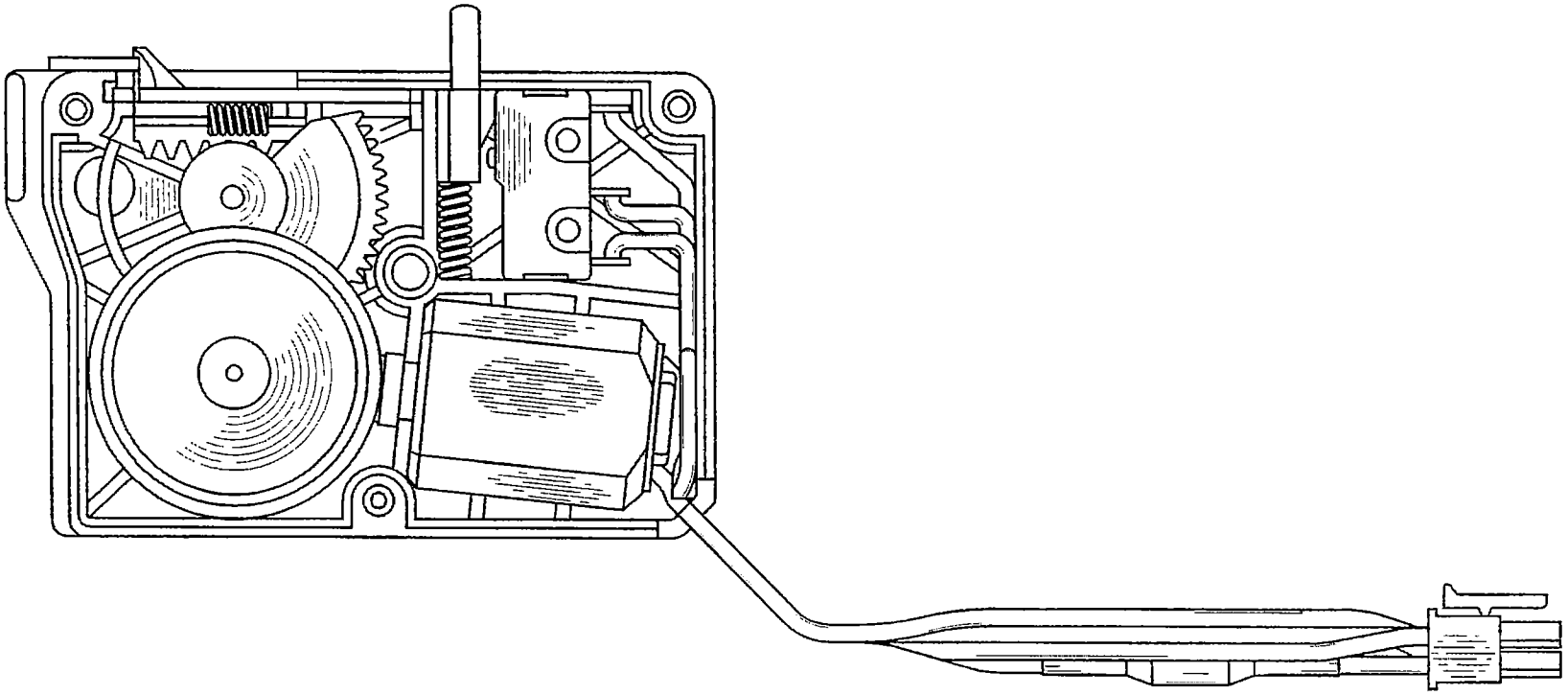
FIG. 27 is a view similar to FIG. 26 showing the release member in a return position.

In the operation of actuator 702, a control circuit like that previously described is operative to supply electrical power to the motor 706, which causes the release member 722 to be moved from the return position shown in FIG. 24 to the release position shown in FIG. 25. Movement of the release member in the first direction (from right to left as shown in the Figures) is operative to cause the release pawl of a latch assembly to be released from engagement holding a catch jaw. Thereafter, in accordance with the configuration of the control circuit, the motor 706 is operated to cause the release member 722 to move in an opposed direction (from left to right as shown in the Figures) to the return position shown in FIG. 24. As previously discussed, in this position in the exemplary embodiment the latch assembly may return to the latched condition.

In some exemplary embodiments, the control circuit or the wiring harness includes at least one voltage or current limiter 752. In the exemplary arrangement, the voltage or current limiter operates to deliver electricity to cause the motor to apply greater driving force to the release member when moving in one direction than when moving in the opposed direction. In the exemplary arrangement, the voltage or current limiter is operative to cause the motor to apply a greater movement force when the release member moves from the return position toward the release position, and a lesser force when moving from the release position back toward the return position. This is done in an exemplary arrangement to enable the motor to deliver sufficient force to move the release member quickly and apply sufficient force to move the release pawl and change the condition of the latch. In the exemplary arrangement, when the release member moves from the release position back to the return position, it is not engaging components of the latch and therefore the need for driving force is less. Further, in this exemplary arrangement the wear and tear and shock that the release member experiences at the end of its travel to the return position are reduced. In the exemplary arrangement, the limiter is positioned in the wiring harness 746 and comprises a Zener diode. Of course, it should be understood that in other arrangements other approaches may be used, including providing in the control circuit for the motor, circuitry which provides voltage or current limiting for movement of the motor in one or both directions.

The exemplary actuator 702 may further achieve more efficient operation and longer life by providing cushioning of the release member when it reaches its extremes of travel to the release position and in the return position. This is accomplished in the exemplary embodiment in the manner described in FIGS. 26-31. In the exemplary arrangement, as shown in the reverse view of the actuator 704 from that shown in FIGS. 24 and 25, the release member 722 includes thereon a first bumper portion 754 and a second bumper portion 756, each of which may also be referred to herein as bumpers. The bumper portions 754 and 756 extend generally transversely of the gear rack 724 on the release member 722. The bumper portions 754 and 756 move in guided relation in a linear guide trough 758 in the housing.

In the exemplary embodiment, a linear compression spring 760 is disposed in a pocket 762. The pocket 762 is configured so that a substantial portion of a diameter of the spring extends outside the pocket and into the guide trough 758.

In the exemplary arrangement, the spring 760 is positioned between the first bumper portion and the second bumper portion. The spring is positioned so as to biasingly oppose movement of the release member with increasing opposing force as the release member moves beyond the release and return positions in the release direction and return direction respectively.

Figure 28:
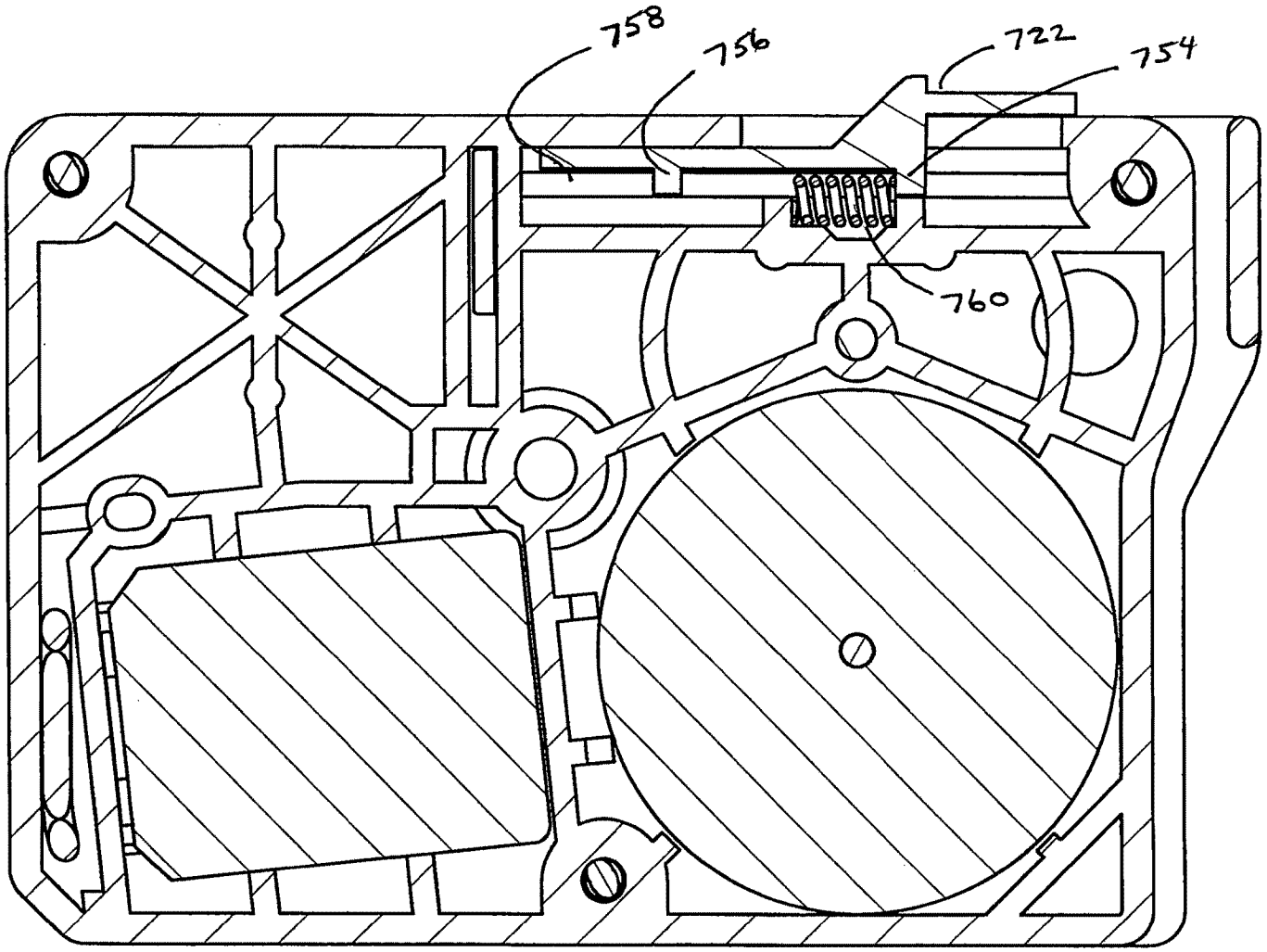
FIG. 28 is an enlarged view similar to FIG. 26 showing the release member in a release position.

For example, as represented in FIG. 28, the release member 722 is shown moved from the return position to the release position in which the release member moves the release pawl to unlatch the latch. As represented in FIG. 28, as the release member moves from right to left in the Figure, the spring 760 engages the first bumper portion 754 and acts to oppose movement in the first direction beyond the release position. This serves to cushion the travel of the release member 722 as it reaches the release position.

Figure 29:
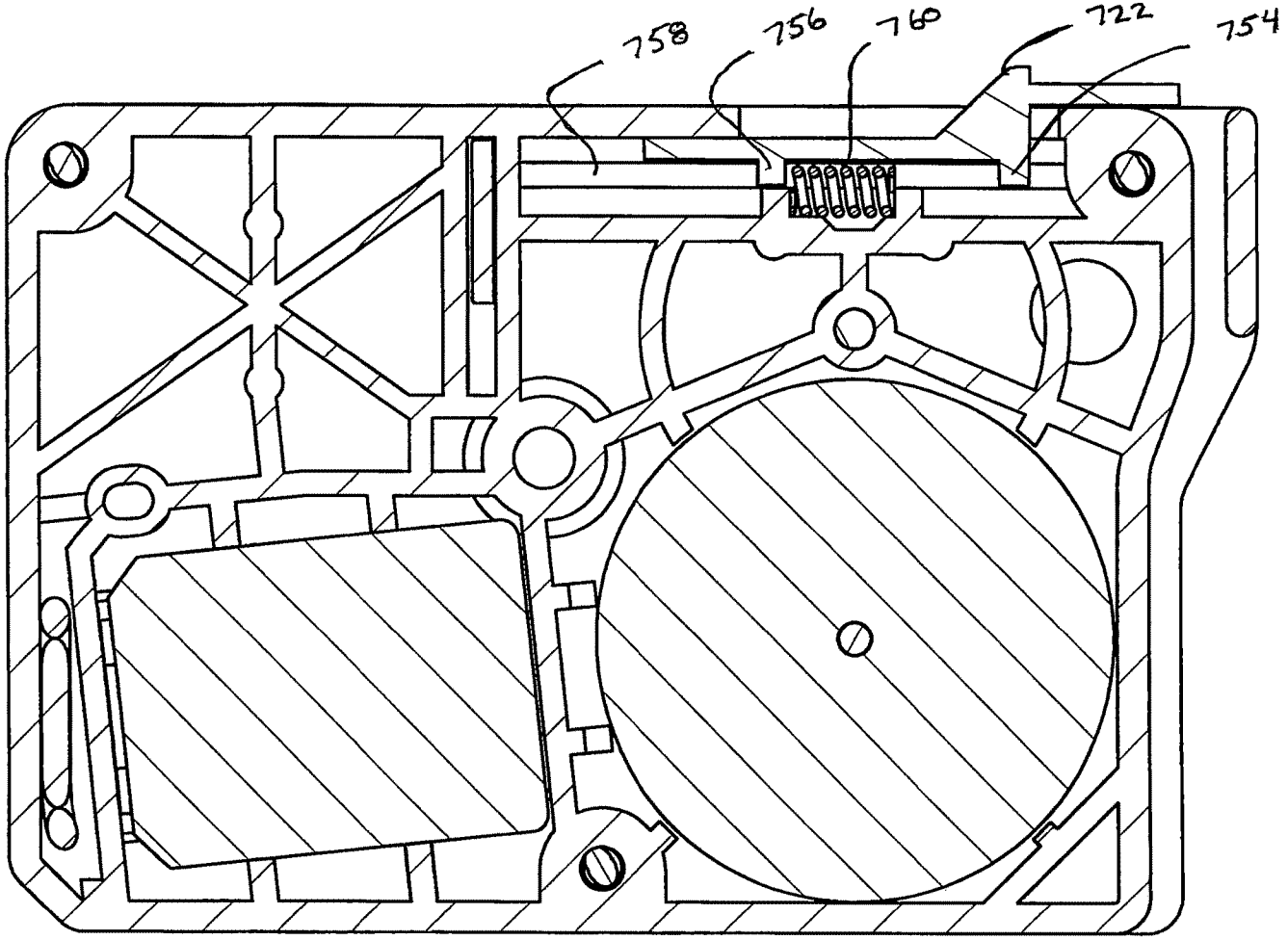
FIG. 29 is an enlarged view similar to FIG. 27 showing the release member in a return position.
Figure 30:
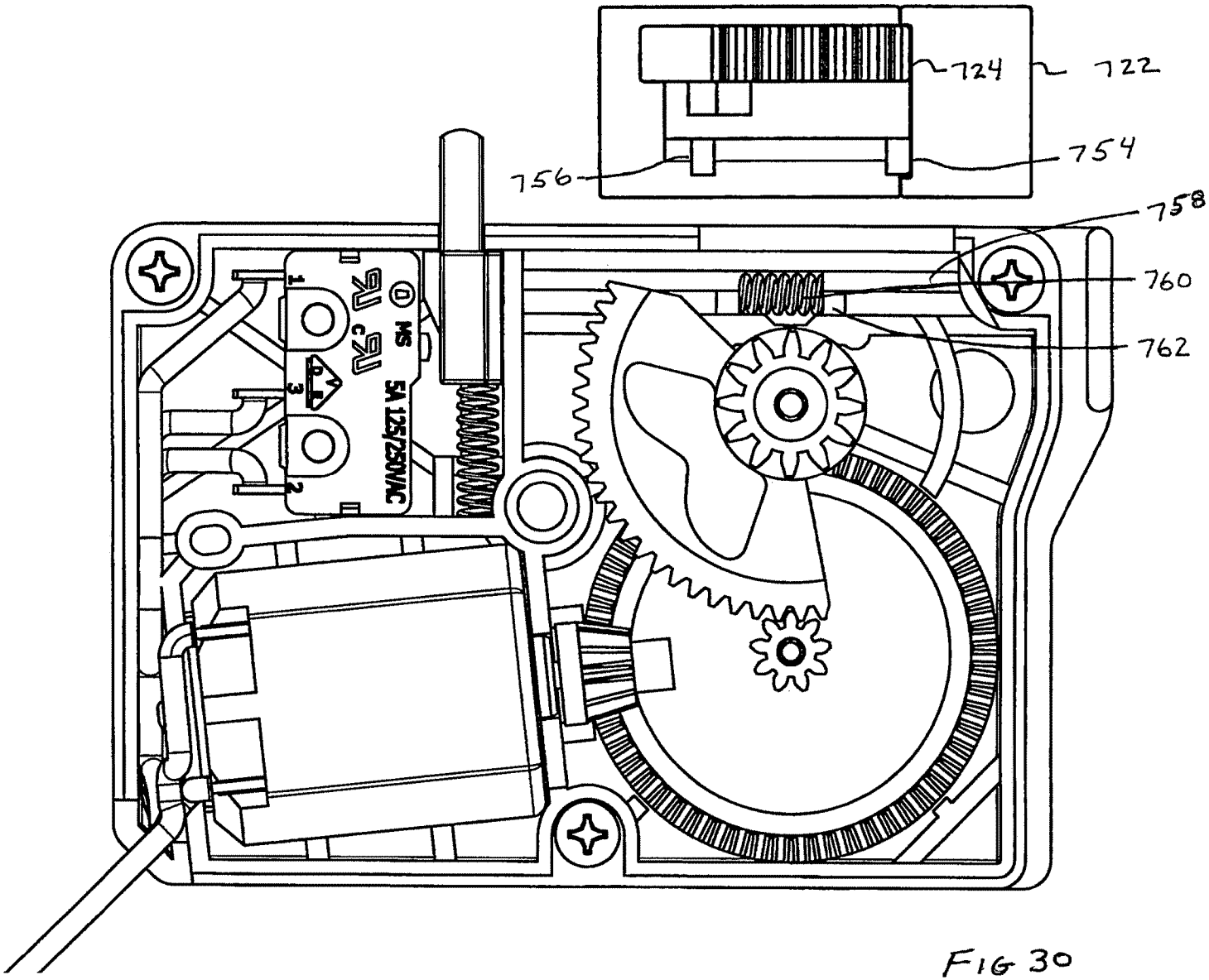
FIG. 30 is a transparent view of the latch mechanism, including the release member shown transposed 90 degrees from the housing of the latch actuator.
Figure 31:
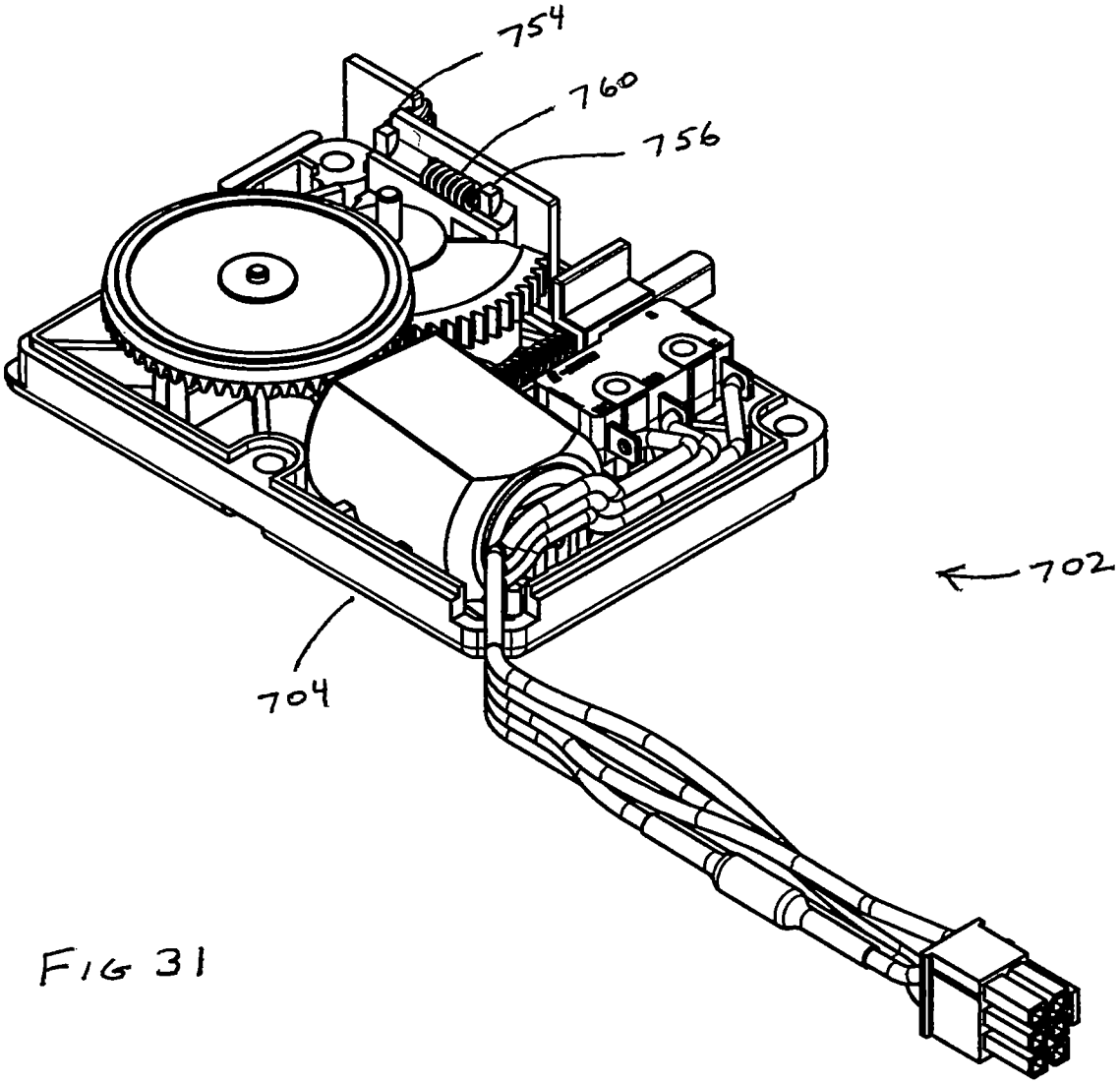
FIG. 31 is a rear top isometric view of the exemplary latch actuator.

Likewise, as shown in FIG. 29, when the release member is returned to the return position, the bumper portion 756 engages the spring 760, which opposes movement of the release member in the opposed direction toward the return position.

As can be appreciated, this exemplary arrangement reduces the shock and potentially damaging impacts that might otherwise occur when the motor moves the release member 722 to the extremes of travel in the first direction to the release position and in the second direction to the return position. The exemplary arrangement of spring 760 serves to cushion the stopping action for the release member in each of these positions and reduces the potential for damage and premature failure of the actuator. In some exemplary arrangements the linear spring may begin to apply biasingly opposing force as the release member approaches or at the release and/or return position or positions, and also apply increasing opposing force with movement beyond the release and/or return positions to assure that movement of the release member is stopped in a desired location. Of course, it should be understood that this arrangement is exemplary and other arrangements of springs or other resilient or impact absorbing structures and arrangements may be utilized in other embodiments to provide the functions of limiting travel and reducing potential damage to the release member and the gear train at the extremes of travel.

Figure 32:
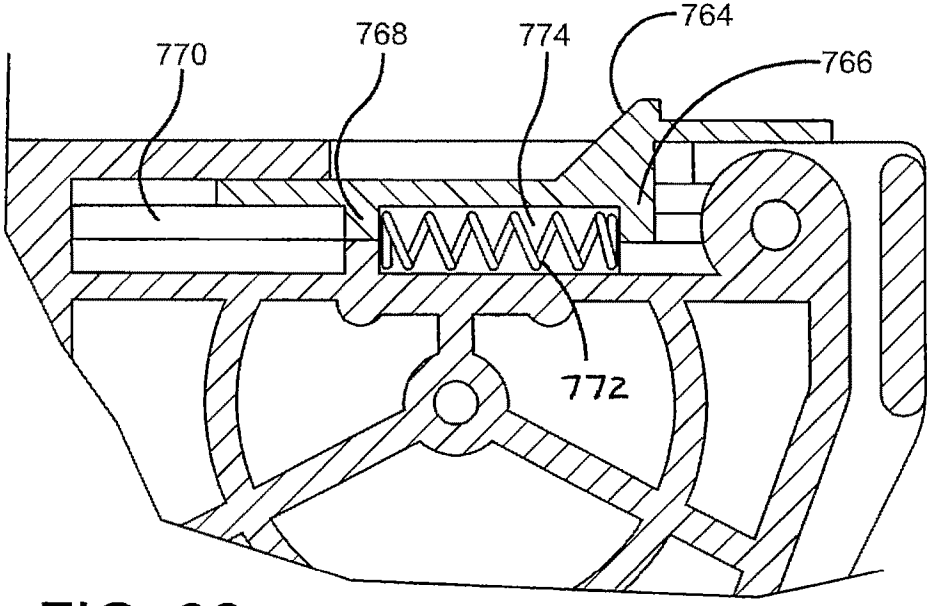
FIGS. 32 and 33 are cross-sectional views of an alternative arrangement for a release member that is configured to automatically return from the release position to the return position.
Figure 33:
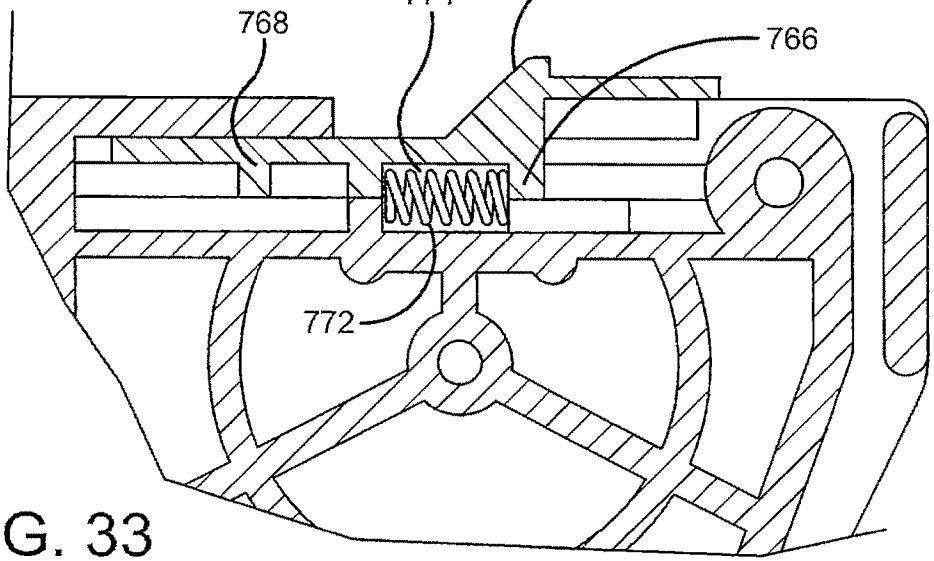

FIGS. 32 and 33 show a further alternative arrangement of a release member 764. In this exemplary arrangement, biasing force is provided to return the release member to the return position without the need for the motor to drive the release member back to the return position.

In this exemplary arrangement, the release member 764 includes a first bumper portion 766 and a second bumper portion 768, as in the previous embodiment. The bumper portions are configured to ride in a linear guide trough 770 as the release member moves between the release and return positions. A linear compression spring 772 is positioned in a pocket 774 in the housing.

In the exemplary arrangement, the motor of the actuator causes the release member to move from the return position shown in FIG. 32 to the release position shown in FIG. 33. Such movement causes the spring 772 to be increasingly compressed by engagement with the first bumper portion 766. In this exemplary arrangement, the spring 772 absorbs sufficient force so that when electrical power is no longer applied to the motor, the spring expands to its original configuration as shown in FIG. 32. This returns the release member to the return position as shown. As a result, this exemplary configuration avoids the need for the control circuitry associated with the actuator to reverse the direction of the motor from that used to move the release member to release the latch. Further, the exemplary arrangement represented by FIGS. 32 and 33 may enable the release member to move to the return position as soon as current is no longer being supplied to the motor, thus enabling the actuator configuration to be in a position to have the latch assembly relatched quickly after unlatching action occurs. In alternative embodiments circuitry may be provided which brakes the motor to selectively hold the release member in the release position and/or in the return position. Of course, these approaches are merely exemplary approaches that may be taken in exemplary embodiments.

FIG. 34 shows a portion of an electrical schematic of control circuitry used in conjunction with controlling an exemplary embodiment of an actuator motor, such as motor 706. In an exemplary arrangement, when the actuator 702 is to move the release member 722 from the return position to the release position, relay contacts 776 and 778 are caused to be in the condition by the control circuitry to deliver the electrical unlock pulse represented in the upper portion of FIG. 34 to the motor. In this exemplary arrangement, electrical power is delivered to the motor by the control circuitry in the pulse from 0.5 to 0.6 seconds. This power pulse is sufficient in the exemplary embodiment to operate the motor and cause the release member to move from the return position to the release position.

In this exemplary arrangement when the actuator 702 is to have the release member move from the release position to the return position, the control circuit is operative to change the condition of the relay contacts 776 and 778 to the condition shown in the lower portion of FIG. 34. An electrical power pulse lasting from 0.5 to 0.6 seconds is delivered, which is operative to cause the release member to move to the return position. Of course, this approach is exemplary and in other embodiments other approaches may be used.

Figure 35:
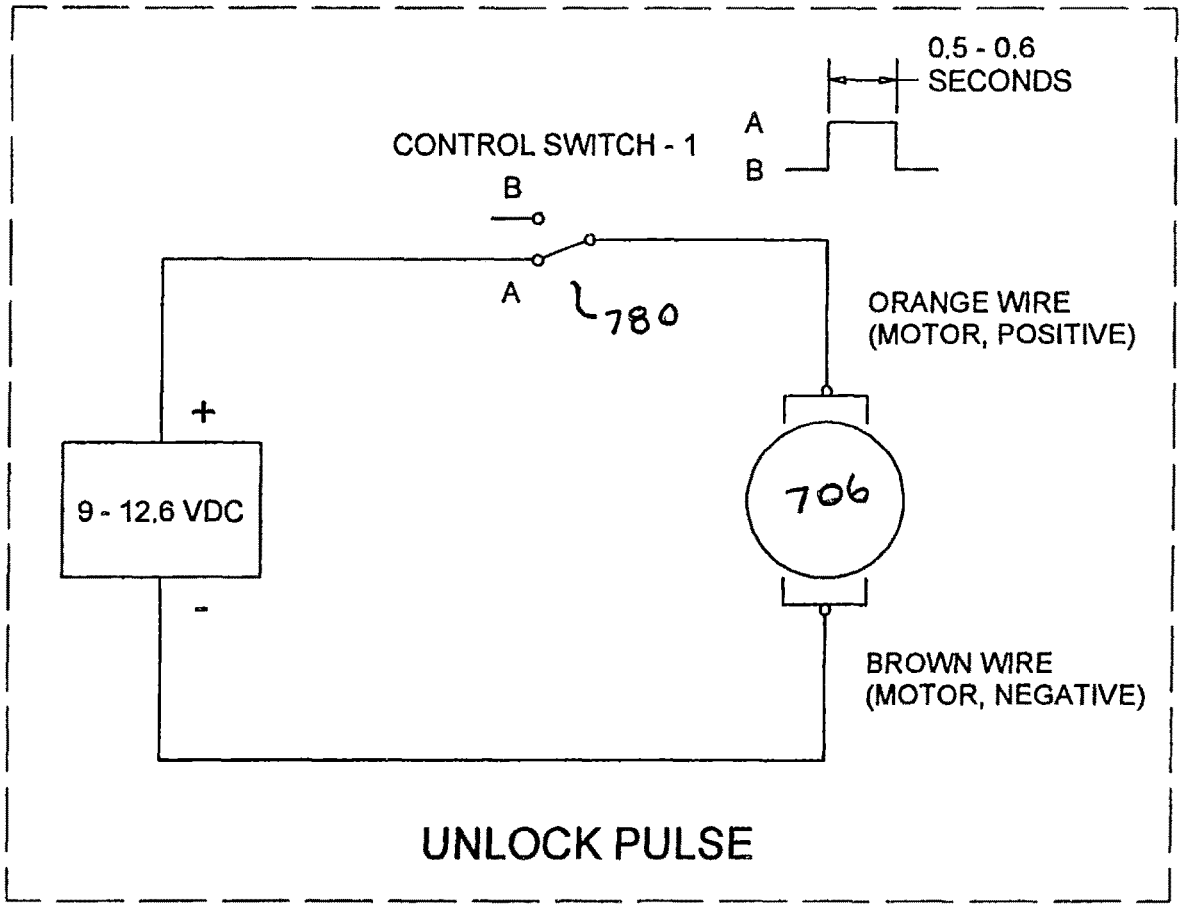
FIG. 35 is an alternative schematic view of control circuitry used in an exemplary embodiment that controls the motor of a latch actuator in an arrangement that provides for the automatic return of the release member to the return position.

FIG. 35 is representative of the control circuitry that is used in conjunction with an exemplary actuator that provides for the automatic return of the release member, such as through spring action as represented in FIGS. 32 and 33. In this exemplary arrangement, the control circuitry is operative to position relay contact 780 in the manner shown in FIG. 35, and deliver a power pulse to the motor 706 having a duration from 0.5 to 0.6 seconds. This power pulse is operative to cause the release member to move from the return position to the release position, unlatching the latch assembly. When the release member is to return to the return position, the condition of relay contact 780 is changed so that power is no longer delivered to the motor. When this occurs, the action of the compression spring, for example spring 772, is operative to cause the release member to move in the second direction until it reaches the return position. Of course, it should be understood that these approaches are exemplary and in other arrangements other approaches may be used.

In other exemplary embodiments, the control circuitry may be configured to brake the motor to resist motor movement due to forces imparted thereto. For example, in some arrangements it may be desirable to hold the release member in a particular position and assure that the release member is not moved by external forces from a desired position. In such arrangements, the control circuitry may be operative to apply voltage to the motor of the actuator to hold the motor shaft and associated gear train and release member in a fixed position. This may be done, for example, by using a stepper motor or other motor configuration where applied voltage potentials will provide a strong force that is operative to hold the motor shaft fixed and resist forces that would otherwise tend to cause rotation thereof. Thus, for example, in some exemplary embodiments where the release member includes a spring return, the exemplary control circuitry may be operative to hold the position of the motor and gear train fixed once the release member has moved to the release position for a desired period of time before allowing the release member to move to the return position.

The control circuitry of such exemplary embodiments may operate to brake and hold the motor shaft and thus the release member for as long as desired before permitting such return. Of course, this exemplary approach is only one of many that may be utilized in connection with a control circuit that is selectively operative to brake the motor to resist motor movement due to external forces that may be applied thereto.

Figure 36:
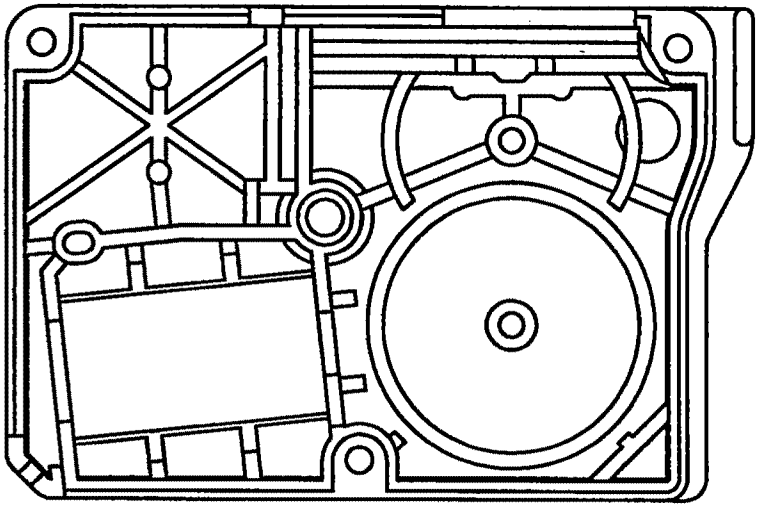
FIG. 36 is a side view of a base housing portion of an exemplary latch housing.
Figure 37:
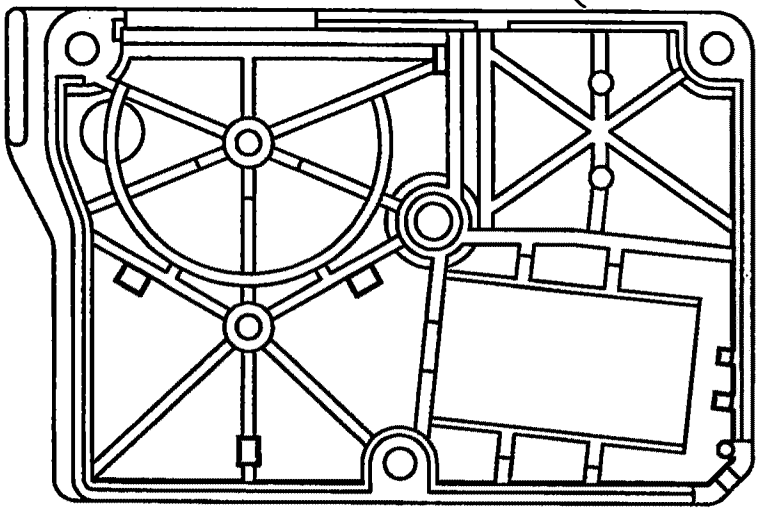
FIG. 37 is a side view of an exemplary cover housing portion.
Figure 38:
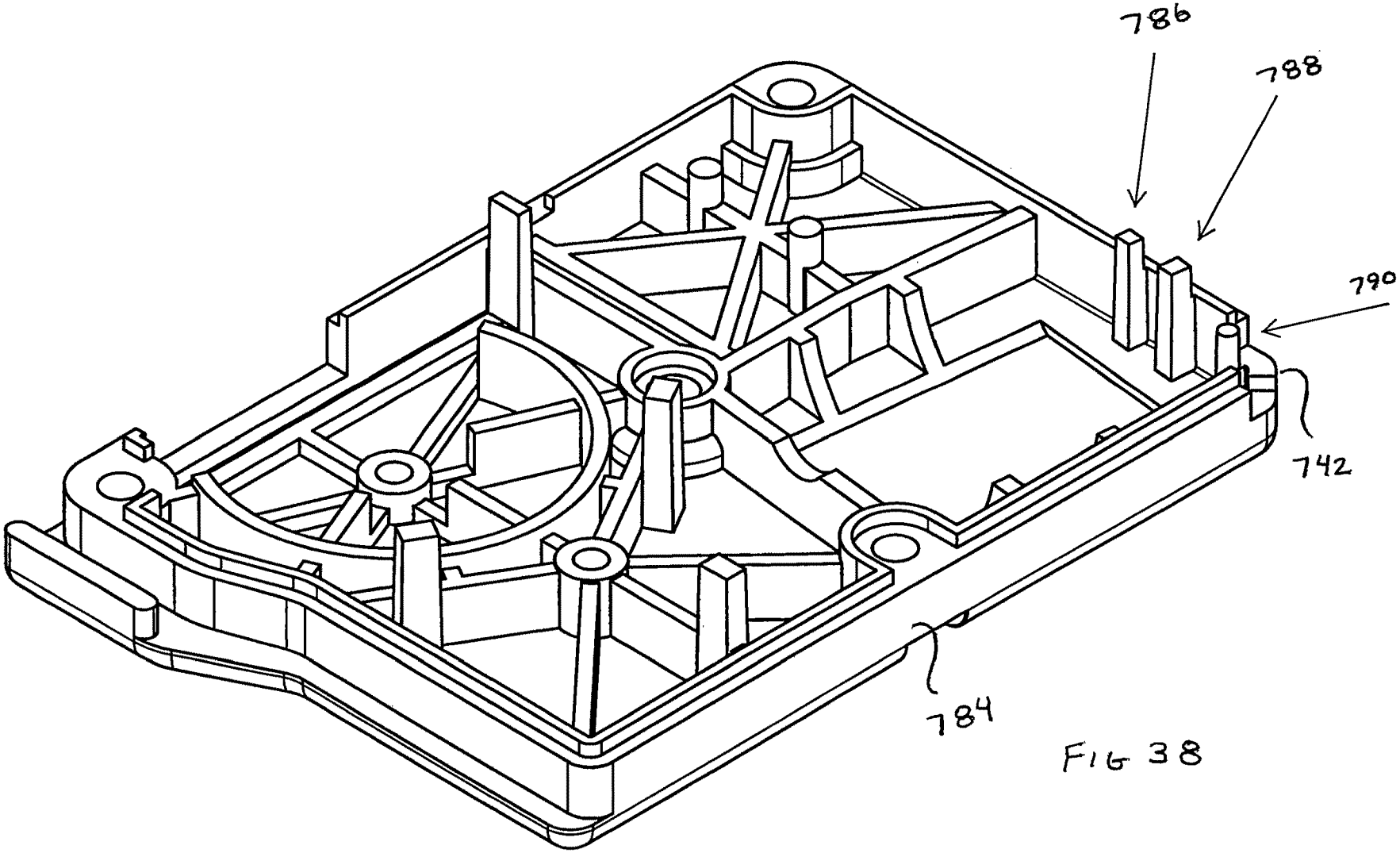
FIG. 38 is an isometric view of the housing cover portion shown in FIG. 37.

FIGS. 36-38 show the exemplary housing portions associated with the housing 704 of actuator 702. Housing portion 782, which may be alternatively referred to as a casing, shown in FIG. 36 includes internal structures for supporting the motor, the switch, the gears and the release member of the actuator. Exemplary structures include strengthening ribs that are molded into the housing portion to provide strength and to guide the movement of the gear portions and other structures during operation of the actuator. The exemplary housing portion 782 also includes the apertures for fasteners, support for shafts, guides for the plunger member and other structures included in the exemplary embodiment.

FIG. 37 shows the outer housing portion 784 of housing 704. Housing 784, similar to housing portion 782, includes apertures and rib structures to accommodate the support and movement of components within the housing. Housing portion 784 further includes suitable closure member structures to close the interior area of the housing and to also support the components which are positioned therein.

As shown in greater detail in FIG. 38, housing portion 784 of the exemplary embodiment includes a plurality of clamp projections 786, 788 and 790. In an exemplary embodiment, the clamp projections are configured to engage the switch wires 740 and the motor wires 744 within the interior area of the housing.

Figure 40:
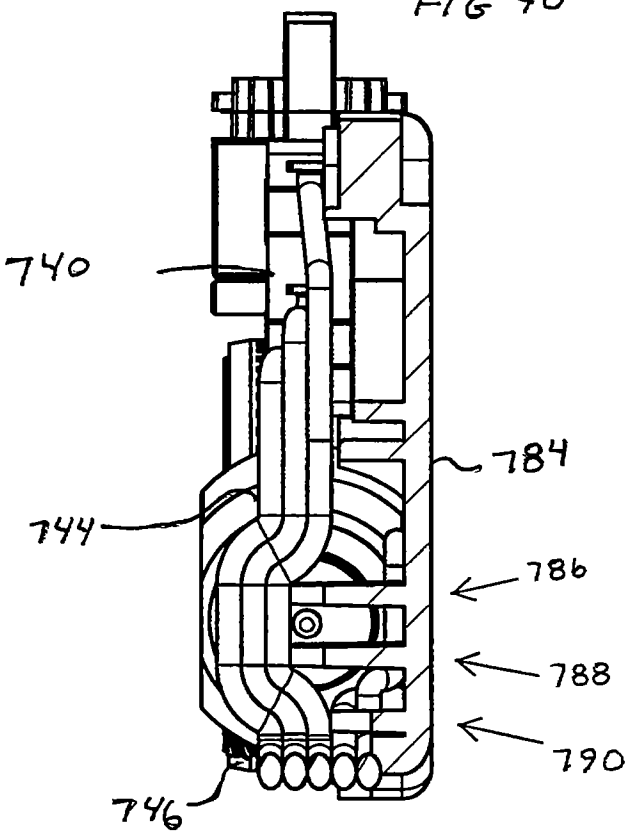
FIG. 40 is a cross-sectional view showing a cross section of the housing portion shown in FIG. 39 in the area of the clamp projections.
Figure 39:
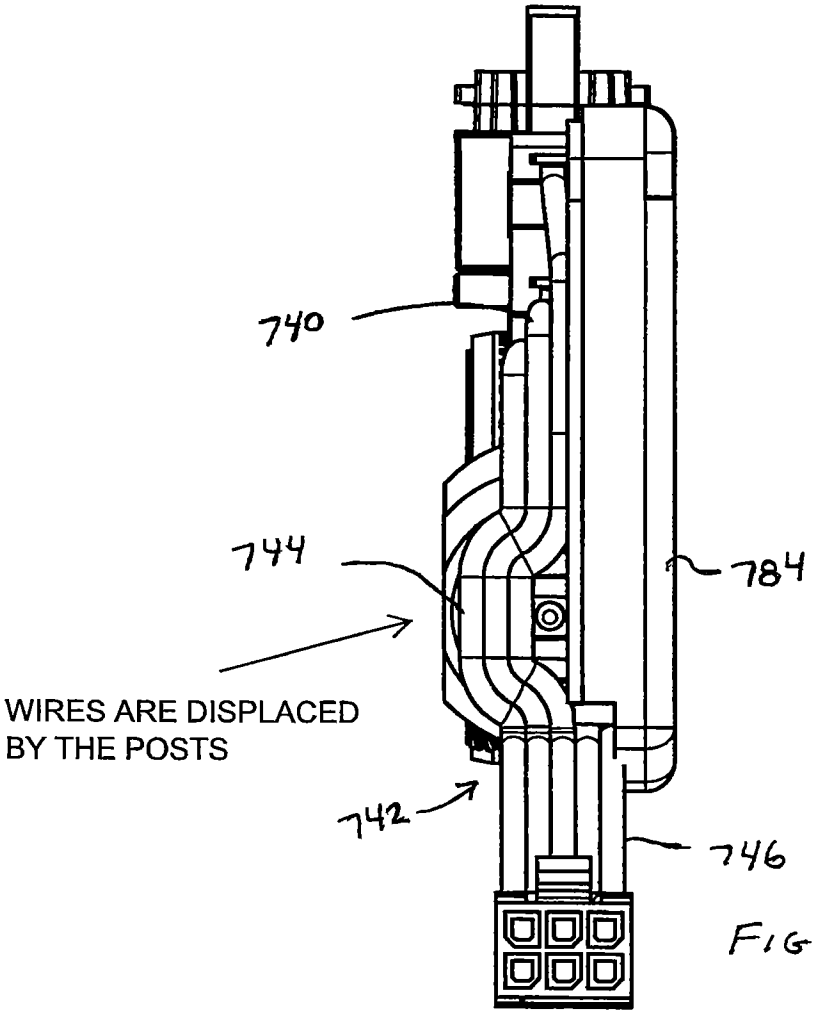
FIG. 39 is an end view of the housing cover portion shown with the base portion removed from the housing assembly.

As represented in FIGS. 39 and 40, the exemplary clamp projections extend in the interior area and engage the switch wires and motor wires adjacent to the opening 742 from which the wires exit the housing. The engagement of the wires with the clamp projections hold the wires firmly within the interior area of the housing and help to resist external forces which might otherwise cause the wires to be pulled out of the housing and/or disengaged from the electrical components therein. As can be appreciated from FIGS. 39 and 40, when the exemplary housing casings or portions 782 and 784 are in engaged relation, the clamp projections hold the wires firmly within the housing and help to avoid damage that might be caused by excessive forces that are applied to the wiring harness 746. Of course, these approaches are exemplary and in other embodiments other approaches may be used.

In the foregoing description, certain terms have been described to describe example embodiments for purposes of brevity, clarity and understanding. However, no unnecessary limitations are to be implied therefrom, because such terms are used for descriptive purposes and are intended to be broadly construed. Moreover, the descriptions and illustrations herein are by way of examples and the embodiment is not limited to the features shown or described.

Further, in the following claims any feature described as a means for performing a function shall be construed as encompassing any means known to those skilled in the art as being capable of carrying out the recited function, and shall not be deemed limited to the particular means shown or described for performing the recited function in the foregoing description, or mere equivalents thereof.

Having described the features, discoveries and principles of the exemplary arrangements, the manner in which they are constructed and operated, and the advantages and useful results attained; the new and useful structures, devices, elements, arrangements, parts, combinations, systems, equipment, operations, methods, processes and relationships are set forth in the appended claims.

We claim:

1. An apparatus comprising:

an actuator configured to operate a latch, wherein the latch is configured to be in a closed condition wherein the latch engages an item, and the latch is configured to be in an open condition wherein the latch disengages the item, wherein the latch includes a movable catch jaw, wherein the catch jaw is operative in a first position to engage a member operatively connected to the item when the latch is in the closed condition, and wherein the catch jaw is operative in a second position to enable the member to disengage from the catch jaw when the latch is in the open condition, wherein the actuator includes a drive and a release member, wherein the drive is in operative connection with the release member, wherein the release member is in operative connection with the catch jaw, wherein the release member is operative to linearly move along a straight line in a first direction from a return position in which the catch jaw is in the first position to a release position in response to operation of the drive, wherein the linear movement of the release member in the first direction to the release position enables the catch jaw to be movable from the first position to the second position, a spring, wherein in the return position of the release member the spring does not act to apply biasing force that resists movement of the release member in the first direction toward the release position, and after the release member has moved from the return position in the first direction toward the release position the spring becomes operative to biasingly oppose movement of the release member in the first direction, whereby movement of the release member in the first direction beyond the release position is biasingly opposed by the spring.

2. The apparatus according to claim 1 wherein the latch further includes a movable release pawl, wherein the release pawl is in operative connection with the catch jaw, wherein the release pawl is operative in a first pawl position to engagingly hold the catch jaw in the first position, and wherein movement of the release pawl to a second pawl position enables the catch jaw to be movable from the first position to the second position, wherein the release pawl includes a release projection, wherein the release projection is movable in operative engagement with the release member.

3. The apparatus according to claim 2 wherein the release member includes a release projection engaging recess, wherein in the release position the release projection extends within the release projection engaging recess.

4. The apparatus according to claim 2 wherein the actuator includes a housing, wherein the housing generally surrounds the drive, wherein the release member includes a finger that extends outside the housing, wherein the release pawl of the latch includes a further release projection, a release lever, wherein the release lever is movably mounted in supported operative connection with the housing, wherein the release lever is movably engageable with the further release projection, wherein movement of the release lever is operative to cause movement of the release pawl to enable the catch jaw to be movable from the first position to the second position when the release member is not in the release position and without movement of the release member.

5. The apparatus according to claim 2 wherein the actuator further includes a housing, wherein the housing houses the drive, and further including a trip release member movably mounted in supported operative connection with the housing, wherein the trip release member is configured to cause release member movement in the first direction to the release position responsive to movement of the trip release member without operation of the drive.

6. The apparatus according to claim 4 wherein the exterior of the housing includes a guide slot, wherein the release lever is movable in guided relation in the guide slot.

7. The apparatus according to claim 6 wherein the guide slot of the housing includes in cross-section a pair of opposed tracks, wherein the release lever is movable in guided relation between the tracks.

8. The apparatus according to claim 4 wherein the spring is in operatively supported connection with the housing, wherein the spring comprises a linear compression spring, wherein the spring is operative to compress and increasingly oppose movement of the release member in the first direction beyond the release position.

9. The apparatus according to claim 8 wherein the release member is movable in a second direction opposed of the first direction from the release position to the return position, wherein movement of the release member in the second direction is operative to enable the release projection to extend in the projection engaging recess and hold the catch jaw in the first position, wherein the spring is operative to biasingly oppose movement of the release member in the second direction beyond the return position.

10. The apparatus according to claim 9 and further including a first bumper and a second bumper, wherein the first bumper and the second bumper are in operative connection with the release member, wherein the spring is positioned between the first bumper and the second bumper, wherein the spring opposes movement of the release member in the first direction beyond the release position by operative engagement with the first bumper, and opposes movement in the second direction beyond the return position by operative engagement with the second bumper.

11. The apparatus according to claim 10 wherein the housing includes a linear guide trough, wherein the first and second bumpers are constrained to move linearly in the guide trough, wherein the spring extends in the guide trough.

12. The apparatus according to claim 8 wherein movement of the release member in a second direction opposed of the first direction to the return position is operative to enable the release projection to extend in the projection engaging recess and hold the catch jaw in the first position.

13. The apparatus according to claim 12 wherein the drive includes an electric motor, wherein the electric motor is configured to selectively cause movement of the motor to be braked, wherein the release member is held in the release position against opposed biasing force of the spring, and movement of the motor, wherein the release member is moved to the return position responsive at least in part to the biasing force of the spring.

14. The apparatus according to claim 4 wherein movement of the release member in the first direction to the release position is operative to enable the catch jaw to be movable to the second position, wherein movement of the release member in a second direction opposed of the first direction to the return position is operative to enable the release projection to extend in the projection engaging recess and hold the catch jaw in the first position, wherein the drive is operative to cause greater force to be applied to move the release member in the first direction than in the second direction.

15. The apparatus according to claim 14 wherein the drive comprises an electric motor, and further including at least one of a voltage limiter or a current limiter in operative connection with the motor, wherein the at least one voltage limiter or current limiter acts to reduce force applied by the motor to move the release member in the second direction relative to force applied by the motor to move the release member in the first direction.

16. The apparatus according to claim 15 wherein the at least one voltage limiter or current limiter comprises a Zener diode.

17. The apparatus according to claim 14 wherein the motor is selectively operative to hold the release member in at least one of the first position and the second position.

18. The apparatus according to claim 15 and further including a control circuit, wherein the control circuit is selectively operative to brake the motor to resist motor movement due to force imparted thereto by the release member.

19. The apparatus according to claim 18 wherein the control circuit is selectively operative to brake the motor to hold the release member in one of the release position and the return position.

20. The apparatus according to claim 14 wherein the latch includes a latch plate, wherein the catch jaw and the release pawl are in movable operative supported connection with the latch plate, wherein the housing is mounted in operatively fixed connection with the latch plate.

21. The apparatus according to claim 20 wherein one of the latch plate and the housing includes a projection, and the other of the latch plate and the housing includes a recess sized to accept the projection therein, wherein engagement of the projection and recess is operative to prevent movement of the housing relative to the latch plate.

22. The apparatus according to claim 21 wherein the housing includes a first aperture and the latch plate includes a second aperture, and wherein the first and second apertures are aligned and are disposed away from the projection and recess, a fastener, wherein the fastener extends in the first and second apertures, wherein the fastener is operative to hold the housing and the latch plate in engaged relation.

23. The apparatus according to claim 21 wherein the housing includes at least one wire extending therefrom, wherein the latch plate includes at least one wire tie opening, wherein the at least one wire tie opening is configured to accept a wire tie in engaged relation therewith to enable the at least one wire to be held in a fixed operatively engaged position relative to the latch plate.

24. The apparatus according to claim 21 wherein the housing includes an interior area, wherein a switch is positioned in the interior area, wherein the switch is operative to change condition responsive at least in part to a change in position of the catch jaw, wherein the switch is in operative connection with at least one switch wire, wherein the at least one switch wire extends in the interior area and through an opening in the housing, wherein the drive includes an electric motor, wherein the motor extends in the interior area, wherein the motor is in operative connection with at least one motor wire, wherein the at least one motor wire extends in the interior area and through the opening, wherein the interior area includes at least one clamp projection, wherein the at least one clamp projection engages the at least one switch wire and the at least one motor wire, wherein the at least one clamp projection is operative to resist pulling force applied outside the housing on the at least one switch wire or the at least one motor wire.

25. The apparatus according to claim 24 wherein the housing comprises a separable two-piece housing, wherein the at least one clamp projection engages the at least one switch wire and the at least one motor wire within the interior area when housing pieces are in engaged relation.

26. The apparatus according to claim 1 wherein the latch includes a latch plate, wherein the catch jaw is movably mounted in supported connection with the latch plate, and wherein the drive and the release member are mounted in operative supported connection with the latch plate.

27. The apparatus according to claim 1 wherein the actuator includes a housing, wherein the drive is housed within the housing, wherein the housing exterior includes at least one guide slot, a release lever, wherein the release lever is movable within the guide slot, wherein the release lever is in operative connection with the catch jaw, wherein movement of the release lever in the guide slot is operative to enable the catch jaw to move from the first position to the second position when the release member is not in the release position.

28. An apparatus comprising:

an actuator configured to operate a latch, wherein the latch is configured to be in a closed condition wherein the latch engages an item, and the latch is configured to be in an open condition wherein the latch disengages the item, wherein the latch includes a movable catch jaw, wherein the catch jaw is operative in a first position to engage a member operatively connected to the item when the latch is in the closed condition, and wherein the catch jaw is operative in a second position to enable the member to disengage from the catch jaw when the latch is in the open condition, wherein the actuator includes a drive motor and a release member, wherein the drive motor is in operative connection with the release member, wherein the release member is in operative connection with the catch jaw, wherein the release member is operative responsive to the drive motor to linearly move along a straight line in response to operation of the drive motor, between a return position and a release position, wherein the linear movement of the release member in a first direction from the return position to the release position enables the catch jaw to be movable from the first position to the second position, and movement in a second direction opposed of the first direction from the release position causes the release member to be in the return position, wherein the actuator further includes a spring, wherein the spring is in operative connection with the release member and biasingly opposes movement of the release member in the first direction in the release position, and opposes movement of the release member in the second direction in the return position, a circuit, wherein the circuit is in operative connection with the drive motor, wherein the circuit is selectively operative to brake the drive motor to hold the release member in the release position against opposing force of the spring.

29. The apparatus according to claim 28 wherein the release member is operative responsive to the drive motor to linearly move along the straight line in the second direction opposed of the first direction to the return position, wherein in the return position of the release member the catch jaw is enabled to move from the second position to the first position, wherein the spring opposes movement of the release member in the second direction beyond the return position.

30. An apparatus comprising:

an actuator configured to operate a latch, wherein the latch is configured to be in a closed condition wherein the latch engages an item, and the latch is configured to be in an open condition wherein the latch disengages the item, wherein the latch includes a moveable catch jaw, wherein the catch jaw is operative in a first position to engage a member operatively connected to the item when the latch is in the closed condition, and wherein the catch jaw is operative in a second position to enable the member to disengage from the catch jaw when the latch is in the open condition, wherein the actuator includes a drive motor and a release member, wherein the drive motor is in operative connection with the release member, wherein the release member is in operative connection with the catch jaw, wherein the release member is operative to linearly move along a straight line in a first direction in response to operation of the drive motor, wherein the linear movement of the release member in the first direction to a release position enables the catch jaw to be moveable from the first position to the second position, wherein the release member is operative responsive to the drive motor to linearly move along the straight line in a second direction opposed of the first direction to a return position, wherein in the return position of the release member the catch jaw is enabled to move from the second position to the first position, a linear spring, wherein in the return position of the release member the spring does not act to apply biasing force that resists movement of the release member in the first direction toward the release position, and after the release member has moved in the first direction from the return position toward the release position, the spring becomes operative to biasingly oppose movement of the release member in the first direction, whereby movement of the release member in the first direction beyond the release position is opposed by the spring, at least one of a voltage limiter and a current limiter in operative connection with the drive motor, wherein the at least one voltage limiter and current limiter is operative to cause the drive motor to produce less force to move the release member in the second direction than to move the release member in the first direction.

31. The apparatus according to claim 30 wherein the spring is operative to biasingly oppose movement of the release member in the second direction beyond the return position.

32. The apparatus according to claim 1 wherein the spring comprises a linear spring.

33. The apparatus according to claim 32 wherein movement of the release member in a second direction from the release position to the return position causes the spring to biasingly oppose movement of the release member in the second direction beyond the return position.

34. The apparatus according to claim 33 wherein the release member includes a first release member portion and a second release member portion, wherein the first and second release member portions each extend transversely of the straight line, wherein the spring extends along the straight line and is in operative connection with the release member between the first release member portion and the second release member portion, wherein the spring is operative to oppose movement of the release member in the first direction beyond the release position by operative contact with the first release member portion, and wherein the spring is operative to oppose movement of the release member in the second direction opposed of the first direction beyond the return position by operative contact with the second release member portion.

35. An apparatus comprising:

an actuator configured to operate a latch, wherein the latch is configured to be in a closed condition wherein the latch engages an item, and the latch is configured to be in an open condition wherein the latch disengages the item, wherein the latch includes a movable catch jaw, wherein the catch jaw is operative in a first position to engage a member operatively connected to the item when the latch is in the closed condition, and wherein the catch jaw is operative in a second position to enable the member to disengage from the catch jaw when the latch is in the open condition, wherein the actuator includes a wall, a linear spring, a drive motor, and a release member, wherein the wall includes a first side and a second side, wherein the drive is in operative engagement with the release member, wherein the release member extends in operative moveable connection with the first side and includes a projection that extends through the wall and outward from the second side, wherein the projection is in operative connection with the catch jaw, wherein the release member is operative to linearly move along a straight line in a first direction from a return position to a release position in response to operation of the drive motor, wherein the linear movement of the release member in the first direction to a release position enables the catch jaw to be movable from the first position to the second position, wherein in the return position of the release member the spring does not act to apply biasing force that resists movement of the release member in the first direction toward the release position, and after the release member has moved in the first direction from the return position toward the release position the spring becomes operative to biasingly oppose movement of the release member in the first direction, whereby movement of the release member in the first direction beyond the release position is biasingly opposed by the spring.

* * * * *